US010214999B2

(12) United States Patent
Noske et al.

(10) Patent No.: US 10,214,999 B2
(45) Date of Patent: Feb. 26, 2019

(54) REMOTELY OPERATED ISOLATION VALVE

(71) Applicant: Weatherford Technology Holdings, LLC, Houston, TX (US)

(72) Inventors: Joe Noske, Houston, TX (US); Roddie R. Smith, Katy, TX (US); Paul L. Smith, Katy, TX (US); Thomas F. Bailey, Abilene, TX (US); Christopher L. McDowell, New Caney, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 585 days.

(21) Appl. No.: 14/885,024

(22) Filed: Oct. 16, 2015

(65) Prior Publication Data

US 2016/0090818 A1 Mar. 31, 2016

Related U.S. Application Data

(62) Division of application No. 13/237,347, filed on Sep. 20, 2011, now Pat. No. 9,163,481.

(Continued)

(51) Int. Cl.
*E21B 23/02* (2006.01)
*E21B 41/00* (2006.01)

(Continued)

(52) U.S. Cl.
CPC ..... *E21B 41/00* (2013.01); *E21B 23/02* (2013.01); *E21B 23/04* (2013.01); *E21B 23/06* (2013.01);

(Continued)

(58) Field of Classification Search
CPC ..... E21B 23/02; E21B 23/04
See application file for complete search history.

(56) References Cited

U.S. PATENT DOCUMENTS 2,171,171 A 8/1939 Brauer
4,378,839 A * 4/1983 Fisher, Jr. ..... E21B 23/02 166/217

(Continued)

FOREIGN PATENT DOCUMENTS

GB 2267522 A 12/1993
WO 2008063072 A1 5/2008
WO 2009133108 A1 11/2009

OTHER PUBLICATIONS

Canadian Office Action dated Mar. 24, 2016, for Canadian Patent Application No. 2,811,117.

(Continued)

*Primary Examiner* — Giovanna C. Wright
(74) *Attorney, Agent, or Firm* — Patterson + Sheridan, LLP

(57) ABSTRACT

A shifting tool for use in a wellbore includes a tubular housing having a bore formed therethrough; a tubular mandrel disposed in the housing and longitudinally movable relative thereto; and an engagement member moveable relative to the housing between an extended position, a released position, and a retracted position, wherein: the engagement member is movable from the retracted position to the extended position in response to movement of the mandrel relative to the housing, and the engagement member is further movable from the extended position to the released position in response to movement of the mandrel relative to the housing.

21 Claims, 31 Drawing Sheets

Related U.S. Application Data

(60) Provisional application No. 61/492,012, filed on Jun. 1, 2011, provisional application No. 61/384,591, filed on Sep. 20, 2010.

(51) Int. Cl.

| | |
|---|---|
| ***E21B 23/04*** | (2006.01) |
| ***E21B 34/14*** | (2006.01) |
| ***E21B 43/10*** | (2006.01) |
| ***E21B 23/06*** | (2006.01) |
| *E21B 21/00* | (2006.01) |

(52) U.S. Cl.

CPC ..... *E21B 34/14* (2013.01); *E21B 43/103* (2013.01); *E21B 2021/006* (2013.01)

(56) References Cited

U.S. PATENT DOCUMENTS

| | | | |
|---|---|---|---|
| 5,145,005 | A | 9/1992 | Dollison |
| 5,253,712 | A | 10/1993 | Swor |
| 5,390,739 | A | 2/1995 | Tailby |
| 5,494,105 | A | 2/1996 | Morris |
| 5,678,633 | A | 10/1997 | Constantine, Jr. |
| 5,797,454 | A | 8/1998 | Hipp |
| 6,152,232 | A | 11/2000 | Webb et al. |
| 6,199,635 | B1 | 3/2001 | Brunet et al. |
| 6,209,663 | B1 | 4/2001 | Hosie |
| 6,401,826 | B2 | 6/2002 | Patel |
| 6,575,249 | B2 | 6/2003 | Deaton |
| 6,644,110 | B1 | 11/2003 | Curtis et al. |
| 7,303,020 | B2 | 12/2007 | Bishop et al. |
| 7,306,031 | B2 | 12/2007 | Wright et al. |
| 7,451,809 | B2 | 11/2008 | Noske et al. |
| 7,597,151 | B2 | 10/2009 | Curtis et al. |
| 8,479,808 | B2 | 7/2013 | Gouthaman |
| 9,163,481 | B2 | 10/2015 | Noske et al. |
| 2003/0150622 | A1 | 8/2003 | Patel et al. |
| 2005/0230118 | A1 | 10/2005 | Noske et al. |
| 2006/0157240 | A1 | 7/2006 | Shaw et al. |
| 2008/0110643 | A1 | 5/2008 | Richard et al. |
| 2008/0245531 | A1 | 10/2008 | Noske et al. |
| 2009/0266544 | A1 | 10/2009 | Redlinger et al. |
| 2009/0272539 | A1 | 11/2009 | Lloyd et al. |
| 2009/0294124 | A1 | 12/2009 | Patel |
| 2011/0005772 | A1 | 1/2011 | Ceccarelli et al. |

OTHER PUBLICATIONS

Canadian Office Action dated Sep. 6, 2017 for Application No. 2,943,132.

PCT Invitation to Pay Additional Fees and Partial International Search Report, International Application No. PCT/US2011/052407, dated Mar. 13, 2013.

PCT International Search Report and Written Opinion for International Application No. PCT/US2011/052407 dated May 27, 2013.

Australian Examination Report for Patent Application No. 2011305573 dated Jun. 24, 2014.

Singapore Search Report and Written Opinion for Singapore Patent Application No. 201302002-9 dated Dec. 23, 2013.

Australian Office Action for Application No. 2011305573 dated Nov. 12, 2014.

European Office Action dated Jan. 12, 2018 for Application No. EP17193142.1.

European Office Action dated Apr. 7, 2014 for Application No. EP11761794.4.

European Office Action dated Nov. 26, 2015 for Application No. EP11761794.4.

Canadian Office Action dated May 30, 2014 for Application No. 2,811,117.

Canadian Office Action dated Dec. 15, 2014 for Application No. 2,811,117.

Canadian Office Action dated Feb. 20, 2018 for Application No. 2,943,132.

PCT Notification Concerning Transmittal of International Preliminary Report on Patentability for International Application No. PCT/US2011/052407 dated Jun. 13, 2013.

EPO Examination Report dated Jun. 27, 2016, for European Patent Application No. 11761794.4.

* cited by examiner

FIG. 2A
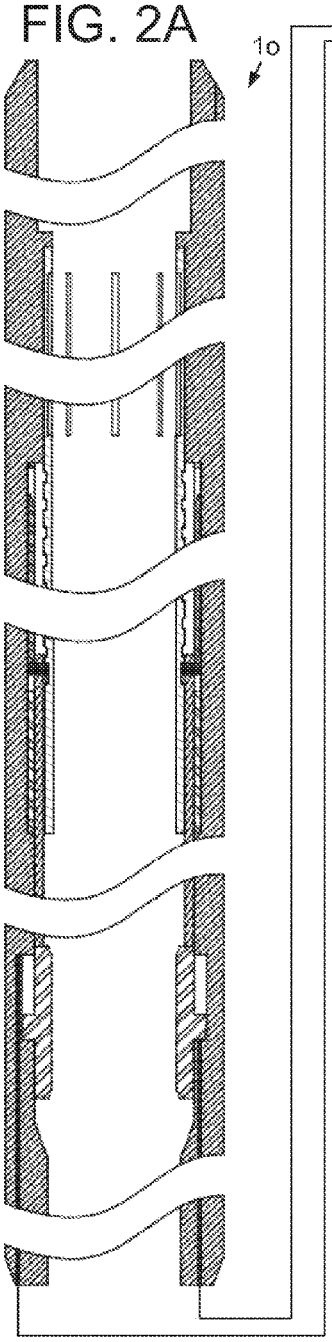
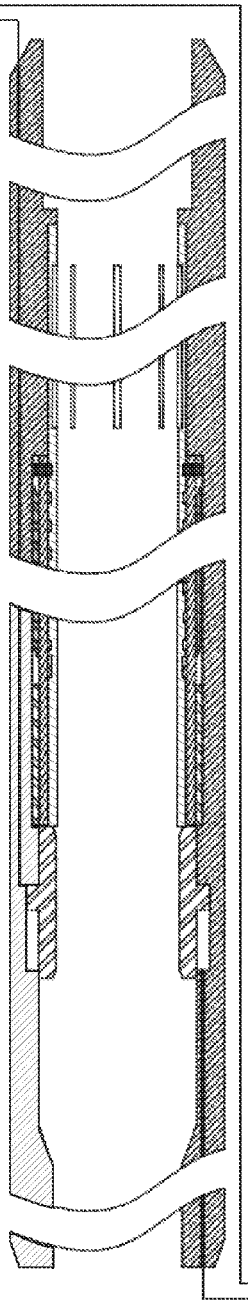
FIG. 2B
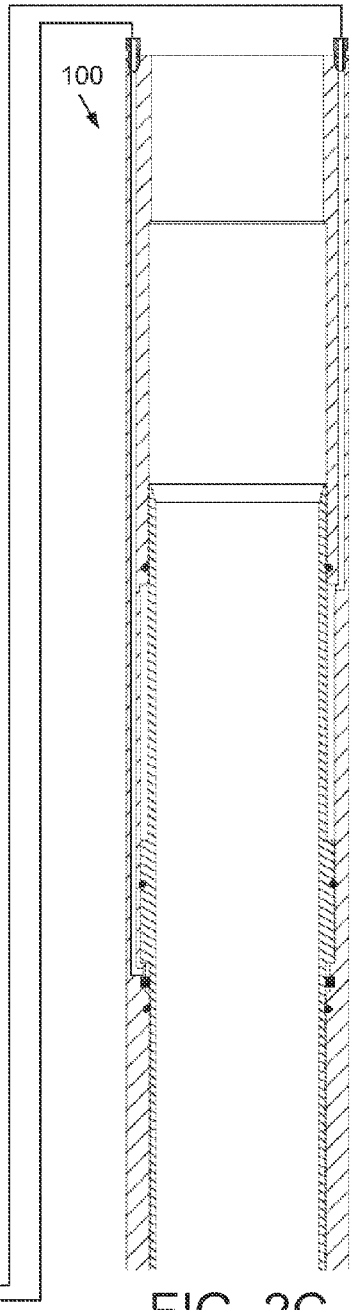
FIG. 2C

REMOTELY OPERATED ISOLATION VALVE

CROSS-REFERENCE TO RELATED APPLICATIONS

This application is a divisional application of U.S. patent application Ser. No. 13/237,347, entitled "Remotely Operated Isolation Valve", filed Sep. 20, 2011, now U.S. Pat. No. 9,163,481, issued on Oct. 20, 2015, which claims the benefit of U.S. Prov. Pat. App. No. 61/384,591, entitled "Remotely Operated Isolation Valve", filed on Sep. 20, 2010, and of U.S. Prov. Pat. App. No. 61/492,012, entitled "Remotely Operated Isolation Valve", filed on Jun. 1, 2011, which are herein incorporated by reference in their entireties.

BACKGROUND OF THE INVENTION

Field of the Invention

Embodiments of the invention generally relate to a remotely operated isolation valve.

Description of the Related Art

A hydrocarbon bearing formation (i.e., crude oil and/or natural gas) is accessed by drilling a wellbore from a surface of the earth to the formation. After the wellbore is drilled to a certain depth, steel casing or liner is typically inserted into the wellbore and an annulus between the casing/liner and the earth is filled with cement. The casing/liner strengthens the borehole, and the cement helps to isolate areas of the wellbore during further drilling and hydrocarbon production.

Once the wellbore has reached the formation, the formation is then usually drilled in an overbalanced condition meaning that the annulus pressure exerted by the returns (drilling fluid and cuttings) is greater than a pore pressure of the formation. Disadvantages of operating in the overbalanced condition include expense of the drilling mud and damage to formations by entry of the mud into the formation. Therefore, underbalanced or managed pressure drilling may be employed to avoid or at least mitigate problems of overbalanced drilling. In underbalanced and managed pressure drilling, a light drilling fluid, such as liquid or liquid-gas mixture, is used instead of heavy drilling mud so as to prevent or at least reduce the drilling fluid from entering and damaging the formation. Since underbalanced and managed pressure drilling are more susceptible to kicks (formation fluid entering the annulus), underbalanced and managed pressure wellbores are drilled using a rotating control device (RCD) (also known as rotating diverter, rotating BOP, rotating drilling head, or PCWD). The RCD permits the drill string to be rotated and lowered therethrough while retaining a pressure seal around the drill string.

An isolation valve as part of the casing/liner may be used to temporarily isolate a formation pressure below the isolation valve such that a drill or work string may be quickly and safely inserted into a portion of the wellbore above the isolation valve that is temporarily relieved to atmospheric pressure. An example of an isolation valve having a flapper is discussed and illustrated in U.S. Pat. No. 6,209,663, which is incorporated by reference herein in its entirety. An example of an isolation valve having a ball is discussed and illustrated in U.S. Pat. No. 7,204,315, which is incorporated by reference herein in its entirety. The isolation valve allows a drill/work string to be tripped into and out of the wellbore at a faster rate than snubbing the string in under pressure. Since the pressure above the isolation valve is relieved, the drill/work string can trip into the wellbore without wellbore pressure acting to push the string out. Further, the isolation valve permits insertion of the drill/work string into the wellbore that is incompatible with the snubber due to the shape, diameter and/or length of the string.

Actuation systems for the isolation valve are typically hydraulic requiring one or two control lines that extend from the isolation valve to the surface. The control lines require crush protection and would be difficult to route through a subsea wellhead.

SUMMARY OF THE INVENTION

Embodiments of the invention generally relate to a remotely operated isolation valve. In one embodiment, a shifting tool for use in a wellbore includes a tubular housing having a bore formed therethrough; a tubular mandrel disposed in the housing and longitudinally movable relative thereto; and an engagement member moveable relative to the housing between an extended position, a released position, and a retracted position, wherein: the engagement member is movable from the retracted position to the extended position in response to movement of the mandrel relative to the housing, and the engagement member is further movable from the extended position to the released position in response to further movement of the mandrel relative to the housing.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 2A-D are cross-sections of the isolation assembly in the open position.

DETAILED DESCRIPTION OF THE PREFERRED EMBODIMENT

Figures 9A, 9B, 9C, 9D:
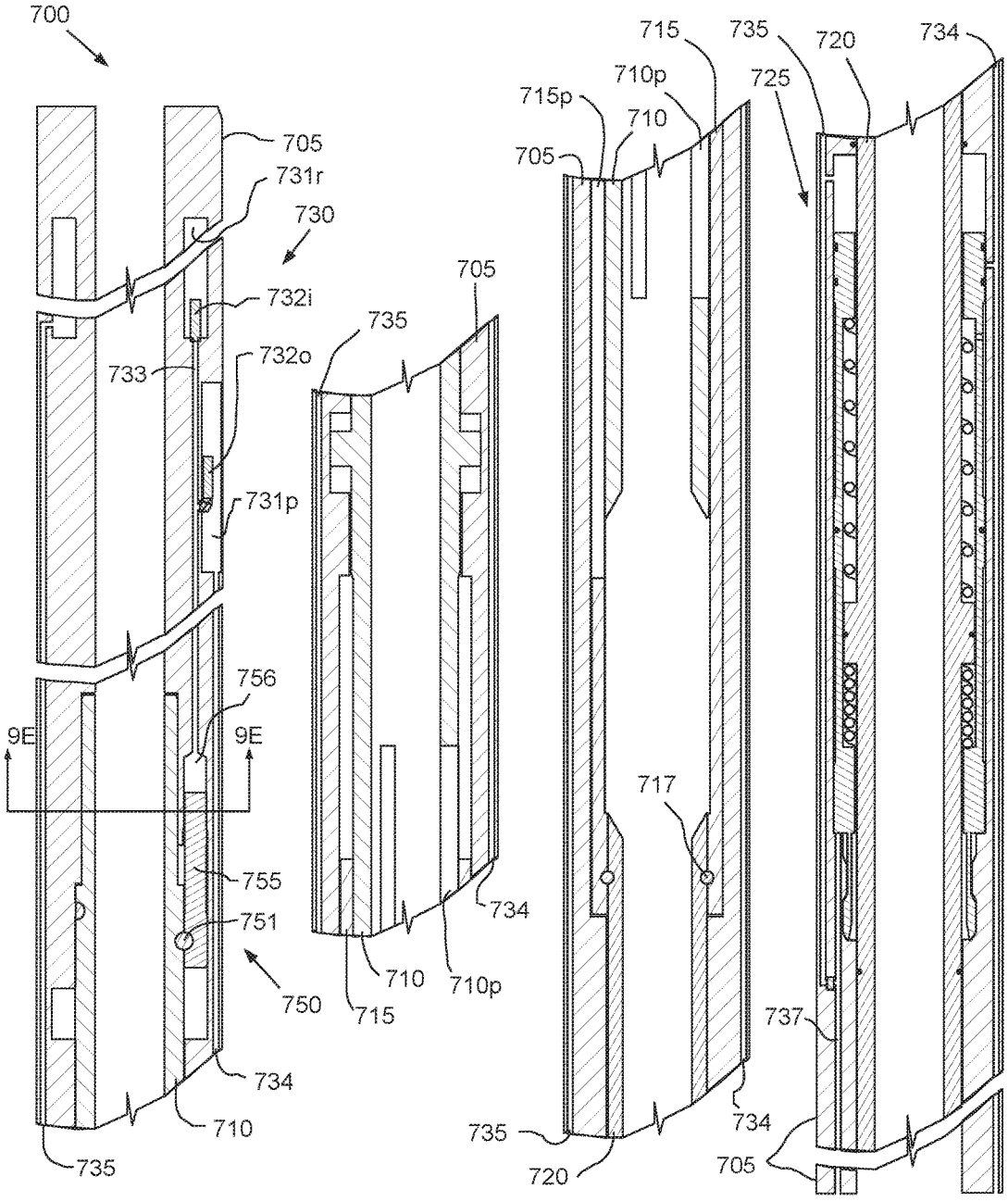
FIGS. 9A-9D illustrate a power sub for operating an isolation valve, according to another embodiment of the present invention.

FIGS. 1A-D are cross-sections of a isolation assembly in the closed position, according to one embodiment of the present invention. FIGS. 2A-D are cross-sections of the isolation assembly in the open position. The isolation assembly may include one or more power subs, such as an opener 1*o* and a closer 1*c*, and an isolation valve 100. The isolation assembly may further include a spacer sub (not shown, see spacer sub 550 in FIG. 9B) disposed between the closer 1*c* and the isolation valve 100 and/or between the opener 1*o* and the closer. The isolation assembly may be assembled as part of a casing or liner string and run-into a wellbore (see FIG. 15A). The casing or liner string may be cemented in the wellbore or be a tie-back casing string.

Each power sub 1*o,c* may include a tubular housing 5, a tubular mandrel 10, a piston 15, a tubular driver 25, and a clutch. The housing 5 may have couplings (not shown) formed at each longitudinal end thereof for connection between the power subs 1*o,c*, with the spacer sub 550, or with other components of the casing/liner string. The couplings may be threaded, such as a box and a pin. The housing 5 may have a central longitudinal bore formed therethrough. Although shown as one piece, the housing 5 may include two or more sections to facilitate manufacturing and assembly, each section connected together, such as fastened with threaded connections.

Figure 5C:
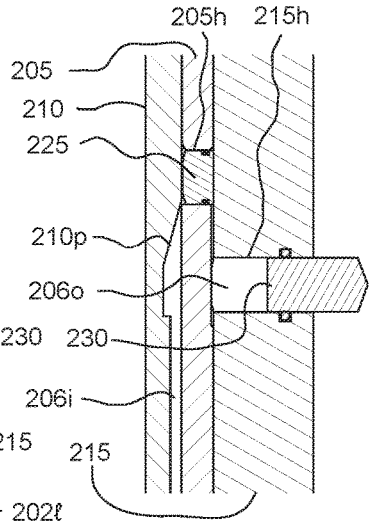
FIGS. 5A-5F illustrate operation of the shifting tool.
Figure 5D:
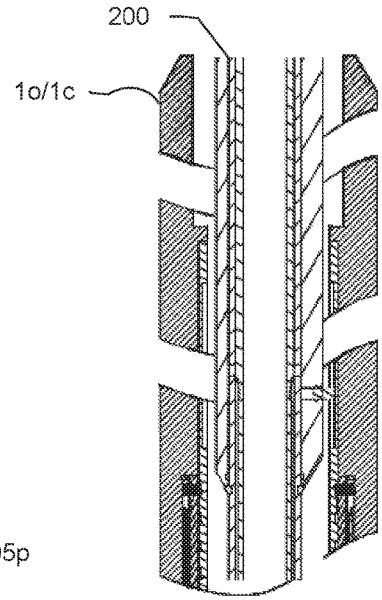

The mandrel 10 may be disposed within the housing 5, longitudinally connected thereto, and rotatable relative thereto. The mandrel 10 may have a profile 10*p* formed in an inner surface thereof for receiving a driver 230 of a shifting tool 200 (see FIG. 5D). The profile may be a series of slots 10*p* spaced around the mandrel inner surface. The slots 10*p* may have a length substantially greater than a diameter of the shifting tool driver 230 to provide an engagement tolerance and/or to compensate for heave of the drill string for subsea drilling operations. The mandrel 10 may further have one or more helical profiles 10*t* formed in an outer surface thereof. If the mandrel 10 has two or more helical profiles 10*t* (two shown), then the helical profiles may be interwoven.

The piston 15 may be tubular and have a shoulder 15*s* disposed in a chamber 6 formed in the housing 5. The housing 5 may further have upper 6*u* and lower 6*t* shoulders formed in an inner surface thereof. The chamber 6 may be defined radially between the piston 15 and the housing 5 and longitudinally between an upper seal (not shown) disposed between the housing 5 and the piston 15 proximate the upper shoulder 6*u* and a lower seal (not shown) disposed between the housing 5 and the piston 15 proximate the lower shoulder 6*l*. A piston seal (not shown) may also be disposed between the piston shoulder 15*s* and the housing 5. Hydraulic fluid may be disposed in the chamber 6. Each end of the chamber 6 may be in fluid communication with a respective hydraulic coupling (not shown) via a respective hydraulic passage 9*p* formed longitudinally through a wall of the housing 5.

The power subs 1*o,c* may be hydraulically connected to the isolation valve 100 in a three-way configuration such that each of the power sub pistons 15 are in opposite positions and operation of one of the power subs 1*o,c* will operate the isolation valve 100 between the open and closed positions and alternate the other power sub 1*o,c*. This three way configuration may allow each power sub 1*o,c* to be operated in only one rotational direction and each power sub 1*o,c* to only open or close the isolation valve 100. Respective hydraulic couplings of each power sub 1*o,c* and the isolation valve 100 may be connected by a conduit, such as tubing 9*t*. Although the tubing 9*t* connecting the opener 1*o* and the isolation valve 100 is shown external to the closer 1*c*, in actuality, the closer 1*c* may include a bypass passage (not shown) formed through the housing 5 for connecting the components.

FIGS. 3A-3D illustrate operation of the power subs 1*o,c*. The helical profiles 10*t* and the clutch may allow the driver 25 to longitudinally translate while not rotating while the mandrel 10 is rotated by the shifting tool 200 and not translated. The clutch may include a tubular cam 35 and one or more followers 30. The cam 35 may be disposed in an upper chamber 7 formed in the housing 5. The housing 5 may further have upper 7*u* and lower 7*l* shoulders formed in an inner surface thereof. The chamber 7 may be defined radially between the mandrel 10 and the housing 5 and longitudinally between an upper seal disposed between the housing 5 and the mandrel 10 proximate the upper shoulder 7*u* and lower seals disposed between the housing 5 and the driver 25 and between the mandrel 10 and the driver 25 proximate the lower shoulder 7*l*. Lubricant may be disposed in the chamber. A compensator piston (not shown) may be disposed in the mandrel 10 or the housing 5 to compensate for displacement of lubricant due to movement of the driver 25. The compensator piston may also serve to equalize pressure of the lubricant (or slightly increase) with pressure in the housing bore.

Figures 3A, 3B, 3C, 3D:
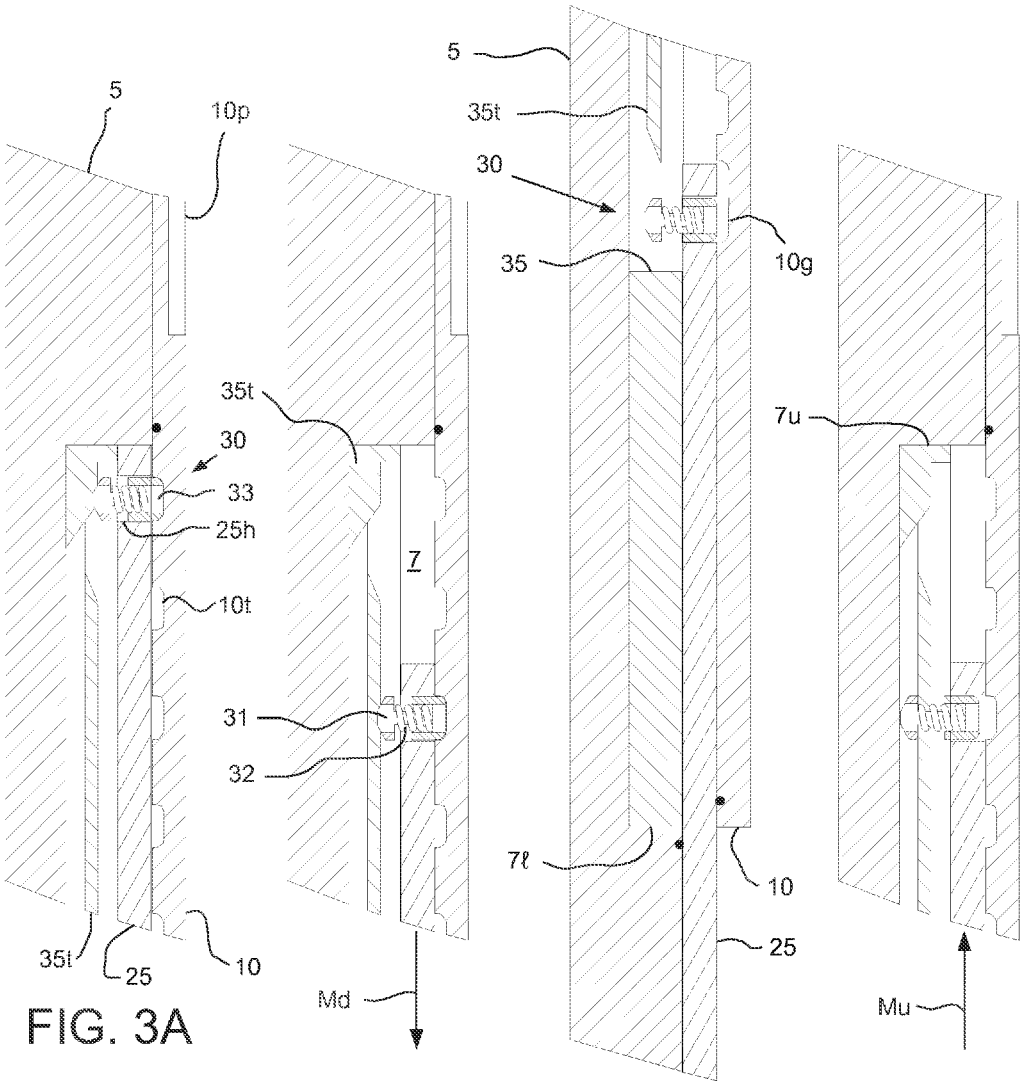
FIGS. 3A-3D illustrate operation of a power sub of the isolation assembly.

Each follower 30 may include a head 31, a base 33, and a biasing member, such as a spring 32, disposed between the head 31 and the base 33. Each follower 30 may be disposed in a hole 25*h* formed through a wall of the driver 25. The follower 30 may be moved along a track 35*t* of the cam 35 between an engaged position (FIGS. 3A and 3B), a disengaged position (FIG. 3D), and a neutral position (FIG. 3C). The follower base 33 may engage a respective helical profile

10*t* in the engaged position, thereby operably coupling the mandrel 10 and the driver 25. The head 31 may be connected to the base 33 in the disengaged position by a foot. The base 33 may have a stop (not shown) for engaging the foot to prevent separation.

The cam 35 may be longitudinally and rotationally connected to the housing 5, such as by a threaded connection (not shown). The cam 35 may have one or more tracks 35*t* formed therein. When the driver 25 is moving downward $M_d$ relative to the housing 5 and the mandrel 10 (from the piston upper position), each track 35*t* may be operable to push and hold down a top of the respective head 31, thereby keeping the base 33 engaged with the helical profile 10*t* and when the driver 25 is moving upward $M_u$ relative to the housing 5 and the mandrel 10, each track 35*t* may be operable to pull and hold up a lip of the head 31, thereby keeping the base 33 disengaged from the helical profile 10*t*.

Figures 1A, 1B, 1C:
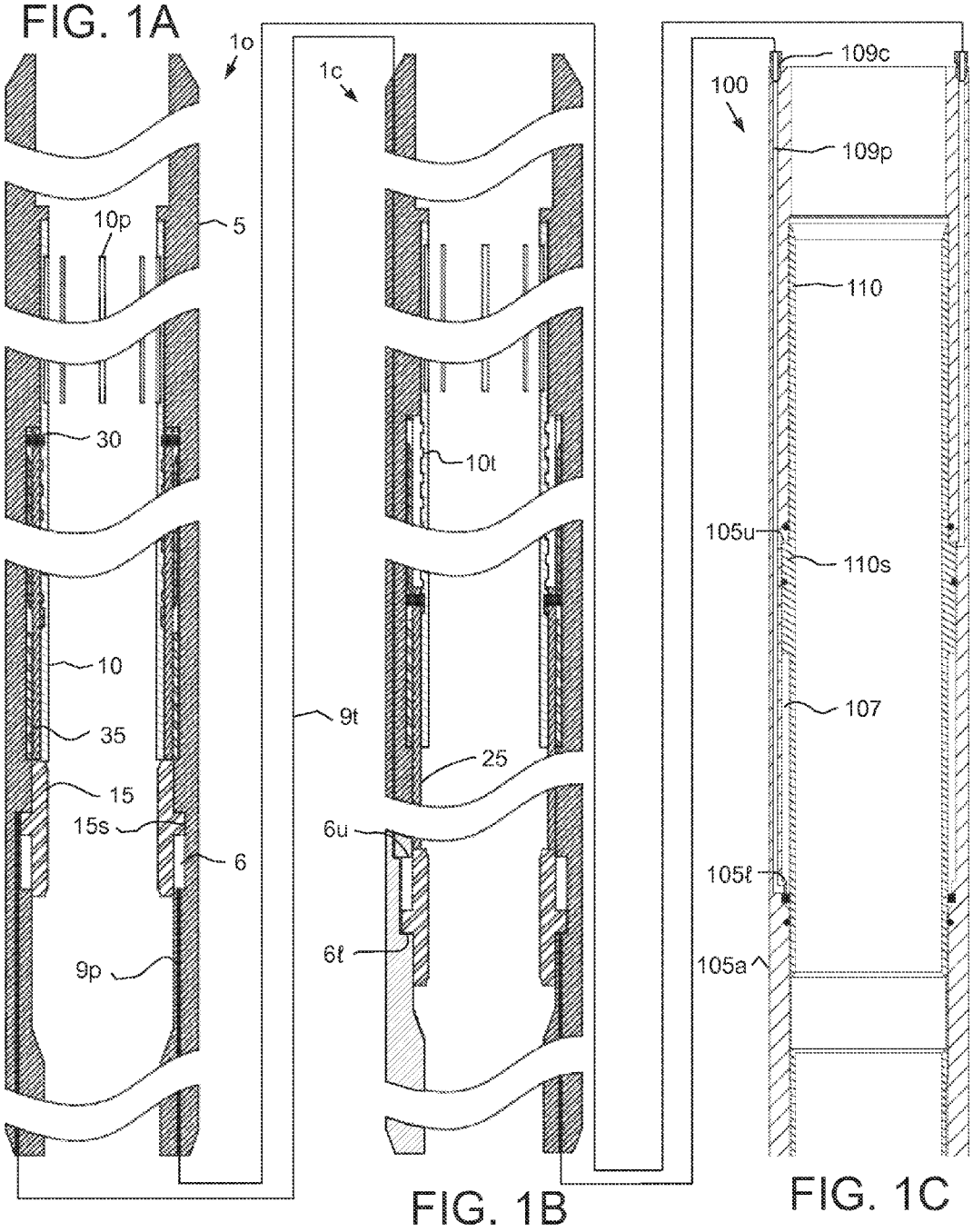
FIGS. 1A-D are cross-sections of an isolation assembly in the closed position, according to one embodiment of the present invention.
Figure 1D:
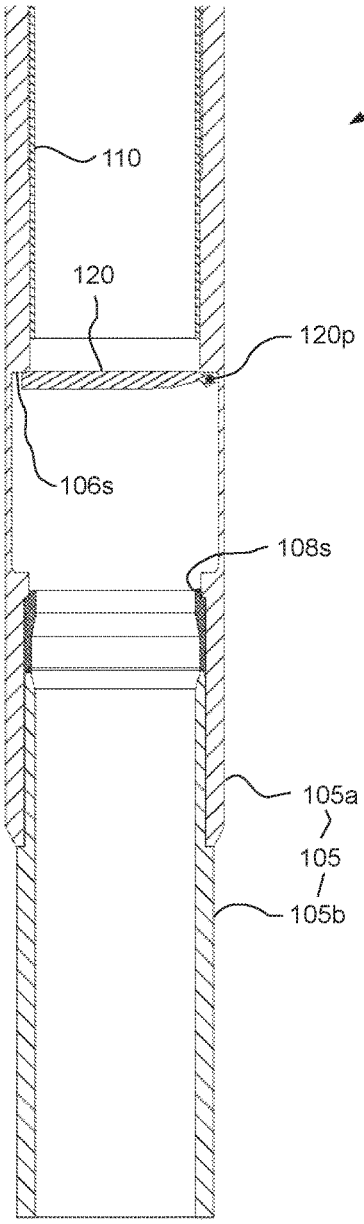
Figure 2D:
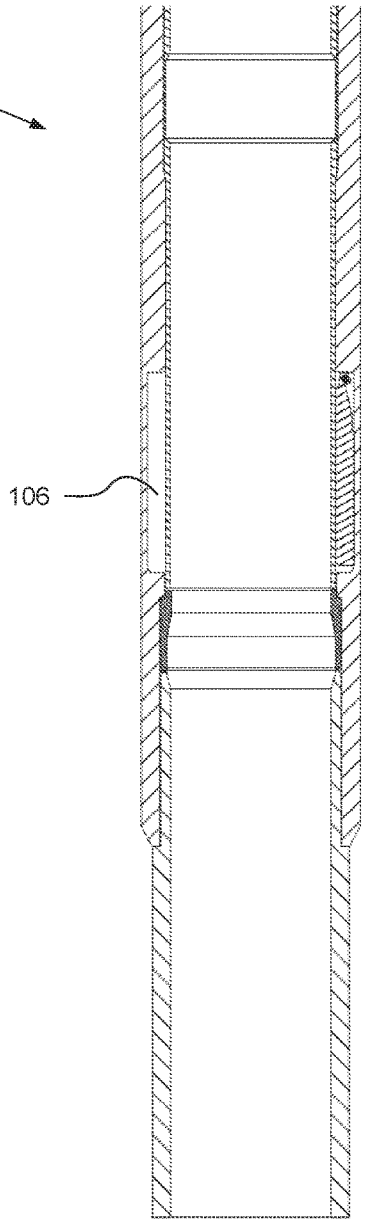

The driver 25 may be disposed between the mandrel 10 and the cam 35, rotationally connected to the cam 35, and longitudinally movable relative to the housing 5 between an extended position (FIGS. 1B and 3C) and a retracted position (FIGS. 1A and 3A). A bottom of the driver 25 may abut a top of the piston 15, thereby pushing the piston 15 from an upper position (FIGS. 1A, 2B) to a lower position (FIGS. 1B, 2A) when moving from the retracted to the extended positions. When the follower base 33 is engaged with the helical profile 10*t* (FIGS. 3A, 3B), rotation of the mandrel 10 by engagement with the shifting tool 200 may cause longitudinal downward movement $M_d$ of the driver relative to the housing, thereby pushing the piston 15 to the lower position. This conversion from rotational motion to longitudinal motion may be caused by relative helical motion between the follower base 33 and the helical profile 10*t*.

Once the follower 30 reaches a bottom of the helical profile 10*t* and the end of the track, the follower spring 32 may push the head 31 toward the neutral position as continued rotation of the mandrel 10 may push the follower base 33 into a groove 10*g* formed around an outer surface of the mandrel 10, thereby disengaging the follower base 33 from the helical profile 10*t*. The follower 30 may float radially in the neutral position so that the base 33 may or may not engage the groove 10*g* and/or remain in the groove 10*g*. The groove 10*g* may ensure that the mandrel 10 is free to rotate relative to the driver 25 so that continued rotation of the mandrel 10 does not damage any of the shifting tool 200, the power subs 1*o,c*, and the isolation valve 100.

Once the other power sub is operated by the shifting tool 200, fluid force may push the piston 15 toward the upper position, thereby longitudinally pushing the driver 25. The driver 25 may carry the follower 30 along the track 35*t* until the follower head 31 engages track 35*t*. As discussed above, the track 35*t* may engage the head lip and hold the base 33 out of engagement with the helical profile 10*t* so that the mandrel 10 does not backspin as the driver 25 moves longitudinally upward $M_u$ relative thereto. Once the follower 30 reaches the top of the second longitudinal track portion, the follower head 31 may engage an inclined portion of the track 35*t* where the follower 30 is compressed until the base 33 engages the helical profile 10*t*.

Returning to FIGS. 1A-D and 2A-D, the isolation valve 100 may include a tubular housing 105, a flow tube 110, and a closure member, such as a flapper 120. As discussed above, the closure member may be a ball (not shown) instead of the flapper 120. To facilitate manufacturing and assembly, the housing 105 may include one or more sections 105*a,b* each connected together, such as fastened with threaded connections and/or fasteners. The housing 105 may further include an upper adapter (not shown) connected to section 105*a* for connection to the spacer sub and a lower adapter (not shown) connected to the section 105*d* for connection with casing or liner. The housing 105 may have a longitudinal bore formed therethrough for passage of a drill string.

The flow tube 110 may be disposed within the housing 105. The piston 110 may be longitudinally movable relative to the housing 105. A piston 110*s* may be formed in or fastened to an outer surface of the flow tube 110. The piston 110*s* may include one or more seals for engaging an inner surface of a chamber 107 formed in the housing 105. The housing 105 may have upper 105*u* and lower 105*l* shoulders formed in an inner surface thereof. The chamber 107 may be defined radially between the flow tube 110 and the housing 105 and longitudinally between an upper seal disposed between the housing 105 and the flow tube 110 proximate the upper shoulder 105*u* and a lower seal disposed between the housing 105 and the flow tube 110 proximate the lower shoulder 105*l*. Hydraulic fluid may be disposed in the chamber 107. Each end of the chamber 107 may be in fluid communication with a respective hydraulic coupling 109*c* via a respective hydraulic passage 109*p* formed through a wall of the housing 105.

The flow tube 110 may be longitudinally movable by the piston 110*s* between the open position and the closed position. In the closed position, the flow tube 110 may be clear from the flapper 120, thereby allowing the flapper 120 to close. In the open position, the flow tube 110 may engage the flapper 120, push the flapper 120 to the open position, and engage a seat 108*s* formed in or disposed in the housing 105. Engagement of the flow tube with the seat 108*s* may form a chamber 106 between the flow tube 110 and the housing 105, thereby protecting the flapper 120 and the flapper seat 106*s*. The flapper 120 may be pivoted to the housing 105, such as by a fastener 120*p*. A biasing member, such as a torsion spring (not shown) may engage the flapper 120 and the housing 105 and be disposed about the fastener 120*p* to bias the flapper 120 toward the closed position. In the closed position, the flapper 120 may fluidly isolate an upper portion of the valve from a lower portion of the valve.

Figure 4A:
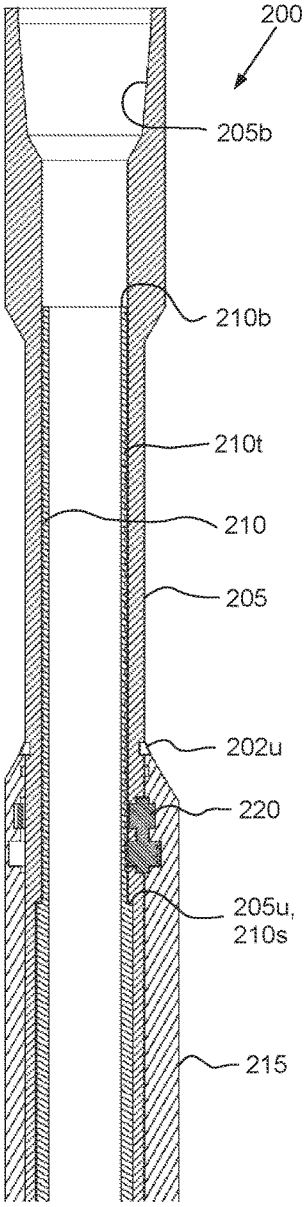
FIGS. 4A and 4B are cross-sections of a shifting tool for actuating the isolation assembly between the positions, according to another embodiment of the present invention.
Figure 4B:
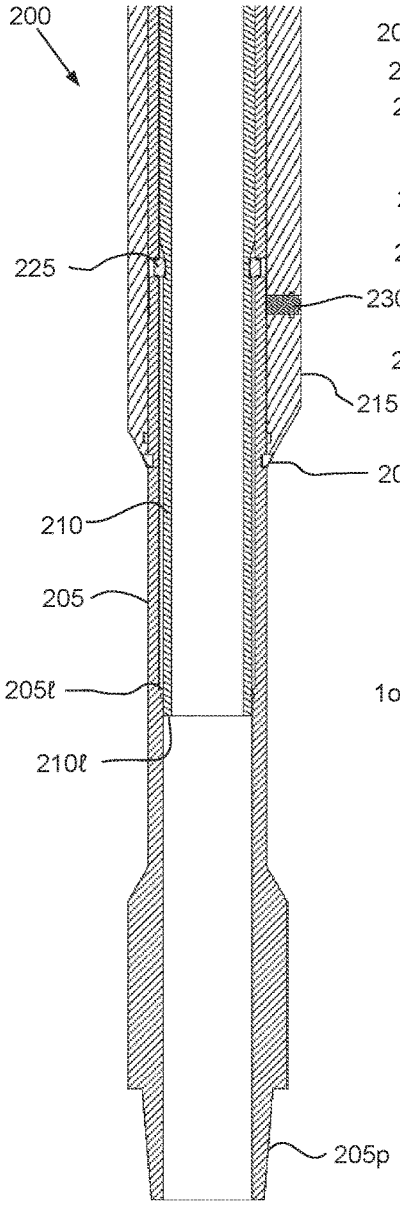
Figure 4C:
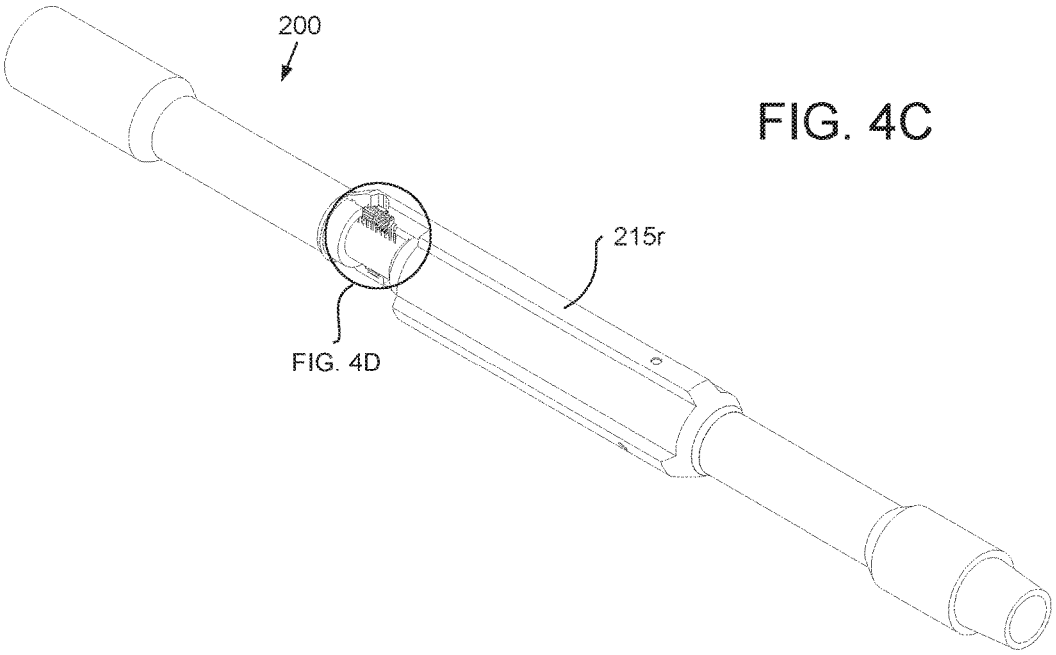
FIG. 4C is an isometric view of the shifting tool.
Figure 4D:
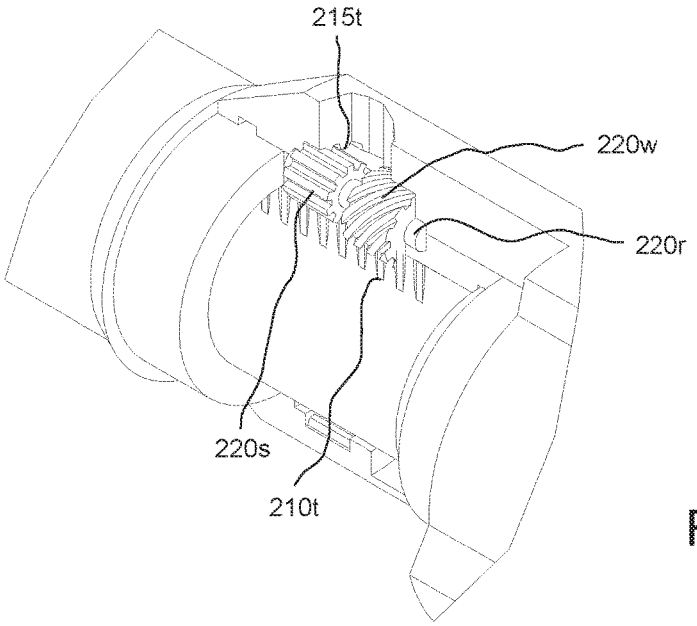
FIG. 4D is an enlargement of a portion of FIG. 4C.

FIGS. 4A and 4B are cross-sections of a shifting tool 200 for actuating the isolation assembly between the positions, according to another embodiment of the present invention. FIG. 4C is an isometric view of the shifting tool 200. FIG. 4D is an enlargement of a portion of FIG. 4C.

The shifting tool 200 may include a tubular housing 205, a tubular mandrel 210, a tubular rotor 215, a gear train 220, one or more pistons 225, and a driver 230. The housing 205 may have couplings 205*b,p* formed at each longitudinal end thereof for connection with other components of a drill string. The couplings 205*b,p* may be threaded, such as a box 205*b* and a pin 205*p*. The housing 205 may have a central longitudinal bore formed therethrough for conducting drilling fluid. Although shown as one piece, the housing 205 may include two or more sections to facilitate manufacturing and assembly, each connected together, such as fastened with threaded connections. An inner surface of the housing 205 may have one or more shoulders 205*u,l* formed therein and a wall of the housing 205 may have one or more ports 205*h* formed therethrough.

Figure 5A:
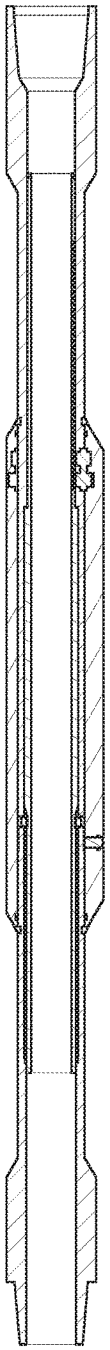
Figure 5B:
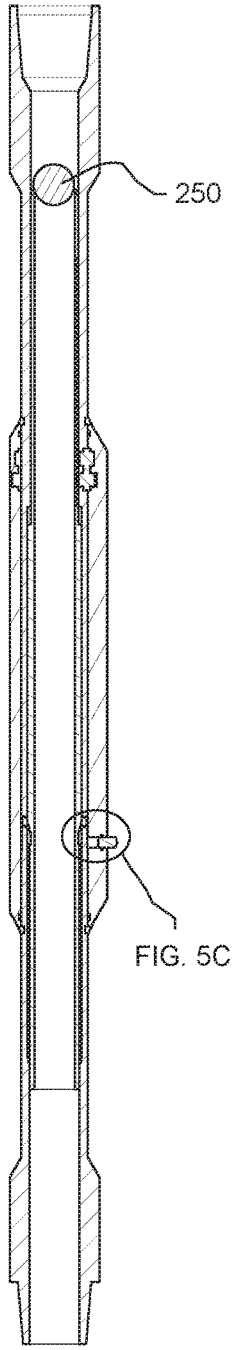
Figure 5E:
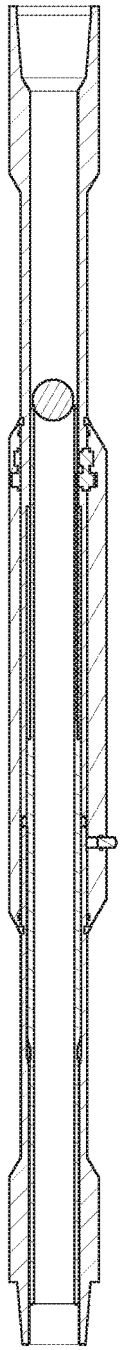
Figure 5F:
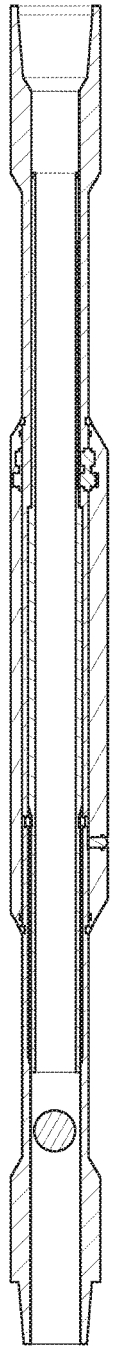

The mandrel 210 may be disposed within the housing 205 and longitudinally movable relative thereto between a retracted position (shown), an engaged position (FIGS. 5B-5D), and an extended position (FIG. 5E). The mandrel 210 may have teeth 210*t* formed along an outer surface thereof, a shoulder 210*s* formed in an outer surface thereof and a profile, such as a taper 210*p*, formed in an outer surface thereof. An upper end 210*b* of the mandrel 210 may serve as a seat for a blocking member, such as a ball 250 (FIG. 5B), pumped from the surface. A bottom 210*l* of the mandrel 210 may have an area greater than a top 210*b* of the mandrel, thereby serving to bias the mandrel 210 toward the retracted position in response to fluid pressure (equalized) in the housing bore.

An inner chamber 206*i* may be defined radially between the mandrel 210 and the housing 205 and longitudinally between an upper seal disposed between the mandrel 210 and the housing 205 proximate the upper end of the mandrel and a lower seal disposed between the housing 205 and the mandrel 210 proximate to the lower housing shoulder 205*l*. Lubricant may be disposed in the inner chamber 206*i*. An outer chamber 206*o* may be defined radially between the rotor 215 and the housing 205 and longitudinally between an upper seal disposed between the rotor 215 and the housing 205 proximate to an upper fastener 202*u* and a lower seal disposed between the rotor 215 and the housing proximate to a lower fastener 202*l*. Hydraulic fluid may be disposed in the outer chamber 206*o*.

The rotor 215 may be disposed around and connected to the housing 205, such as by one or more fasteners 202*u,l*. The rotor 215 may be rotatable relative to the housing 205. One or more ribs 215*r* may be formed in an outer surface of the rotor 215. A driver 230 may be disposed in a port 215*h* formed radially through each rib 215*r*. A seal may be disposed between each driver 230 and a respective rib 215*r*. An inner face of the driver 230 may be in fluid communication with the outer chamber 206*o* and an outer face of the driver 230 may be in fluid communication with an exterior of the shifting tool 200.

The housing 205 may include a cavity formed through a wall thereof for receiving the gear train 220. The gear train 220 may be disposed in the cavity and connected to the housing 205, such as by bearings (not shown), thereby allowing rotation of the gear train 220 relative to the housing. The gear train 220 may include one or more gears, such as a worm gear 220*w* engaged with the mandrel teeth 210*t*, a spur gear 220*s* engaged with teeth 215*t* formed around an inner surface of the rotor 215, and a shaft 220*r* connecting the gears 220*s,w*. Each gear 220*s,w* may be connected to the shaft, such as by interference fit or key/keyway.

The pistons 225 may each be disposed between the mandrel 210 and the housing 205. The mandrel 210 may have a recess formed near the profile 210*p* for receiving a portion of a respective piston 225 and the housing 205 may have a port 205*h* formed therethrough for receiving a portion of a respective piston 225. Each piston 225 may carry a seal engaged with the housing 205. An inner face of the piston 225 may be in fluid communication with the inner chamber 206*i* and an outer face of the piston 225 may be in fluid communication with the outer chamber 206*o*.

FIGS. 5A-5F illustrate operation of the shifting tool 200. The shifting tool 200 may be assembled as part of a drill string. The drill string may be run into the wellbore until the driver 230 is at a depth corresponding to the power sub profile 10*p*. The ball 250 may be launched from the surface and pumped down through the drill string until the ball lands on the seat 210*b*. Continued pumping may exert fluid pressure on the ball 250, thereby driving the mandrel 210 longitudinally downward and rotating the worm gear 220*w* due to engagement with the mandrel teeth 210*t*. Rotation of the worm gear 220*w* may then rotate the spur gear 220*s* due to connection by the shaft 220*r*. Rotation of the spur gear 220*s* may then rotate the rotor 215 due to engagement with the rotor teeth 215*t*. The profile 210*p* may engage the pistons 225 and push the pistons 225 outward, thereby exerting pressure on the hydraulic fluid in the outer chamber 206*o*.

The hydraulic fluid may then exert pressure on an inner face of the driver 230, thereby pushing the driver 230 outward and extending the driver 230 from an outer surface of each rib 215*r* into engagement with the power sub profile 10*p*. The driver 230 may be momentarily misaligned with the profile 10*p* but continued rotation may quickly engage the driver 230 with the profile 10*p*. Continued rotation of the driver 230 may rotate the power sub mandrel 10, thereby pushing the power sub piston 15 and actuating the isolation valve 100, as discussed above. Once an end of the mandrel teeth 10*t* reach the worm gear 220*w*, continued pumping may increase pressure exerted on the ball 250 until the ball deforms and passes through the mandrel 210. Once pressure between the two mandrel ends 210*b,l* equalize, an upward net pressure may be exerted on the lower mandrel end, 210*l* thereby resetting the shifting tool 200. The drill string may further include a catcher 950 (see FIG. 13B) to receive the ball 250.

The deformable ball 250 may be made from a polymer, such as a thermoplastic (i.e., nylon or PTFE) or an elastomer. The ball 250 may have a density greater than that of the drilling fluid. Alternatively, the ball 250 may be allowed to free fall to the seat. Alternatively, the ball 250 may be made from a dissolvable material instead of a deformable material.

FIGS. 6A-6C and 6E illustrate a power sub 300 for operating the isolation valve 100, according to another embodiment of the present invention. The power sub 300 may include a tubular housing 305, a tubular mandrel 310, a release piston 315, a release sleeve 320, a clutch, and a valve piston 325. A power sub 300 may replace each of the power subs 1*o,c* of the isolation assembly, discussed above. The housing 305 may have couplings (not shown) formed at each longitudinal end thereof for connection between the power subs 300, with the spacer sub 550, or with other components of the casing/liner string. The couplings may be threaded, such as a box and a pin. The housing 305 may have a central longitudinal bore formed therethrough. The housing 305 may include two or more sections 305*a-f* to facilitate manufacturing and assembly, each section connected together, such as fastened with threaded connections.

The mandrel 310 may be disposed within the housing 305, longitudinally connected thereto, and rotatable relative thereto. The mandrel 310 may have a profile 310*p* formed through a wall thereof for receiving a respective latch 430 of a shifting tool 400 (see FIG. 8B). The profile may be a series of slots 310*p* spaced around the mandrel inner surface. The slots 310*p* may have a length substantially greater than the shifting tool latch 430 to provide an engagement tolerance and/or to compensate for heave of the drill string for subsea drilling operations. The mandrel 310 may further have one or more helical profiles 310*t* formed in an outer surface thereof. If the mandrel 310 has two or more helical profiles 310*t* (two shown), then the helical profiles may be interwoven.

The release piston 315 may be tubular and have a shoulder 315*s* disposed in a chamber 306 formed in the housing 305. A bottom of one of the housing sections 305*a* may serve as an upper shoulder 306*u* and a lower shoulder 306*l* may be formed in an inner surface of another of the housing sections 305*b*. The chamber 306 may be defined radially between the piston 315 and the housing 305 and longitudinally between an upper seal disposed between the housing 305 and the piston 315 proximate the upper shoulder 306*u* and a lower seal disposed between the housing 305 and the piston 315 proximate the lower shoulder 306*l*. A piston seal (not shown) may also be disposed between the piston shoulder 315*s* and the housing 305. Hydraulic fluid may be disposed in the chamber 306. Each end of the chamber 306 may be in fluid communication with a respective hydraulic coupling (not shown) via a respective hydraulic passage 309*a,b* formed through a wall of the housing 305.

The release piston 315 may be longitudinally connected to the release sleeve 320. The release piston 315 may have a shoulder formed in a bottom thereof for receiving a top of the sleeve 320. The sleeve 320 may be operably coupled to the mandrel 310 by a cam profile 321 and one or more followers 322 (FIG. 6E). The cam profile 321 may be formed in an inner surface of the sleeve 320 and the follower 321 may be fastened to the mandrel 310 and extend from the mandrel outer surface into the profile 322 or vice versa. The profile 321 may repeatedly extend around the sleeve inner surface so that the follower 322 continuously travels along the profile as the sleeve 320 is moved longitudinally relative to the mandrel by the release piston. Engagement of the follower 322 with the profile 321 may rotationally connect the mandrel 310 and the sleeve 320 when the follower 322 is in a straight portion of the profile 321 and cause limited relative rotation between the mandrel and the sleeve as the follower travels through a curved portion of the profile. The cam profile 321 may be a V-slot. The sleeve 320 may have a release profile 320*p* formed through a wall thereof for receiving the respective latch 430. The release profile may be a series of slots 320*p* spaced around the sleeve inner surface. The release slots 320*p* may correspond to the slots 310*p*. The slots 320*p* may be oriented relative to the profile 321 so that the sleeve slots 320*p* are aligned with the mandrel slots 310*p* when the follower is at a bottom 321*b* of the V-slot 321 (see also FIG. 8D) and misaligned when the follower 322 is at any other location of the V-slot 321 (covering the mandrel slots 310*p* with the sleeve wall).

The valve piston 325 may be tubular and have a shoulder 325*s* disposed in a chamber 308 formed in the housing 305. A bottom of one of the housing sections 305*e* may serve as an upper shoulder 308*u* and a lower shoulder 308*l* may be formed in an inner surface of another of the housing sections 305*f*. The chamber 308 may be defined radially between the piston 325 and the housing 305 and longitudinally between an upper seal disposed between the housing 305 and the piston 325 proximate the upper shoulder 308*u* and a lower seal disposed between the housing 305 and the piston 325 proximate the lower shoulder 308*l*. A piston seal may also be disposed between the piston shoulder 325*s* and the housing 305. Hydraulic fluid may be disposed in the chamber 308. Each end of the chamber 308 may be in fluid communication with a respective hydraulic coupling (not shown) via a respective hydraulic passage 309*b,c* formed through a wall of the housing 305. The passage/conduit 309*b* may provide fluid communication between a lower portion of the chamber 306 and an upper portion of the chamber 308.

As with the power subs 1*o,c*, two power subs 300 (only one shown) may be hydraulically connected to the isolation valve 100 in a three-way configuration such that each of the power sub valve pistons 325 are in opposite positions and operation of one of the power subs 300 will operate the isolation valve 100 between the open and closed positions and alternate the other power sub 300. This three way configuration may allow each power sub 300 to be operated in only one rotational direction and each power sub 300 to only open or close the isolation valve 100. To connect the power sub 300 as the opener, the passage 309*c* may be in fluid communication with an upper face of the isolation valve piston 110*s* and the passage/conduit 309*a* may be in fluid communication with an upper face of the closer release piston 315. To connect the power sub 300 as the closer, the passage 309*c* may be in fluid communication with a lower face of the isolation valve piston 110*s* and the passage/conduit 309*a* may be in fluid communication with an upper face of the opener release piston 320. Although the passage/conduit 309*b* is shown external to the power sub 300, in actuality, the power sub may include an internal passage (not shown) formed through the housing 305 for connecting the chambers 306, 308.

The clutch may include one or more cam profiles 335 and one or more followers 330. The follower and cam profile may operate in a manner similar to that of the follower 30 and track 35*t* discussed above except that the cam profile 335 may be linear instead of an oval track. Alternatively, the shifting tool 300 may include the follower 30 and the track 35*t* instead of the follower 330 and the profile 335 or vice versa. The cam profile 335 may be disposed in a lubricant chamber 307 (FIG. 6D) formed in the housing 305. A shoulder formed in the housing section 305*d* and a shoulder 310*s* formed in the mandrel 310 may serve as an upper 307*u* shoulder and a shoulder formed in the housing section 305*d* and a top of the housing section 305*e* may serve as a lower 307*l* shoulder. The chamber 307 may be defined radially between the mandrel 310 and the housing 305 and longitudinally between an upper seal disposed between the housing 305 and the mandrel 310 proximate the upper shoulder 307*u* and lower seals disposed between the valve piston 325 and the mandrel 310 and between the valve piston 325 and the housing section 305*e* proximate the lower shoulder 307*l*. Lubricant may be disposed in the chamber 307. A compensator piston (not shown) may be disposed in the mandrel 310 or the housing 305 to compensate for displacement of lubricant due to movement of the valve piston 325. The compensator piston may also serve to equalize pressure of the lubricant (or slightly increase) with pressure in the housing bore.

Figures 6A, 6B, 6C:
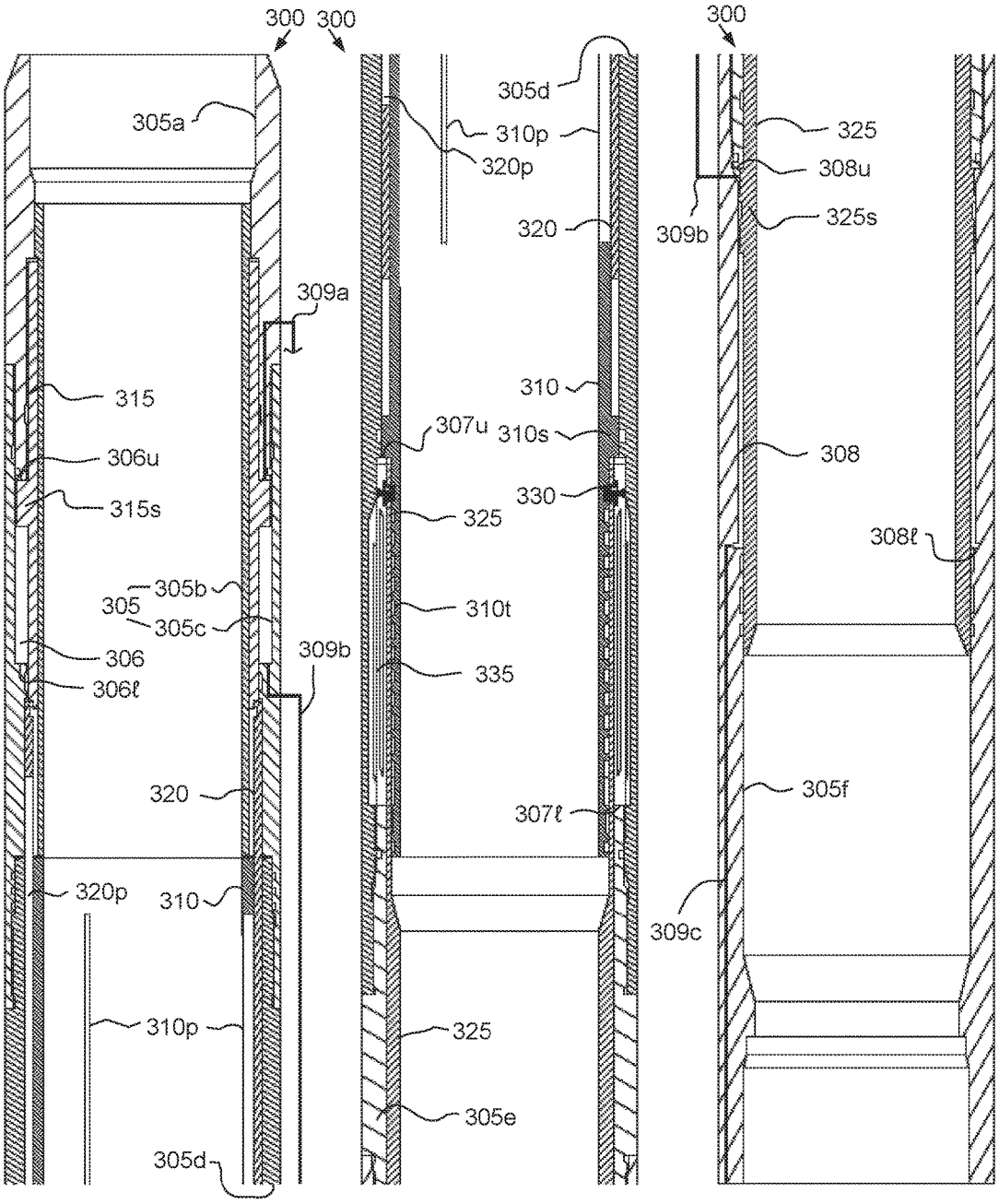
FIGS. 6A-6C and 6E illustrate a power sub for operating an isolation valve, according to another embodiment of the present invention.
Figure 6D:
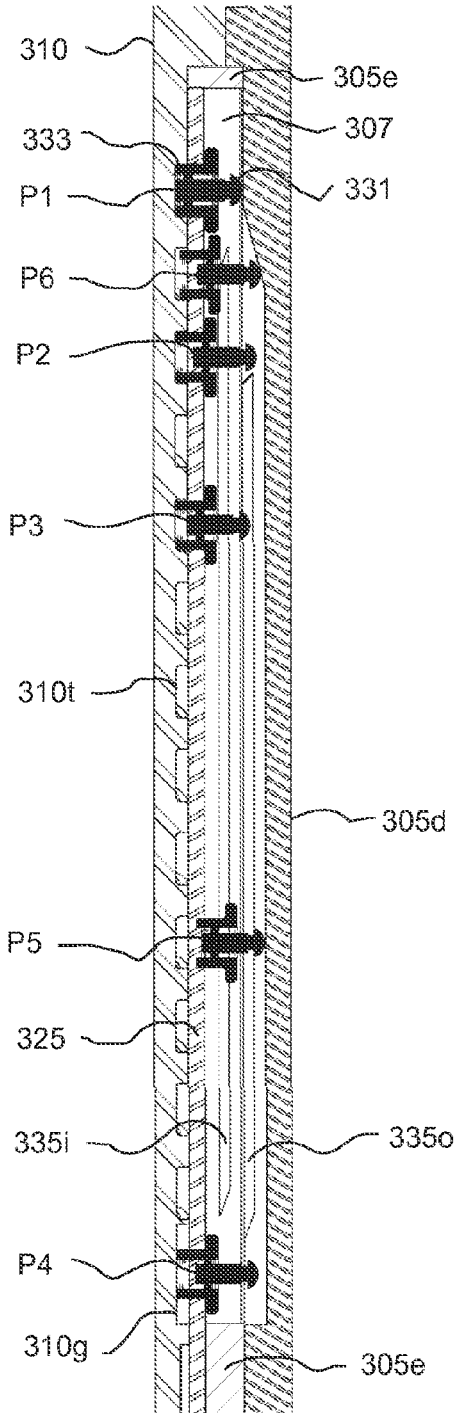
FIG. 6D illustrates operation of a clutch of the power sub.
Figure 6E:
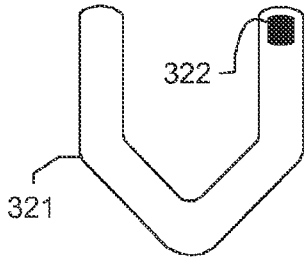

FIG. 6D illustrates operation of the clutch. Please note that FIG. 6D is schematic. In actuality, the valve piston 325 may move longitudinally with follower 330. The helical profiles 310*t* and the clutch may allow the valve piston 325 to longitudinally translate while not rotating while the mandrel 310 is rotated by the shifting tool 400 and not translated. Each follower 330 may include a head 331, a base 333, and a biasing member, such as a spring, disposed between the head 331 and the base 333. Each follower 330 may be disposed in a hole formed through a wall of the valve piston 325, thereby longitudinally connecting the follower 330 and the valve piston 325. The valve piston 325 may be rotationally connected to the housing 305 and longitudinally movable relative to the housing 305 between an upper position and a lower position. When the follower base 333 is engaged with the helical profile 310*t* (P1-P3), rotation of the mandrel 310 by engagement with the shifting tool 400 may cause longitudinal downward movement of the valve piston 325 relative to the housing 305 (FIG. 8C), thereby moving the valve piston 325 to the lower position and opening or closing the isolation valve 100. This conversion from rotational motion to longitudinal motion may be caused by relative helical motion between the follower base 333 and the helical profile 310*t*.

The follower 330 may be reciprocated along the cam profile 335 between an engaged position (P1-P3), a disengaged position (P5, P6), and a neutral position (P4). The follower base 333 may engage a respective helical profile 310*t* in the engaged position, thereby operably coupling the mandrel 310 and the valve piston 325. The head 331 may be connected to the base 333 in the disengaged position by a foot. The foot and base 333 may engage to prevent separation. The base 333 may further have a flange formed at a top thereof for engaging the cam profile 335. The cam profile 335 may include an outer portion 335*o* formed the housing section 305*d* and an inner portion 335*i* formed in the housing section 305*e*. When the valve piston 325 is moving downward relative to the housing 305 and mandrel 310 (from P1 to P4), the inner portion 335*i* may be operable to engage (via a tapered upper end), push, and hold the base flange inward (P2), thereby keeping the base 333 engaged with the helical profile 310*t*. The outer portion 335*o* may then engage (via a tapered upper end), push, and hold the head 331 inward (P2-P3). As the valve piston 325 travels downward, the head 331 and base 333 may ride along respective insides of the inner 335*i* and outer 335*o* portions.

Once the follower 330 reaches a bottom of the helical profile 310*t* and the end of the cam profile 335 (P4 and FIG. 8D), the follower spring may push the head 331 toward the neutral position as continued rotation of the mandrel 310 may push the follower base into a groove 310*g* formed around an outer surface of the mandrel 310, thereby disengaging the follower base 333 from the helical profile 310*t*. The follower 330 may float radially in the neutral position so that the base may or may not engage the groove 310*g* and/or remain in the groove 310*g*. The groove 310*g* may ensure that the mandrel 310 is free to rotate relative to the valve piston 325 so that continued rotation of the mandrel 310 does not damage any of the shifting tool 400, the power subs 300, and the isolation valve 100.

Once the other power sub 300 is operated by the shifting tool 400, fluid force may push the valve piston 325 toward the upper position. The valve piston 325 may carry the follower 330 until the follower head 331 engages a tapered lower end of the outer portion 335*o* (P4 to P5). The outer portion 335*o* may engage the head 331 and pull the base 333 (via the foot) out of engagement with the helical profile 310*t* so that the head will ride along an outside of the outer portion 335*o*. The base 333 may then engage a tapered end of the inner portion 310*t* so that the base will ride along an outside of the inner portion 335*i*, thereby preventing the mandrel 310 from back-spinning as the valve piston 325 moves longitudinally upward relative thereto. Once the follower 330 reaches a tapered inner portion of the housing section 305*d* (P6), the follower 330 may be compressed until the base engages the helical profile 310*t* (P1).

Figure 7A:
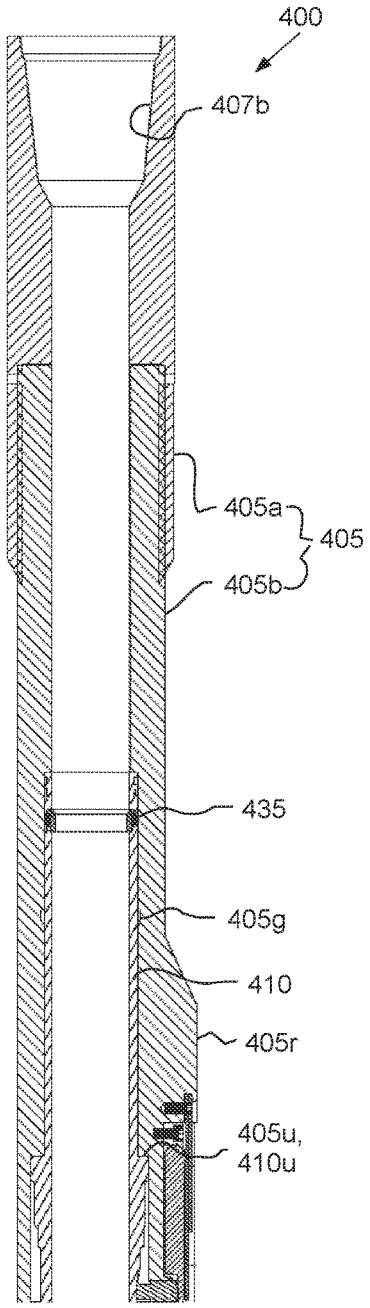
FIGS. 7A and 7B illustrate a shifting tool for actuating the power sub.
Figure 7B:
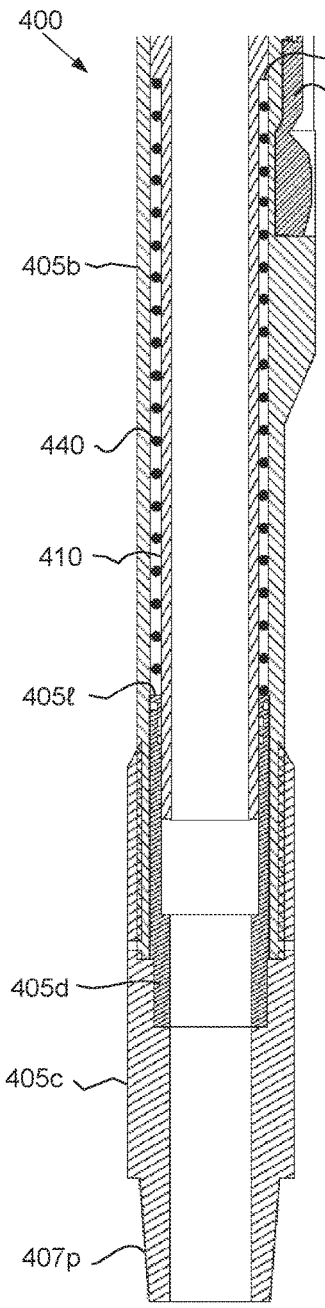
Figure 7C:
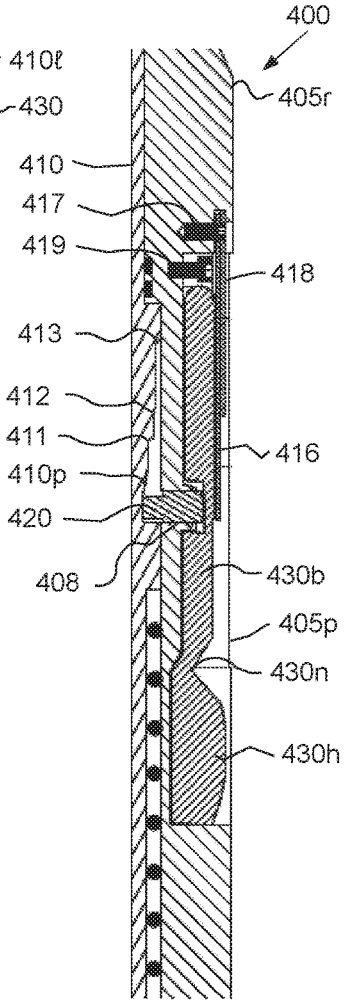
FIG. 7C is an enlargement of a portion of FIGS. 7A and 7B.

FIGS. 7A and 7B illustrate a shifting tool 400 for actuating the power sub 300. FIG. 7C is an enlargement of a portion of FIGS. 7A and 7B. The shifting tool 400 may include a tubular housing 405, a tubular mandrel 410, and one or more latches 430. The housing 405 may have couplings 407*b,p* formed at each longitudinal end thereof for connection with other components of a drill string. The couplings may be threaded, such as a box 407*b* and a pin 407*p*. The housing 405 may have a central longitudinal bore formed therethrough for conducting drilling fluid. The housing 405 may include two or more sections 405*a-d* to facilitate manufacturing and assembly, each section 405*a-d* connected together, such as fastened with threaded connections. The housing section 405*d* may be connected to the other sections 405*a-c* by being disposed between the sections 405*b,c*. An inner surface of the housing 405 may have a groove 405*g* and an upper shoulder 405*u* formed therein, a top of the housing section 405*d* may serve as a lower shoulder 405*l*, and a wall of the housing 405 may have one or more holes 408 formed therethrough.

Figures 8A, 8B, 8C, 8D:
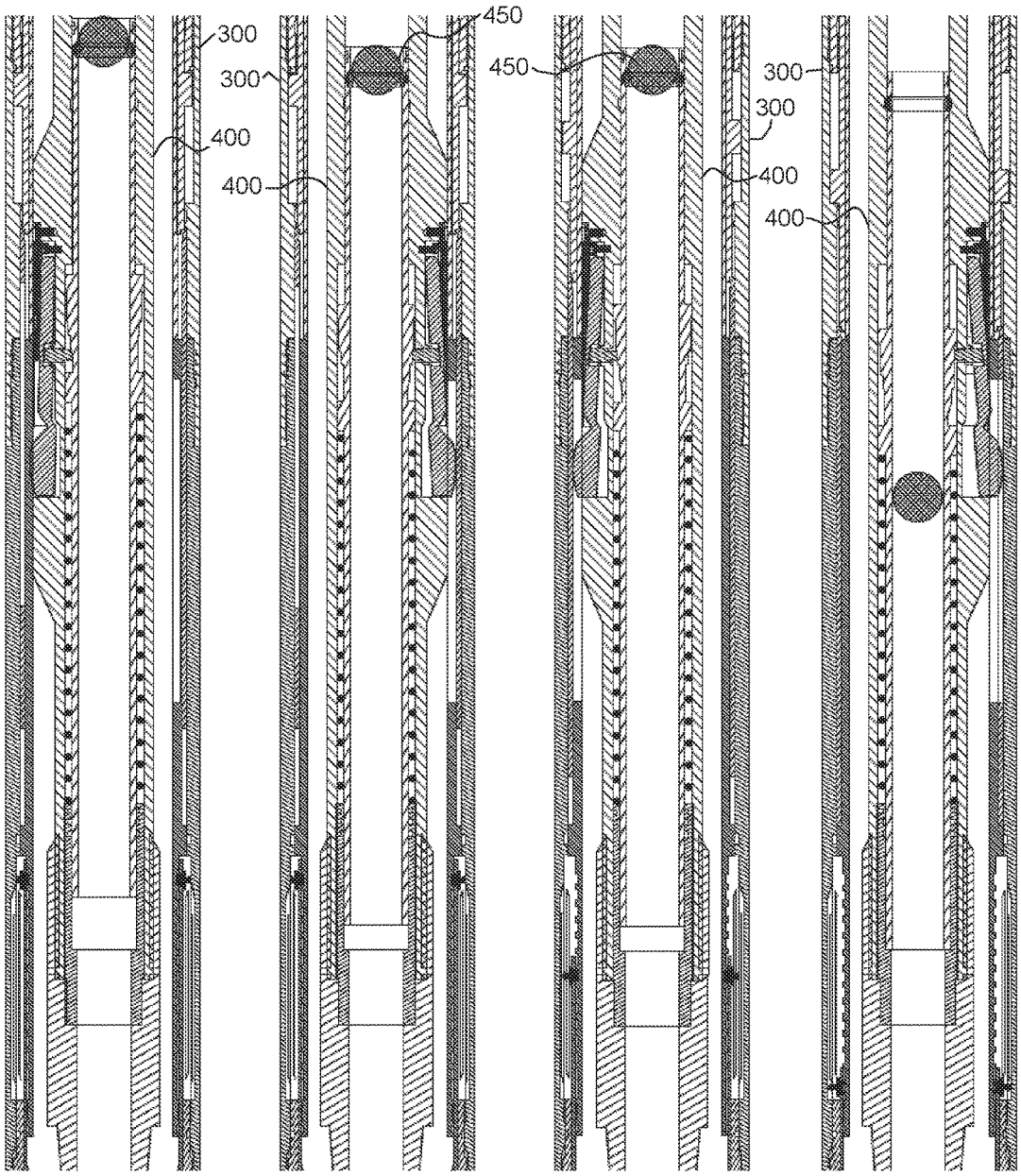
FIGS. 8A-8D illustrate operation of the shifting tool and the power sub.
Figure 15E:
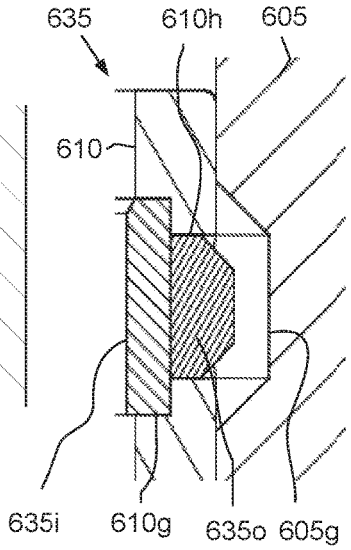
FIGS. 15A-15F illustrate operation of the shifting tool.
Figure 15F:
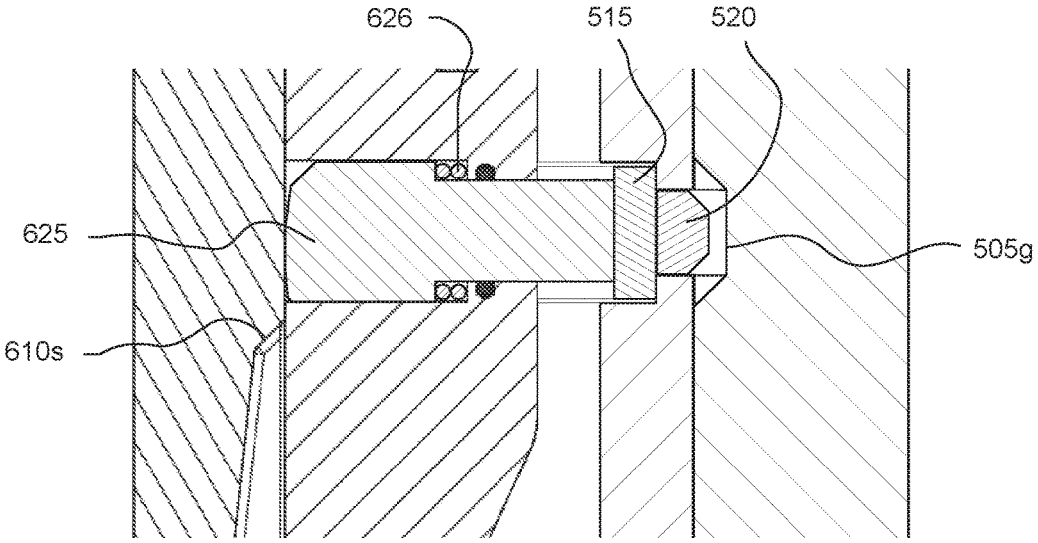

The mandrel 410 may be disposed within the housing 405 and longitudinally movable relative thereto between a retracted position (shown), an orienting position (see FIG. 8A), an engaged position (see FIGS. 8B and 8C), and a released position (see FIG. 8D). The mandrel 410 may have upper 410*u* and lower 410*l* shoulders formed in an outer surface thereof and a profile 410*p*, formed in an outer surface thereof. The profile 410*p* may include a tapered portion and a stepped portion. The stepped portion may include one or more steps and one or more shoulders 411-413 between respective steps. A seat 435 (similar to seat 635 detailed in FIG. 15E) may be fastened to the mandrel 410 for receiving a blocking member, such as a ball 450 (see FIGS. 8A-D), pumped from the surface. The seat 435 may include an inner fastener, such as a snap ring, and one or more outer fasteners, such as dogs. Each dog may be disposed through a respective hole formed through a wall of the mandrel 410. Each dog may engage an inner surface of the housing 405 and extend into a groove formed in an inner surface of the mandrel 410. The snap ring may be biased into engagement with and be received by the groove except that the dogs may prevent engagement of the snap ring with the groove, thereby causing a portion of the snap ring to extend into the mandrel bore to receive the ball 450.

One or more ribs 405*r* may be formed in an outer surface of the housing 405. A pocket 405*p* may be formed in each rib 405*r*. A latch 430 may be disposed in each pocket 405*p* in the retracted position. The latch 430 may be received by a socket connected to the housing 405, such as by fastener 419, thereby pivoting the latch 430 to the housing 405. The latch 430 may be biased toward the retracted position by one or more biasing members, such as inner leaf spring 416 and outer leaf spring 418. Each of the leaf springs 416, 418 may be disposed in the pocket 405*p* and connected to the housing 405, such as being received by a groove formed in the housing and fastened to the housing with fastener 417.

The latch may be a dog 430 and have a body 430*b*, a neck, 430*n*, and a head 430*h*. A cavity may be formed in an inner surface of the body 430*b*. A lug may be formed in the housing outer surface and extend into the cavity. The hole 408 may extend through the lug. A driver, such as a pin 420, may be disposed between the body 430*b* and the mandrel 410 and in the profile 410*p*, and may extend through the hole 408. One or more seals may be disposed between the housing lug and the pin 420.

A chamber may be defined radially between the mandrel 410 and the housing 405 and longitudinally between one or more upper seals disposed between the housing 405 and the mandrel 410 proximate the upper shoulder 405*u* and one or more lower seals disposed between the housing 405 and the mandrel 410 proximate the lower shoulder 405*l*. Lubricant may be disposed in the chamber. A compensator piston (not shown) may be disposed in the mandrel 410 or the housing 405 to compensate for displacement of lubricant due to movement of the mandrel 410. The compensator piston may also serve to equalize pressure of the lubricant (or slightly increase) with pressure in the housing bore. A biasing member, such as a spring 440, may be disposed against the lower shoulders 410*l*, 405*l*, thereby biasing the mandrel 410 toward the retracted position. In addition to the spring 440, bottom of the mandrel 410 may have an area greater than a top of the mandrel 410, thereby serving to bias the mandrel 410 toward the retracted position in response to fluid pressure (equalized) in the housing bore.

FIGS. 8A-8D illustrate operation of the shifting tool 400 and the power sub 300. The shifting tool 400 may be assembled as part of a drill string. The drill string may be run into the wellbore until the latch 430 is at a depth corresponding to the profile 310*p*. The ball 450 may be deployed from the surface and pumped down through the drill string until the ball 450 lands on the seat 435. The ball 450 may be rigid and made from a polymer, such as a thermoset (i.e., phenolic, epoxy, or polyurethane). Continued pumping may exert fluid pressure on the ball 450, thereby driving the mandrel 410 longitudinally downward and moving the profiles 410*p* relative to the pin 420. Travel of mandrel 410 may be halted as the first step in the profile reaches pin 420. The pin 420 may be wedged outward by (relative) movement along the tapered portion of the profile 410*p*. The pin 420 may rotate the latch 430, thereby moving the head 430*h* outward from the pocket 405*p* and into engagement with an inner surface of the power sub mandrel 310. The large angle at the first step 411 reduces outward force on the pin 420, thereby minimizing bending stress exerted on the neck 430*n*. Since the head 430*h* will likely be misaligned with the profile 310*p*, the shifting tool 400 may be rotated by rotating the drill string from the surface until the head 430*h* engages the profile 310*p*. Once engaged, the mandrel 410 may move until the pin 420 reaches to the second shoulder 412, thereby rotating the latch 430 further out and fully engaging the head 430*h* into the profile 310*p*. The large angle at the second step 412 reduces outward force on the pin 420, thereby minimizing bending stress exerted on the neck 430*n*.

The shifting tool 400 may then be rotated by rotating the drill string. Since the head 430*h* may now be engaged with the profile 310, the mandrel 310 may also be rotated. As discussed above, rotation of the mandrel 310 may longitudinally move the valve piston 325 downward, thereby opening or closing the isolation valve 100 (depending on which power sub is being operated). As the isolation valve 100 is being opened or closed, hydraulic fluid from the isolation valve 100 may alternate the other power sub and hydraulic fluid from the other power sub may push the release piston 315 downward, thereby moving the follower 322 along the track 321. Once the stroke is complete, the sleeve profile 320*p* may be aligned with the mandrel profile 310*p*. The head 430*h* is now allowed to rotate further out and moving the pin 420 over the second shoulder 412. The mandrel 410 may then continue moving longitudinally downward until the ball seat dogs align with the housing groove 405*g*, thereby allowing extension of the ball seat snap ring and releasing the ball 450 from the ball seat 435. The ball 450 may then pass through the mandrel 410 and the driller may receive indication at surface that the isolation valve 100 has been actuated. The springs 440, 416 and arms 418 may then reset the shifting tool 400. The drill string may further include a catcher 950 (see FIG. 13B) to receive the ball.

In the event of emergency and/or malfunction of the shifting tool, the power sub, and/or the isolation valve, the shifting tool can be pulled up. As the head 430*h* reaches the end of the profile 310*p* a sufficient bending stress on the neck 430*n* is created to fracture and/or plastically deform the neck 430*n* so that the head 430*h* is forced back into the pocket 405*p*. This measure may free the shifting tool 400 from the power sub 300 and allow the drill string to be retrieved to the surface. Alternatively or additionally, upward force exerted on the drill string from the surface may achieve or facilitate forcing the head 430*h* into the pocket 405*p*.

Alternatively, the shoulders 411, 412 may serve as position indicators by causing respective instantaneous pressure fluctuations detectable at the surface when the pin 420 passes over the shoulders 411, 412. Alternatively, the shoulders 411, 412 and corresponding steps may be replaced by a continuous taper.

Alternatively, the shifting tool 400 may include a spring engaged to an inner surface of the latch instead of the leaf springs. Alternatively, the driver 420 may be bidirectionally connected to the latch 430, such as using a T-slot. Alternatively, the profile 310*p* may include teeth instead of slots and the sleeve 320 may instead be radially movable to engage a release of the shifting tool to release the seat.

Figure 9E:
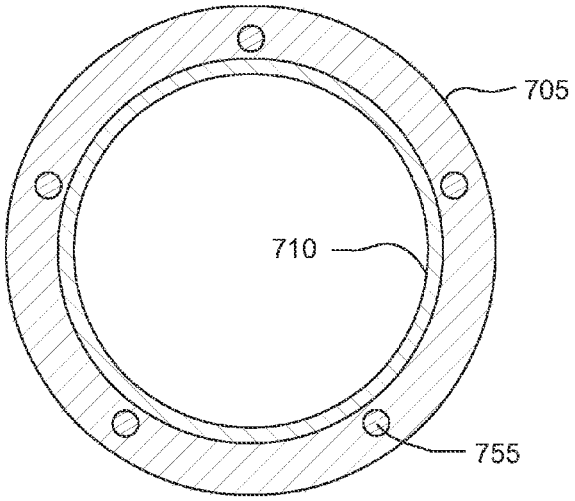
FIG. 9E illustrates a pump of the power sub.
Figure 9F:
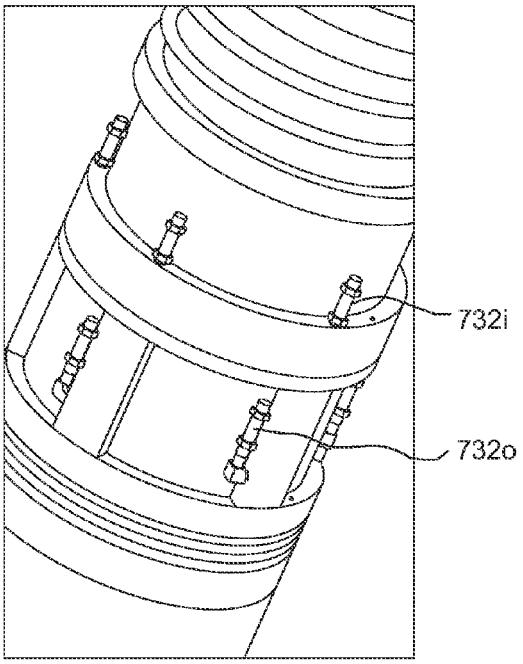
FIG. 9F illustrates check valves of the power sub.
Figure 9G:
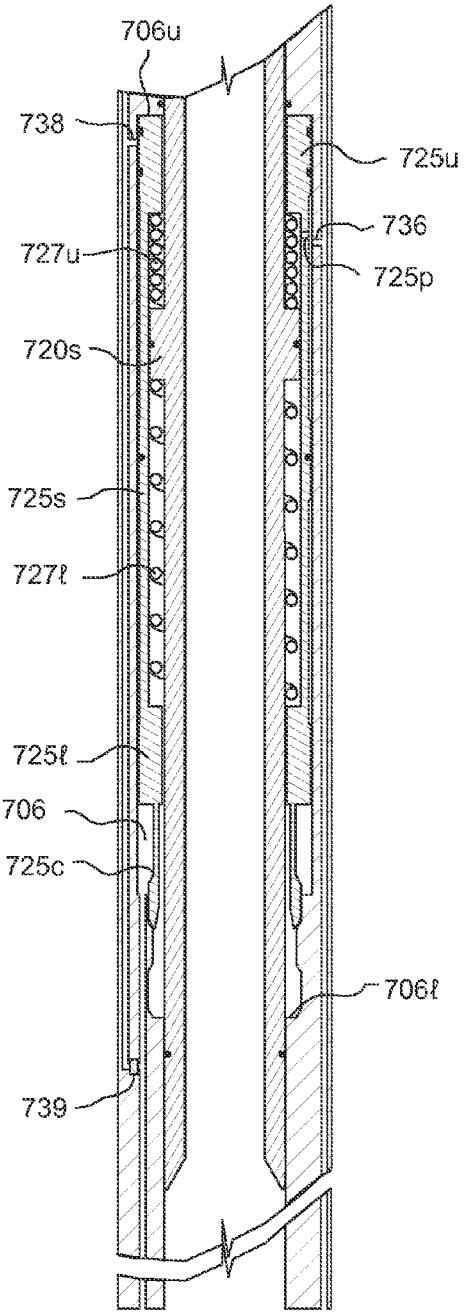
FIG. 9G illustrates a control valve of the power sub in an upper position.
Figures 10A, 10B:
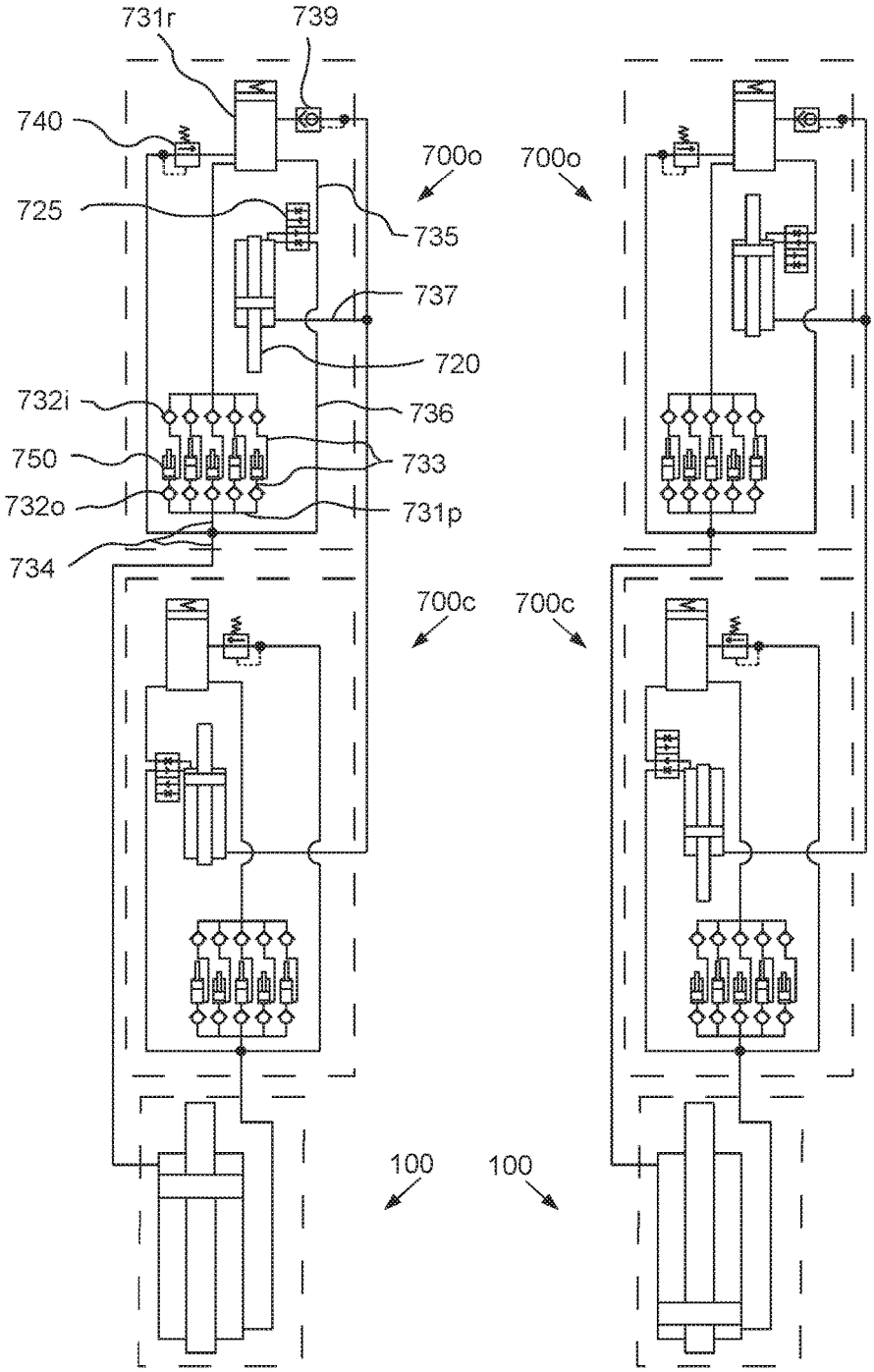
FIGS. 10A and 10B are hydraulic diagrams of an isolation assembly including opener and closer power subs.

FIGS. 9A-9D illustrate a power sub 700 for operating the isolation valve 100, according to another embodiment of the present invention. FIG. 9E illustrates a pump 750 of the power sub. FIG. 9F illustrates check valves 732*i,o* of the power sub 700. FIG. 9G illustrates a control valve 725 of the power sub 700 in an upper position. FIGS. 10A and 10B are hydraulic diagrams of an isolation assembly including opener 700*o* and closer 700*c* power subs.

The power sub 700 may include a tubular housing 705, a tubular mandrel 710, a release sleeve 715, a release piston 720, a control valve 725, hydraulic circuit 730, and a pump 750. An opener power sub 700*o* and a closer power sub 700*c* may replace each of the power subs 1*o,c* of the isolation assembly, discussed above. The housing 705 may have couplings (not shown) formed at each longitudinal end thereof for connection between the power subs 700, with the spacer sub 550, or with other components of the casing/liner string. The couplings may be threaded, such as a box and a pin. The housing 705 may have a central longitudinal bore formed therethrough. The housing 705 may include two or more sections (only one section shown) to facilitate manufacturing and assembly, each section connected together, such as fastened with threaded connections.

The mandrel 710 may be disposed within the housing 705, longitudinally connected thereto, and rotatable relative thereto. The mandrel 710 may have a profile 710*p* formed through a wall thereof for receiving a respective driver 1130 and release 1125 of a shifting tool 1100 (see FIG. 12B). The profile may be a series of slots 710*p* spaced around the mandrel inner surface. The slots 710*p* may have a length equal to, greater than, or substantially greater than a length of a ribbed portion 1105*r* of the shifting tool 1100 to provide an engagement tolerance and/or to compensate for heave of the drill string for subsea drilling operations.

The release piston 720 may be tubular and have a shoulder 720*s* disposed in a chamber 706 formed in the housing 705 between an upper shoulder 706*u* of the housing and a lower shoulder 706*l* of the housing. The chamber 706 may be defined radially between the release piston 720 and the housing 705 and longitudinally between an upper seal disposed between the housing 705 and the release piston 720 proximate the upper shoulder 706*u* and a lower seal disposed between the housing and the release piston proximate the lower shoulder 706*l*. A piston seal may also be disposed between the piston shoulder 720*s* and the housing 705. Hydraulic fluid may be disposed in the chamber 706. A hydraulic conduit 735, such as an internal passage formed along the housing 705, may selectively provide (discussed below) fluid communication between the chamber 706 and a hydraulic reservoir 731*r* formed in the housing.

The release piston 720 may be longitudinally connected to the release sleeve 715, such as by bearing 717, so that the release sleeve may rotate relative to the release piston. The release sleeve 715 may be operably coupled to the mandrel 710 by a cam profile (not shown, see 321 of FIG. 6E) and one or more followers (not shown, see 322 of FIG. 6E). The cam profile may be formed in an inner surface of the release sleeve 715 and the follower may be fastened to the mandrel 710 and extend from the mandrel outer surface into the profile or vice versa. The cam profile may repeatedly extend around the sleeve inner surface so that the cam follower continuously travels along the profile as the sleeve 715 is moved longitudinally relative to the mandrel 710 by the release piston 720.

Engagement of the cam follower with the cam profile may rotationally connect the mandrel 710 and the sleeve 715 when the cam follower is in a straight portion of the cam profile and cause limited relative rotation between the mandrel and the sleeve as the follower travels through a curved portion of the profile. The cam profile may be a V-slot. The release sleeve 715 may have a release profile 715*p* formed through a wall thereof for receiving the shifting tool release 1125. The release profile may be a series of slots 715*p* spaced around the sleeve inner surface. The release slots 715*p* may correspond to the mandrel slots 710*p*. The slots 715*p* may be oriented relative to the cam profile so that the sleeve slots 715*p* are aligned with the mandrel slots 710*p* when the cam follower is at a bottom of the V-slot (see FIG. 12D) and misaligned when the cam follower is at any other location of the V-slot (covering the mandrel slots 710*p* with the sleeve wall). Alternatively, each of the mandrel 710 and the sleeve 715 may further include one or more additional sets of slots for redundancy.

The control valve 725 may be tubular and be disposed in the housing chamber 706. The control valve 725 may be longitudinally movable relative to the housing 705 between a lower position (FIG. 9D) and an upper position (FIG. 9G). The control valve 725 may have an upper shoulder 725*u* and a lower shoulder 725*l* connected by a sleeve 725*s* and a latch 725*c* extending from the lower shoulder. The control valve 725 may also have a port 725*p* formed through the sleeve 725*s*. The upper shoulder 725*u* may carry a pair of seals in engagement with the housing 705. In the lower position, the seals may straddle a hydraulic port 736 formed in the housing 705 and in fluid communication with a hydraulic conduit 734, thereby preventing fluid communication between the hydraulic conduit 734 and an upper face of the piston shoulder 720*s*.

In the lower position, the upper shoulder 725*u* may also expose another hydraulic port 738 formed in the housing 705 and in fluid communication with the hydraulic conduit 735. The port 738 may provide fluid communication between the hydraulic conduit 735 and the upper face of the piston shoulder 720*s* via a passage formed between an inner surface of the upper shoulder 725*u* and an outer surface of the release piston 720. In the upper position, the upper shoulder seals may straddle the hydraulic port 738, thereby preventing fluid communication between the hydraulic conduit 735 and the upper face of the piston shoulder 720*s*. In the upper position, the upper shoulder 725*u* may also expose the hydraulic port 736, thereby providing fluid communication between the hydraulic conduit 734 and the upper face of the piston shoulder 720*s* via the ports 725*p*, 736.

The control valve 725 may be operated between the upper and lower positions by interaction with the release piston 720 and the housing 705. The control valve 725 may interact with the release piston 720 by one or more biasing members, such as springs 727*u,l* and with the housing by the latch 725*c*. The upper spring 727*u* may be disposed between the upper valve shoulder 725*u* and the upper face of the piston shoulder 720*s* and the lower spring 727*l* may be disposed between the lower face of the piston shoulder 720*s* and the lower valve shoulder 725*l*. The housing 705 may have a latch profile formed adjacent the lower shoulder 706*l*. The latch profile may receive the valve latch 725*c*, thereby fastening the control valve 725 to the housing 705 when the control valve is in the lower position. The upper spring 727*u* may bias the upper valve shoulder 725*u* toward the upper housing shoulder 706*u* and the lower spring 727*l* may bias the lower valve shoulder 725*l* toward the lower housing shoulder 706*l*.

The latch 725*c* may be a collet having two or more split fingers each having a lug at a lower end thereof. The lugs may each have inclined upper and lower faces and the latch profile may have corresponding inclined upper and lower faces such that engagement of each lug lower face with the latch profile lower face may push the lugs inward against cantilever bias of the fingers so that the lugs may enter the profile. The latch profile may have a recess to allow return of the lugs outward to their natural position. As the piston shoulder 720*s* moves longitudinally downward toward the lower shoulder 706*l*, the biasing force of the upper spring 727*u* may decrease while the biasing force of the lower spring 727*l* increases. The latch 725*c* and profile may resist movement of the control valve 725 until or almost until the piston shoulder 720*s* reaches an end of a lower stroke. Once the biasing force of the lower spring 727*l* exceeds the resistance of the latch 725*c* and latch profile, the control valve 725 may snap from the upper position to the lower position. Movement of the control valve 725 from the lower position to the upper position may similarly occur by snap action when the biasing force of the upper spring 727*u* against the upper valve shoulder 725*u* exceeds the resistance of the latch 725*c* and latch profile.

The pump 750 may include one or more (five shown) pistons 755 each disposed in a respective piston chamber 756 formed in the housing 705. Each piston 755 may interact with the mandrel 710 via a swash bearing 751. The swash bearing 751 may include a rolling element disposed in an eccentric groove formed in an outer surface of the mandrel 710 and connected to a respective piston 755. Each chamber 756 may be in fluid communication with a respective hydraulic conduit 733 formed in the housing 705. Each hydraulic conduit 733 may be in selective fluid communication with the reservoir 731*r* via a respective inlet check valve 732*i* and may be in selective fluid communication with a pressure chamber 731*p* via a respective outlet check valve 732*o*. The inlet check valve 732*i* may allow hydraulic fluid flow from the reservoir 731*r* to each piston chamber 756 and prevent reverse flow therethrough and the outlet check valve 732*o* may allow hydraulic fluid flow from each piston chamber 756 to the pressure chamber 731*p* and prevent reverse flow therethrough.

In operation, as the mandrel 710 is rotated by the drill string, the eccentric angle of the swash bearing 751 may cause reciprocation of the pistons 755. As each piston 755 travels longitudinally downward relative to the chamber 756, the piston may draw hydraulic fluid from the reservoir 731*r* via the inlet check valve 732*i* and the conduit 733. As each piston 755 reverses and travels longitudinally upward relative to the respective piston chamber 756, the piston may drive the hydraulic fluid into the pressure chamber 731*p* via the conduit 733 and the outlet check valve 732*o*. The pressurized hydraulic fluid may then flow along the hydraulic conduit 734 and to the isolation valve 100, thereby opening or closing the isolation valve 100 (depending on whether the power sub 700 is an opener 700*o* or closer 700*c*). Alternatively, an annular piston may be used in the swash pump 750 instead of the rod pistons 755. Alternatively, a centrifugal or another type of positive displacement pump may be used instead of the swash pump.

Hydraulic fluid displaced by operation of the isolation valve 100 may be received by hydraulic conduit 737. The lower face of the piston shoulder 720*s* may receive the exhausted hydraulic fluid via a flow space formed between the lower face of the lower valve shoulder 725*l*, leakage through the collet fingers, and a flow passage formed between an inner surface of the lower valve shoulder and an outer surface of the release piston 720. Pressure exerted on the lower face of the piston shoulder 720*s* may move the release piston 720 longitudinally upward until the control valve 725 snaps into the upper position. Hydraulic fluid may be exhausted from the housing chamber 706 to the reservoir via the conduit 735. When the other one of the power subs is operated, hydraulic fluid exhausted from the isolation valve 100 may be received via the conduit 734. As discussed above, the upper face of the piston shoulder 720*s* may be in fluid communication with the conduit 734. Pressure exerted on the upper face of the piston shoulder 720*s* may move the release piston 720 longitudinally downward until the control valve 725 snaps into the lower position. Hydraulic fluid may be exhausted from the housing chamber 706 to the other power sub via the conduit 737.

To account for thermal expansion of the hydraulic fluid, the lower portion of the housing chamber 706 (below the seal of the valve sleeve 725*s* and the seal of the piston shoulder 720*s*) may be in selective fluid communication with the reservoir 731*r* via the hydraulic conduit 735, a pilot-check valve 739, and the hydraulic conduit 737. The pilot-check valve 739 may allow fluid flow between the reservoir 731*r* and the housing chamber lower portion (both directions) unless pressure in the housing chamber lower portion exceeds reservoir pressure by a preset nominal pressure. Once the preset pressure is reached, the pilot-check valve 739 may operate as a conventional check valve oriented to allow flow from the reservoir 731*r* to the housing chamber lower portion and prevent reverse flow therethrough. The reservoir 731*r* may be divided into an upper portion and a lower portion by a compensator piston. The reservoir upper portion may be sealed at a nominal pressure or maintained at wellbore pressure by a vent (not shown). To prevent damage to the power sub 700 or the isolation valve 100 by continued rotation of the drill string after the isolation valve has been opened or closed by the respective power sub 700*o,c*, the pressure chamber 731*p* may be in selective fluid communication with the reservoir 731*r* via a pressure relief valve 740. The pressure relief valve 740 may prevent fluid communication between the reservoir and the pressure chamber unless pressure in the pressure chamber exceeds pressure in the reservoir by a preset pressure.

Advantageously, each of the power subs 700*o,c* may provide for purging of air into the reservoir 731*r*, hydraulic fluid replenishment from the reservoir to each hydraulic circuit, and temperature compensation of each hydraulic circuit.

Figures 11A, 11B, 11C:
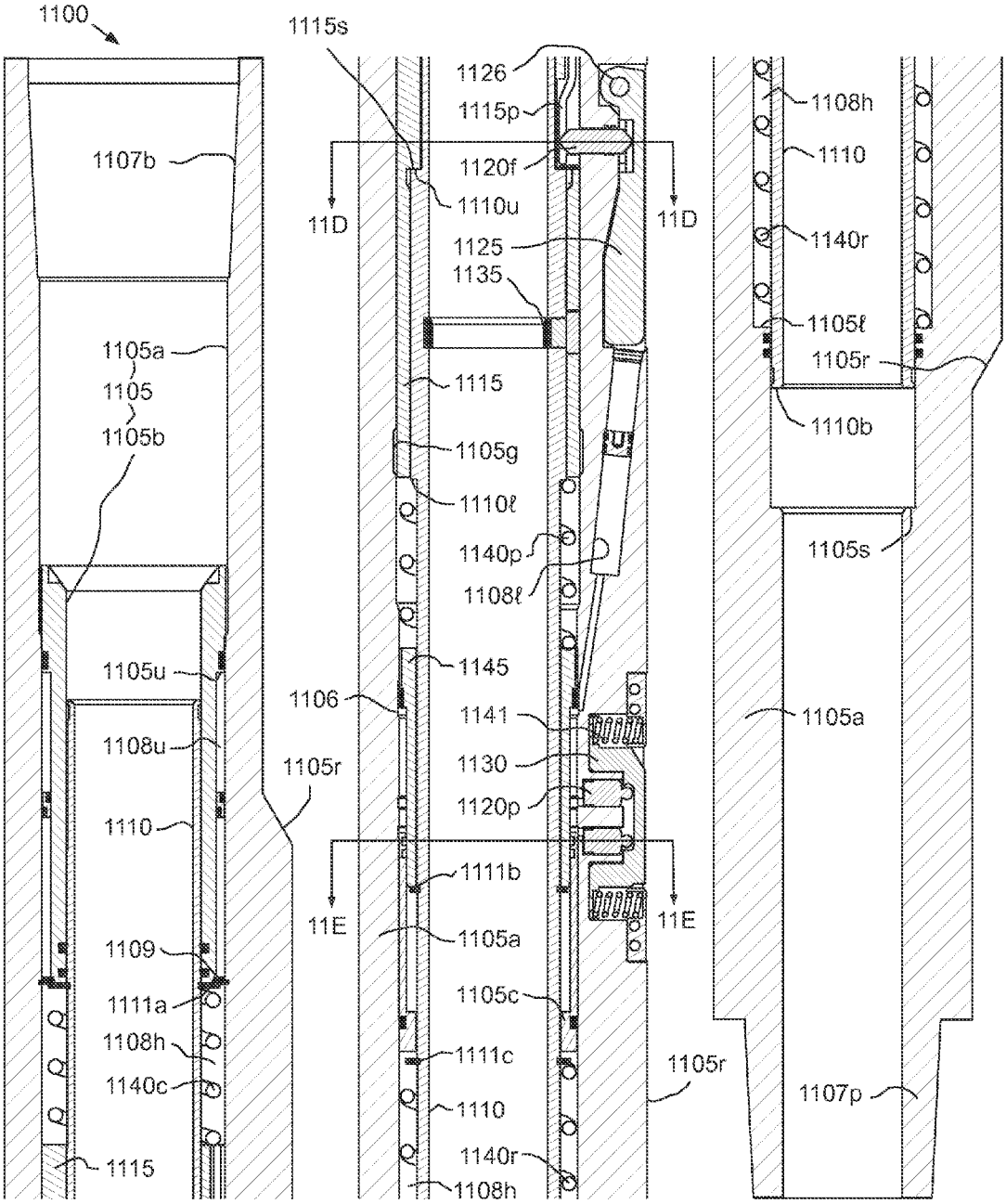
FIGS. 11A-11C illustrate a shifting tool for actuating the power sub.
Figure 11D:
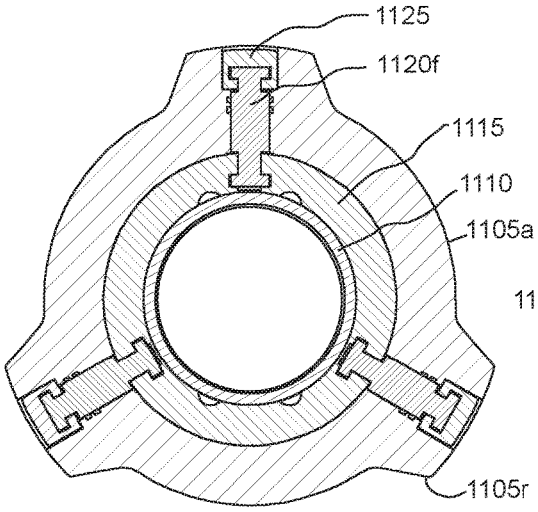
FIG. 11D illustrates a release of the shifting tool.
Figure 11E:
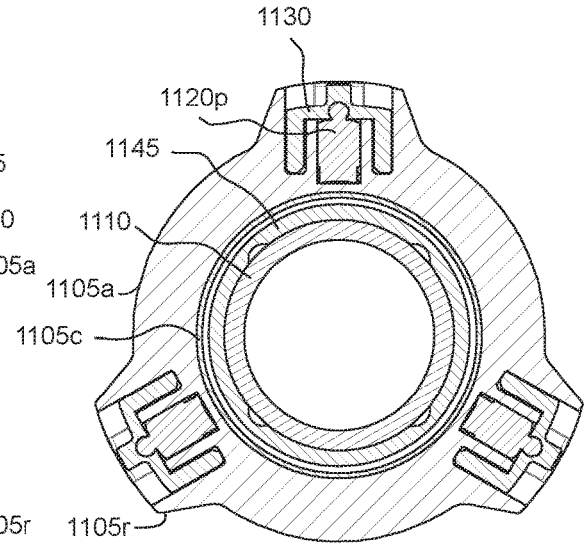
FIG. 11E illustrates a driver of the shifting tool.

FIGS. 11A-11C illustrate a shifting tool 1100 for actuating the power subs 700*o,c*. FIG. 11D illustrates a release 1125 of the shifting tool. FIG. 11E illustrates a driver 1130 of the shifting tool 1100.

The shifting tool 1100 may include a tubular housing 1105, a tubular mandrel 1110, one or more releases 1125, and one or more drivers 1130. The housing 1105 may have couplings 1107*b,p* formed at each longitudinal end thereof for connection with other components of a drill string. The couplings may be threaded, such as a box 1107*b* and a pin 1107*p*. The housing 1105 may have a central longitudinal bore formed therethrough for conducting drilling fluid. The housing 1105 may include two or more sections 1105*a-c* to facilitate manufacturing and assembly, each section 1105*a,b* connected together, such as fastened with threaded connections. The housing section 1105*c* may be fastened to the housing section 1105*a*. The housing 1105 may have a groove 1105*g* and upper 1105*u* and lower 1105*l* shoulders formed therein, and a wall of the housing 1105 may have one or more holes formed therethrough.

The mandrel 1110 may be disposed within the housing 1105 and longitudinally movable relative thereto between a retracted position (shown) and an extended position (FIG. 12A-12D). The mandrel 1110 may have upper and lower shoulders 1110*u,l* formed therein. A seat 1135 (similar to seat 635 detailed in FIG. 15E) may be fastened to the mandrel 1110 for receiving a blocking member, such as a ball 1150 (see FIGS. 12A-F), pumped from the surface. The seat 1135 may include an inner fastener, such as a snap ring, and one or more intermediate and outer fasteners, such as dogs. Each intermediate dog may be disposed in a respective hole formed through a wall of the mandrel 1110. Each outer dog may be disposed in a respective hole formed through a wall of cam 1115. Each outer dog may engage an inner surface of the housing 1105 and each intermediate dog may extend into a groove formed in an inner surface of the mandrel 1110. The snap ring may be biased into engagement with and be received by the mandrel groove except that the dogs may prevent engagement of the snap ring with the groove, thereby causing a portion of the snap ring to extend into the mandrel bore to receive the ball 1150. The mandrel 1110 may also carry one or more fasteners, such as snap rings 1111*a-c*. The mandrel 1110 may also be rotationally connected to the housing 1105.

Figure 12C:
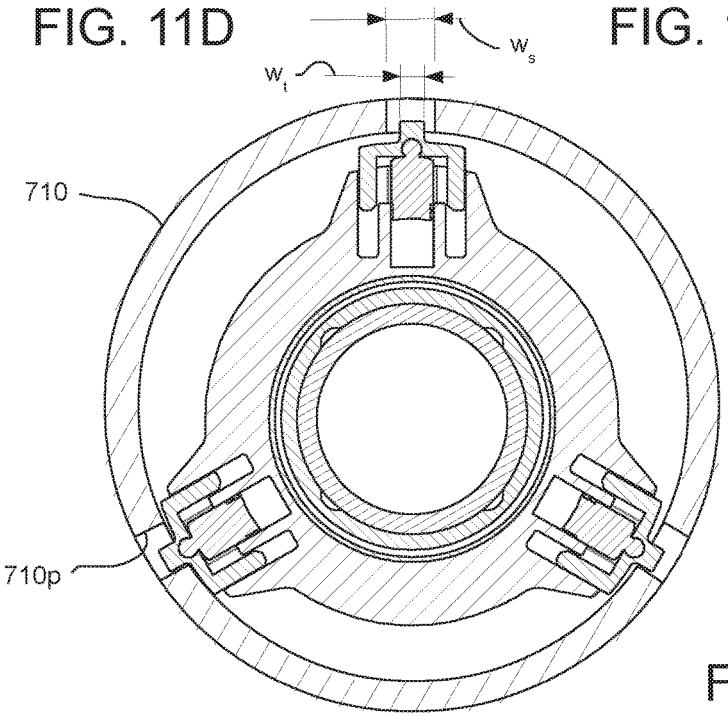
FIGS. 12A-12F illustrate operation of the shifting tool and the power sub.
Figure 12A:
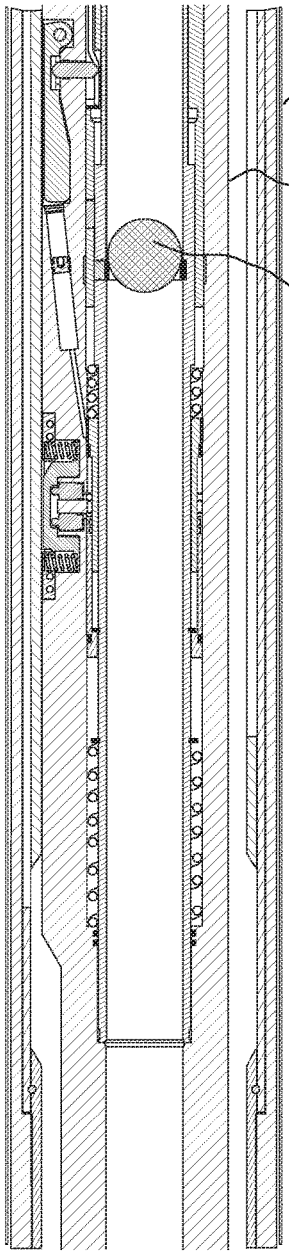
Figure 12B:
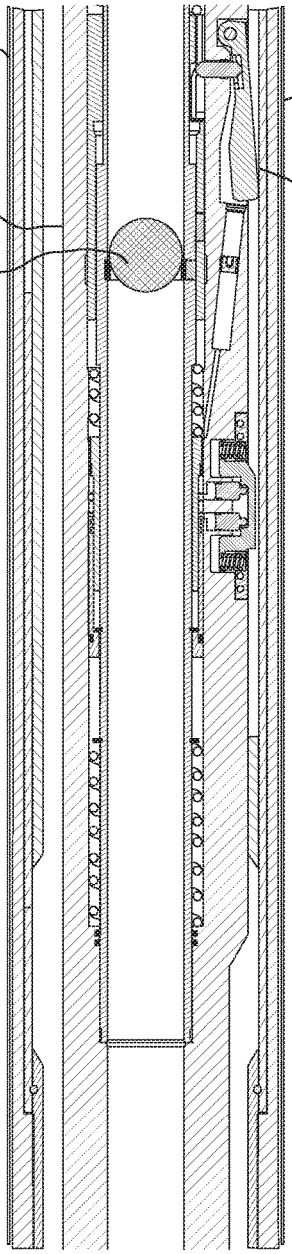
Figure 12D:
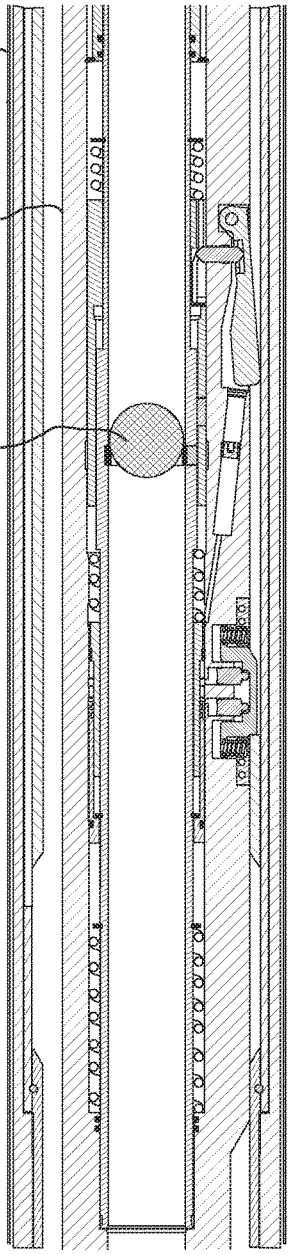
Figure 12E:
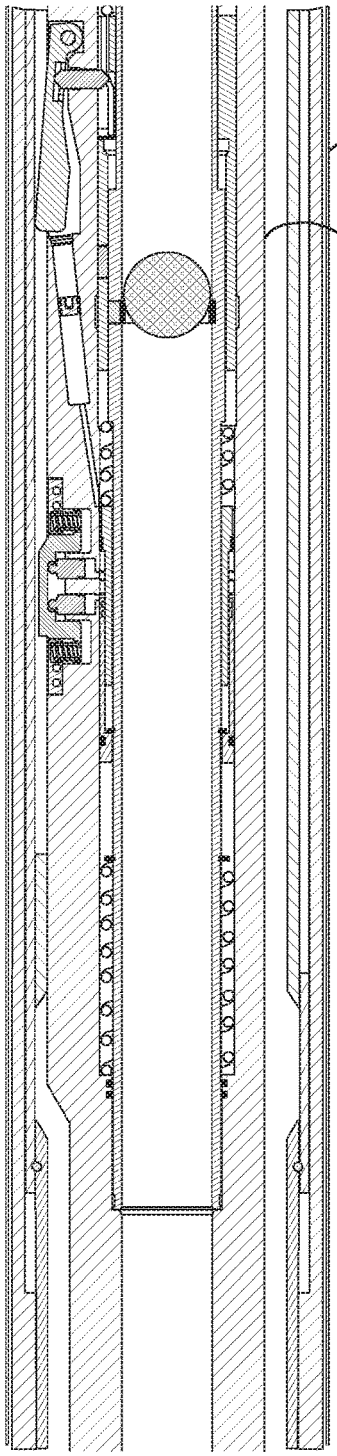
Figure 12F:
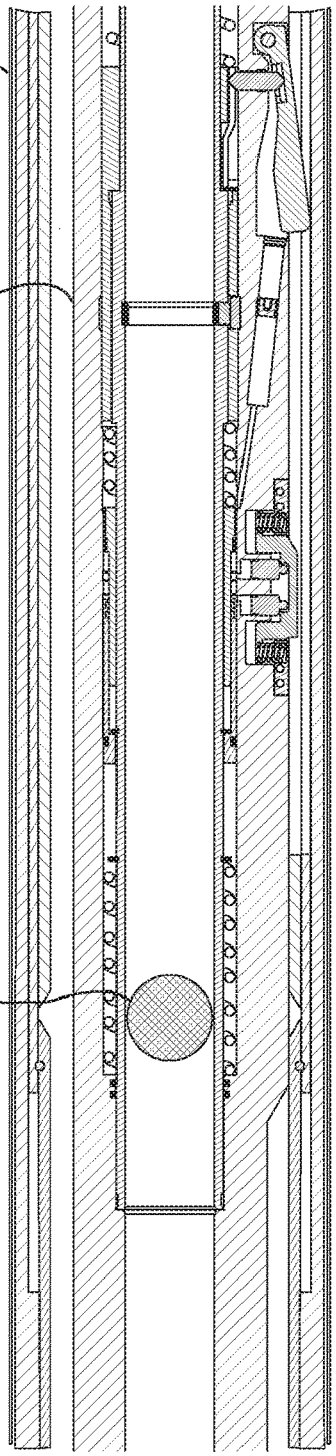

The cam 1115 may be a sleeve disposed within the housing 1105 and longitudinally movable relative thereto between a retracted position (shown), an orienting position (see FIG. 12A), an engaged position (see FIGS. 12B, 12D, and 12E), and a released position (see FIG. 12F). The cam 1115 may have a shoulder 1115*s* formed therein and a profile 1115*p* formed in an outer surface thereof. The profile 1115*p* may have a tapered portion for pushing a follower 1120*f* radially outward and be fluted for pulling the follower radially inward. The follower 1120*f* may have an inner tongue engaged with the flute. The cam 1115 may interact with the mandrel 1110 by being longitudinally disposed between the snap ring 1111*a* and the upper mandrel shoulder 1110*u* and by having a shoulder 1115*s* engaged with the upper mandrel shoulder in the retracted position. A biasing member, such as a spring 1140*c*, may be disposed between the snap ring 111*a* and a top of the cam 1115, thereby biasing the cam toward the engaged position. Alternatively, the cam profile 1115*p* may be formed by inserts instead of in a wall of the cam 1115.

A longitudinal piston 1145 may be a sleeve disposed within the housing 1105 and longitudinally movable relative thereto between a retracted position (shown), an orienting position (see FIG. 12A), and an engaged position (see FIGS. 12B, 12D, and 12E). The piston 1145 may interact with the mandrel 1110 by being longitudinally disposed between the snap ring 1111*b* and the lower mandrel shoulder 1110*l*. A biasing member, such as a spring 1140*p*, may be disposed between the lower mandrel shoulder 1110*l* and a top of the piston 1145, thereby biasing the piston toward the engaged position. A bottom of the piston 1145 may engage the snap ring 1111*b* in the retracted position.

One or more ribs 1105*r* may be formed in an outer surface of the housing 1105. Upper and lower pockets may be formed in each rib 1105*r* for the release 1125 and the driver 1130, respectively. A release, such as arm 1125, and a driver, such as dog 1130, may be disposed in each respective pocket in the retracted position. The release 1125 may be pivoted to the housing by a fastener 1126. The follower 1120*f* may be disposed through a hole formed through the housing wall. The follower 1120*f* may have an outer tongue engaged with a flute formed in an inner surface of the release 1125, thereby accommodating pivoting of the release relative to the housing while maintaining radial connection (pushing and pulling) between the follower and the release. One or more seals may be disposed between the follower 1120*f* and the housing. The release 1125 may be rotationally connected to the housing via capture of the upper end in the upper pocket by the pivot fastener 1126. Alternatively, the ribs 1105*r* may be omitted and the slots 710*p* may have a length equal to, greater than, or substantially greater than a combined length of the release 1125 and the driver 1130.

An inner portion of the driver 1130 may be retained in the lower pocket by upper and lower keepers fastened to the housing 1105. One or more biasing members, such as springs 1141, may be disposed between the keepers and lips of the driver 1130, thereby biasing the driver radially inward into the lower pocket. One or more radial pistons 1120*p* may be disposed in respective chambers formed in the lower pocket. A port may be formed through the housing wall providing fluid communication between an inner face of each radial piston 1120*p* and a lower face of the longitudinal piston 1145. An outer face of each radial piston 1120*p* may be in fluid communication with the wellbore. Downward longitudinal movement of the longitudinal piston 1145 may exert hydraulic pressure on the radial pistons 1120*p*, thereby pushing the drivers 1130 radially outward.

A chamber 1108*h* may be defined radially between the mandrel 1110 and the housing 1105 and longitudinally between one or more upper seals disposed between the housing 1105 and the mandrel 1110 proximate the snap ring 1111*a* and one or more lower seals disposed between the housing 1105 and the mandrel 1110 proximate the lower shoulder 1105*l*. One or more reservoirs 1108*u,l* may be formed in the housing 1105. Upper reservoir 1108*u* may be defined radially between the housing sections 1105*a,b* and longitudinally between an upper seal disposed between the housing sections 1105*a,b* and by a bottom of the housing section 1105*b*. A lower reservoir 1108*l* may be formed each of the ribs 1105*r*. A compensator piston may be disposed in each of the reservoirs 1108*u,l* and may divide the respective reservoir into an upper portion and a lower portion.

The upper portion of the upper reservoir 1108*u* may be sealed at surface with a nominal pressure or a vent (not shown) may be formed in a wall of the housing 1105 to maintain the upper portion at wellbore pressure. The lower reservoir upper portion may be in communication with the wellbore via the upper pocket. Hydraulic fluid may be disposed in the chamber 1108*h* and the lower portions of each reservoir 1108*u,l*. The lower portion of the upper reservoir 1108*u* may be in fluid communication with the chamber 1108*h* via leakage through snap rings 1109, 1111*a*. The lower reservoir lower portion may be in fluid communication with the chamber 1108*h* via hydraulic conduit formed in the respective rib. A bypass 1106 may be formed in an inner surface of the housing 1105. The bypass 1106 may allow leakage around seals of the longitudinal piston 1145 when the piston is in the retracted position (and possibly the orienting position). Once the longitudinal 1145 piston moves downward and the seals move past the bypass 1106, the longitudinal piston seals may isolate a portion of the chamber 1108*h* from the rest of the chamber.

A biasing member, such as a spring 1140*r*, may be disposed against the snap ring 1111*c* and the lower shoulder 1105*l*, thereby biasing the mandrel 1110 toward the retracted position. In addition to the spring 1140*r*, a bottom of the mandrel 1110 may have an area greater than a top of the mandrel 1110, thereby serving to bias the mandrel 1110 toward the retracted position in response to fluid pressure (equalized) in the housing bore. In the retracted position, the snap ring 1111*a* may seat against snap rings 1109, thereby longitudinally keeping the mandrel 1110 within the housing.

The cam profiles 1115*p* and radial piston ports may be sized to restrict flow of hydraulic fluid therethrough to dampen movement of the respective cam 1115 and radial pistons 1120*p* between their respective positions. This damping feature may prevent damage to the releases 1125 and/or the drivers 1130 due to jarring resulting from impact of the ball 1150 with the seat 1135.

FIGS. 12A-12F illustrate operation of the shifting tool 1100 and the power sub 700. The shifting tool 700 may be assembled as part of a drill string. The drill string may be run into the wellbore until each driver 1130 and each release 1125 are at a depth corresponding to the profile 710*p*. The ball 1150 may be deployed from the surface and pumped down through the drill string until the ball 1150 lands on the seat 1135. The ball 1150 may be rigid and made from a polymer, such as a thermoset (i.e., phenolic, epoxy, or polyurethane). Continued pumping may exert fluid pressure on the ball 1150, thereby driving the mandrel 1110 longitudinally downward until a bottom 1110*b* (FIG. 11C) of the shifting tool mandrel 1110 seats against a shoulder 1105*s* formed in an inner surface of the shifting tool housing 1105. Seating of the shifting tool mandrel 1110 may align the seat 1135 and intermediate dog with the housing groove 1105*g*.

Movement of the shifting tool mandrel 1110 may also disengage the upper shoulder 1110*u* from the shifting tool cam 1115 and the snap ring 1111*b* from the longitudinal piston 1145, thereby allowing movement to the orienting position. The spring 1140*c* may then move each cam profile 1115*p* downward relative to the respective follower 1120*f* until the follower engages an inclined portion of the profile, thereby slightly extending the release 1125. Simultaneously, the spring 1140*p* may move the longitudinal piston 1145 downward relative to each set of the radial pistons 1120*p* until one or more of the piston seals move past the bypass 1106, thereby isolating the a portion of the chamber 1108*h*, pressurizing the isolated portion, and slightly extending the drivers 1130. Since each driver 1130 and release 1125 will likely be misaligned with the respective profile 710*p*, the driver and release may only slightly extend until their progress is obstructed by the power sub mandrel wall.

The shifting tool 1100 may then be rotated by rotating the drill string from the surface until each driver 1130 and release 1125 are aligned with a respective profile 710*p*. Upon alignment, the spring 1140*c* may then continue to move each cam profile 1115*p* further downward relative to the respective follower 1120*f* along the inclined portion of the profile and the spring 1140*p* may continue to move the longitudinal piston 1145 downward relative to each set of the radial pistons 1120*p*. Extension of each release 1125 into the respective profile 710*p* may continue until the release engages the misaligned release sleeve wall.

Referring specifically to FIG. 12C, hydraulic extension of the drivers 1130 may allow each driver to radially extend independent of the other drivers. Further, each driver 1130 may have an inner flange, an outer tooth, and a shoulder formed between the flange and the tooth. The flange may be received by a corresponding guide profile in the lower pocket, thereby rotationally connecting the driver 1130 to the housing 1105 while allowing relative radial movement therebetween. A width of the tooth $w_t$ may be less than a width $w_s$ of a respective slot 710*p*. The independent extension of the drivers 1130 and the tolerance in the widths $w_t$, $w_s$ may account for eccentricity in the mandrel 710 (slight eccentricity shown) and/or the drill string and/or buildup of debris (not shown) in the profile 710*p*. A height of each driver tooth may be less than a thickness of the respective slot 710*p*. Extension of each driver 1130 into the respective slot 710*p* may continue until either the counter-force exerted by the radial springs 1141 equalizes with the pressure force exerted by the radial pistons 1120*p* or the driver shoulder engages an inner surface of the mandrel 710.

Referring specifically to FIG. 12D, once the drivers 1130 have engaged the mandrel profile 710*p*, the drill string may be lowered until a bottom of the drivers engage a bottom of the profile. At least a substantial portion of weight of the drill string may be exerted on the profile 710*p* to verify that the drivers 1130 have aligned with and engaged the profile 710*p*. A top of each driver 1130 may be inclined to force retraction of the drivers by engaging the driver tops with a top of the mandrel profile 710*p* if the shifting tool malfunctions or in the event of an emergency. Each release 1125 may also be forced to retract in the event of malfunction/emergency upon engagement of the releases with a top of the profile 710*p*.

Once engagement has been verified, the drill string may be raised. The shifting tool 1100 and power sub mandrel 710 may then be rotated by rotating the drill string. As discussed above, rotation of the power sub mandrel 710 may operate the power sub pump 750, thereby opening or closing the isolation valve 100 (depending on which power sub 700*o,c* is being operated). As the isolation valve 100 is being opened or closed, hydraulic fluid from the isolation valve 100 may alternate the other power sub and hydraulic fluid from the other power sub may push the release piston 720 upward, thereby operating the release sleeve 715. Once the stroke is complete, the sleeve profile 715*p* may be aligned with the mandrel profile 710*p*. Each release 1125 may now be allowed to extend into the sleeve profile 715*p*, thereby allowing further downward movement of the cam 1125 until the outer dog aligns with the housing groove 1105*g*, thereby allowing extension of the ball seat snap ring and releasing the ball 1150 from the ball seat 1135. The ball 1150 may then pass through the mandrel 1110 and the driller may receive indication at surface that the isolation valve 100 has been actuated. The spring 1140*r*, snap ring 1111*b*, and upper mandrel shoulder 1110*u* may then reset the shifting tool 1100. The drill string may further include a catcher 950 (see FIG. 13B) to receive the ball.

In another embodiment (not shown), instead of including opener and closer power subs, the isolation assembly may include a single power sub and a toggle sub. The toggle sub may be disposed between the power sub and the isolation valve. The toggle sub may also serve as the spacer sub. The toggle sub may be in fluid communication with the hydraulic couplings of the power sub and the hydraulic couplings of the isolation valve. The toggle sub may be operable between an open and a closed position. In the open position, the toggle sub may provide fluid communication between the power sub and the isolation valve such that operation of the power sub opens the isolation valve and in the closed position, the toggle sub may provide fluid communication between the power sub and the isolation valve such that operation of the power sub closes the isolation valve. The toggle sub may be operated before or after operating the isolation valve.

The toggle sub may have a profile for receiving a driver of a shifting tool. The shifting tool may be the same shifting tool used to operate the power sub or the drill string may include a second shifting tool for operating the toggle sub. Once the shifting tool has engaged the profile, the toggle sub may be operated by longitudinal movement of the shifting tool. The toggle sub may be operated bidirectionally, i.e., upward movement of the shifting tool may move the toggle sub to the open position and downward movement of the shifting tool may move the toggle sub to the closed position. Alternatively, the toggle sub may be unidirectionally operated, i.e., downward movement of the shifting tool may operate the toggle sub from the open to the closed position and repeated downward movement of the shifting tool may move the toggle sub from the closed to the open position. Additionally, the shifting tool may be operated by deploying a blocking member and the toggle sub may include a release interacting with a seat of the shifting tool to release the blocking member once the toggle sub has been operated from one of the positions to the other of the positions. Alternatively, the toggle sub may be operated by rotation of the shifting tool. The toggle sub may be used with any of the power subs, discussed above.

Figure 13A:
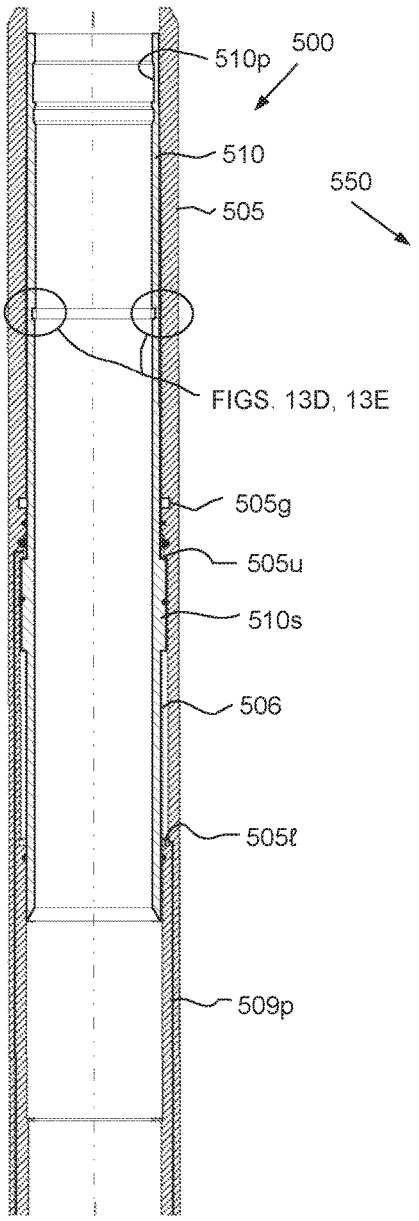
FIGS. 13A-13C are cross-sections of an isolation assembly in the closed position, according to another embodiment of the present invention.
Figure 13B:
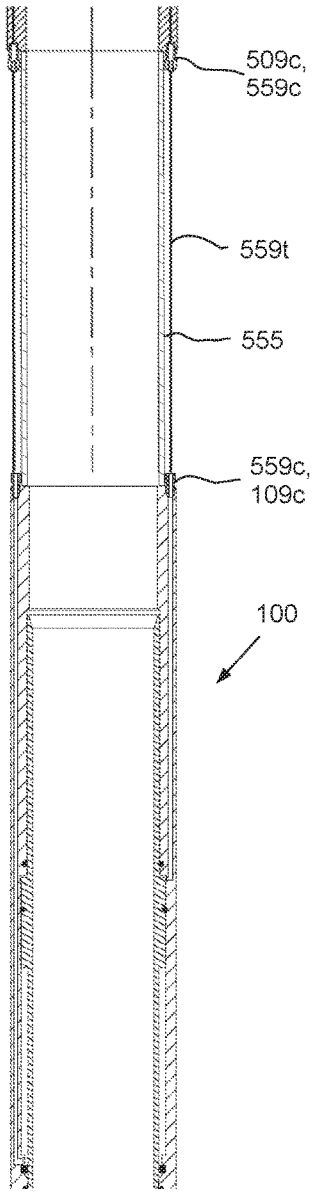
Figure 13C:
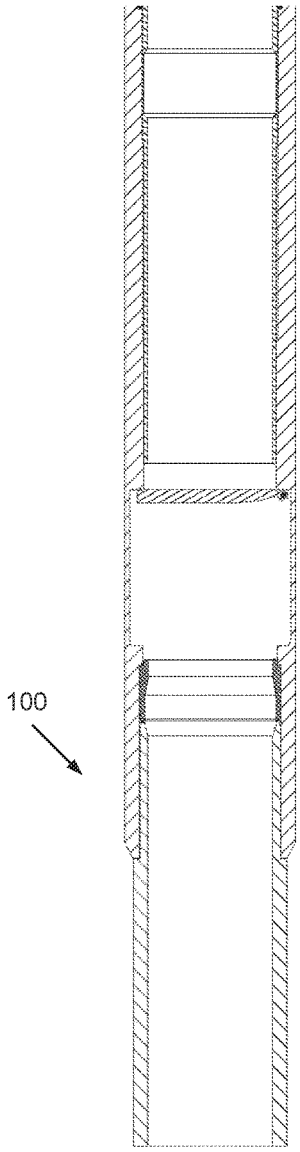
Figure 13D:
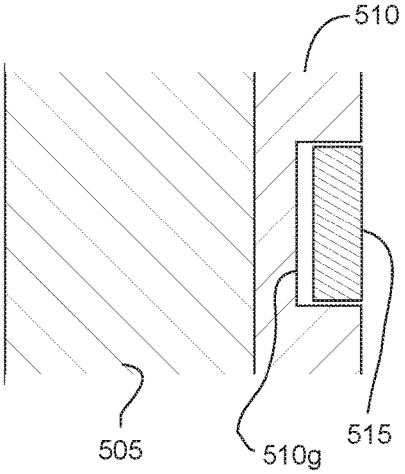
FIGS. 13D and 13E are enlargements of portions of FIG. 13A.
Figure 13E:
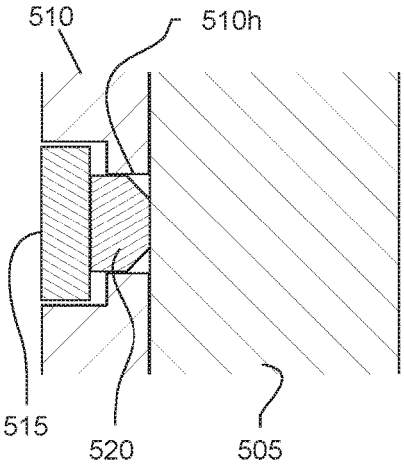
Figures 20A, 20B:
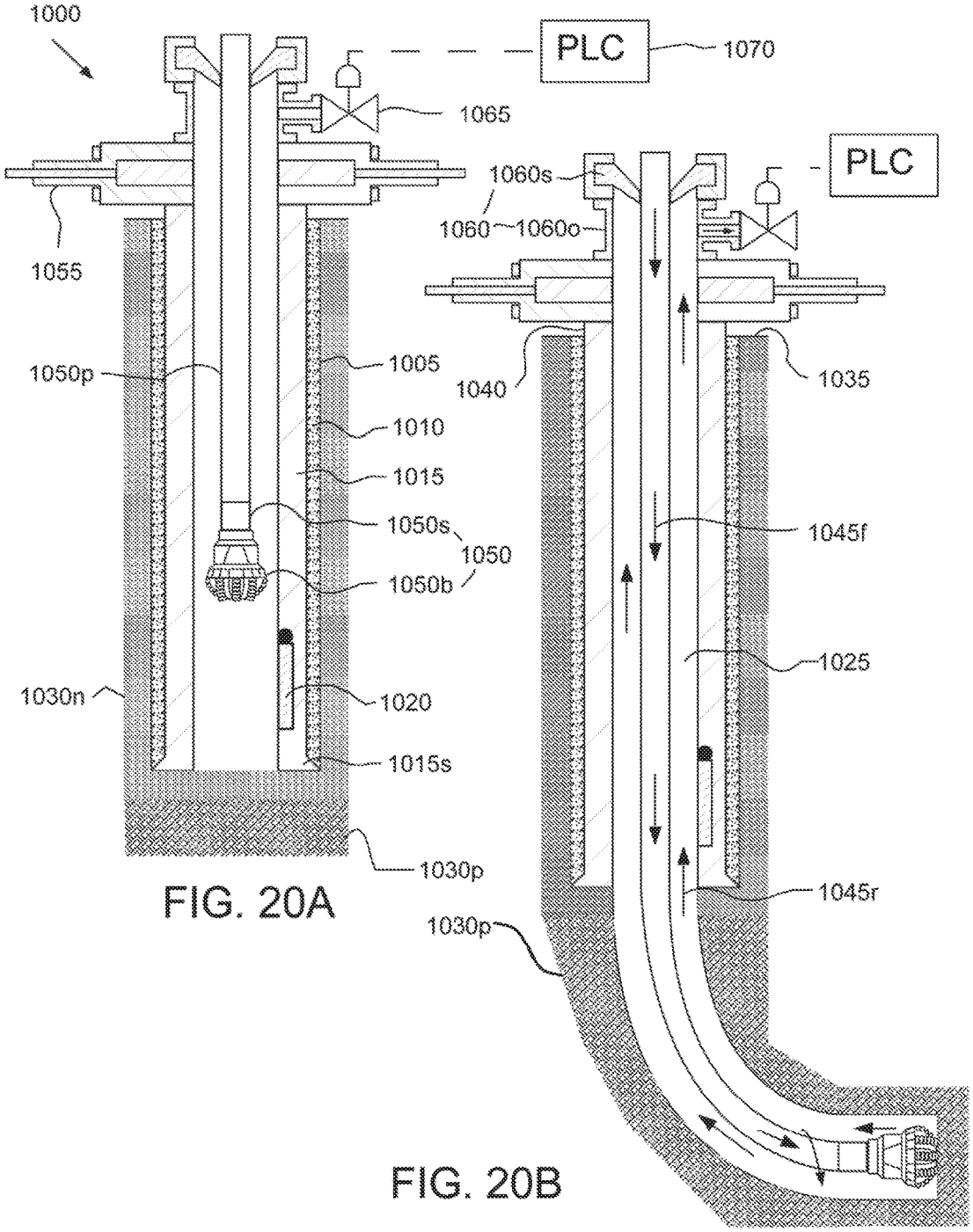
FIGS. 20A-20H illustrate a method of drilling and completing a wellbore, according to another embodiment of the present invention.
Figure 20D:
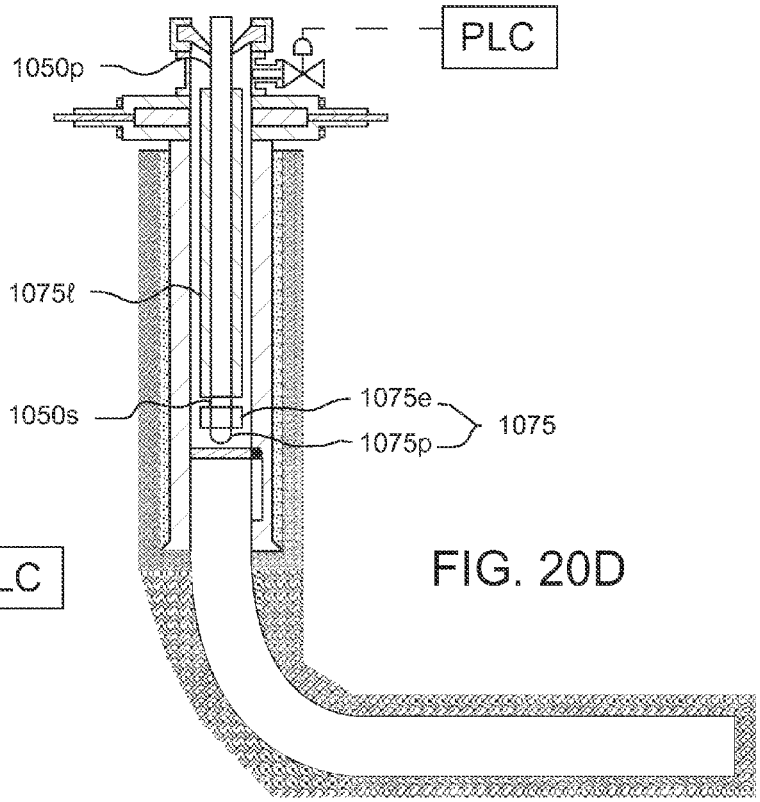
Figure 20C:
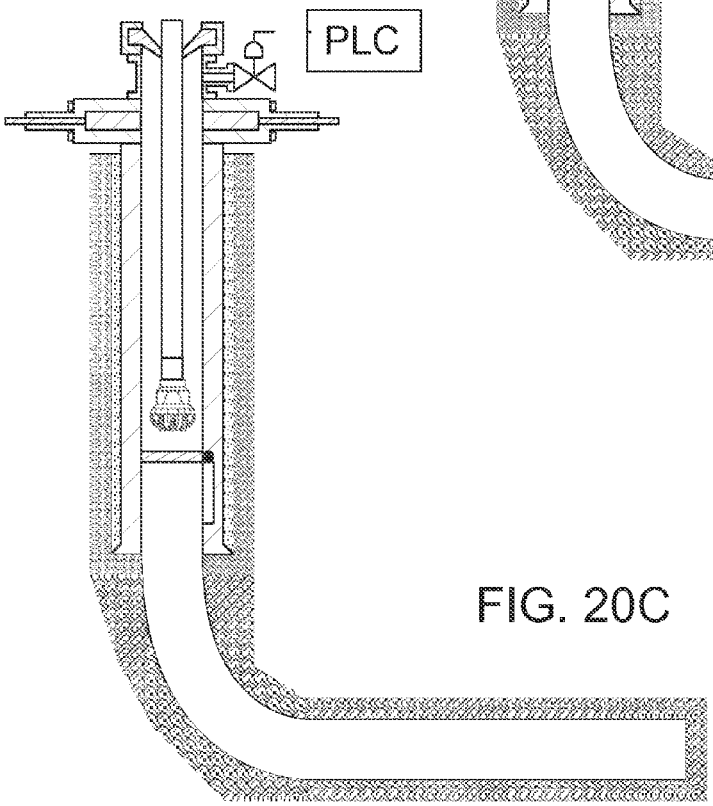
Figure 20F:
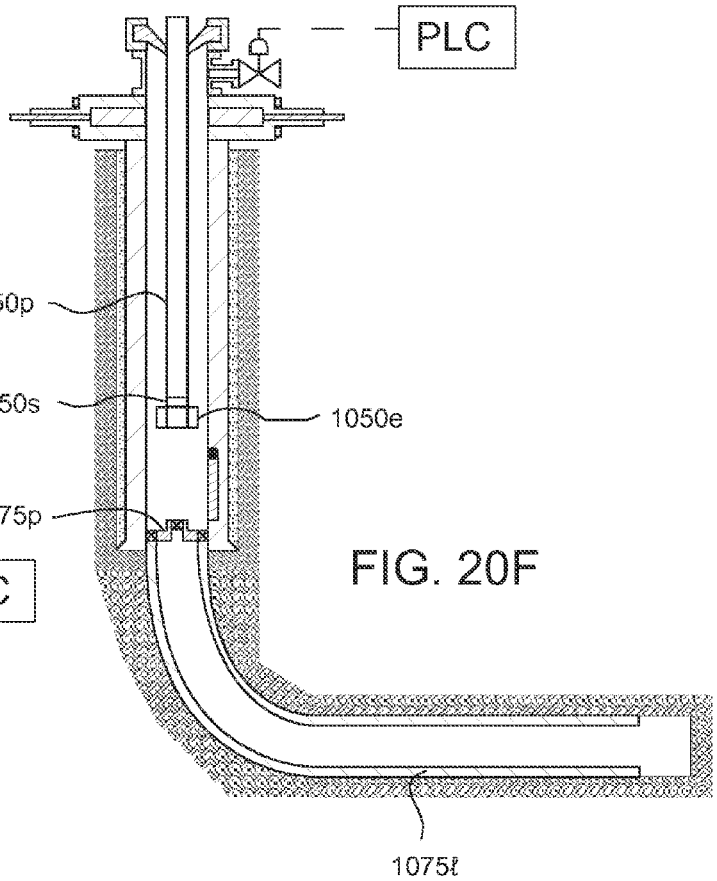
Figure 20E:
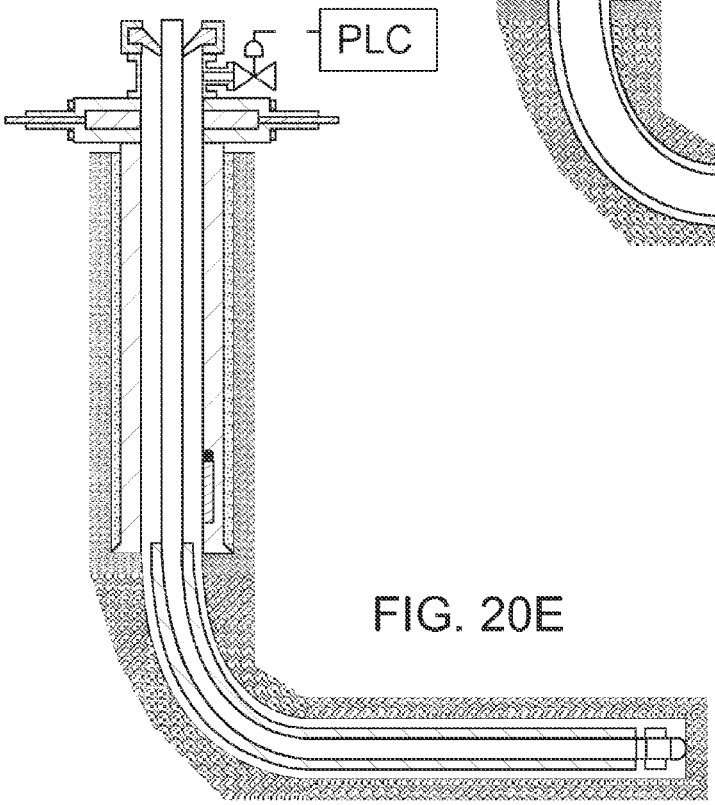
Figures 20G, 20H:
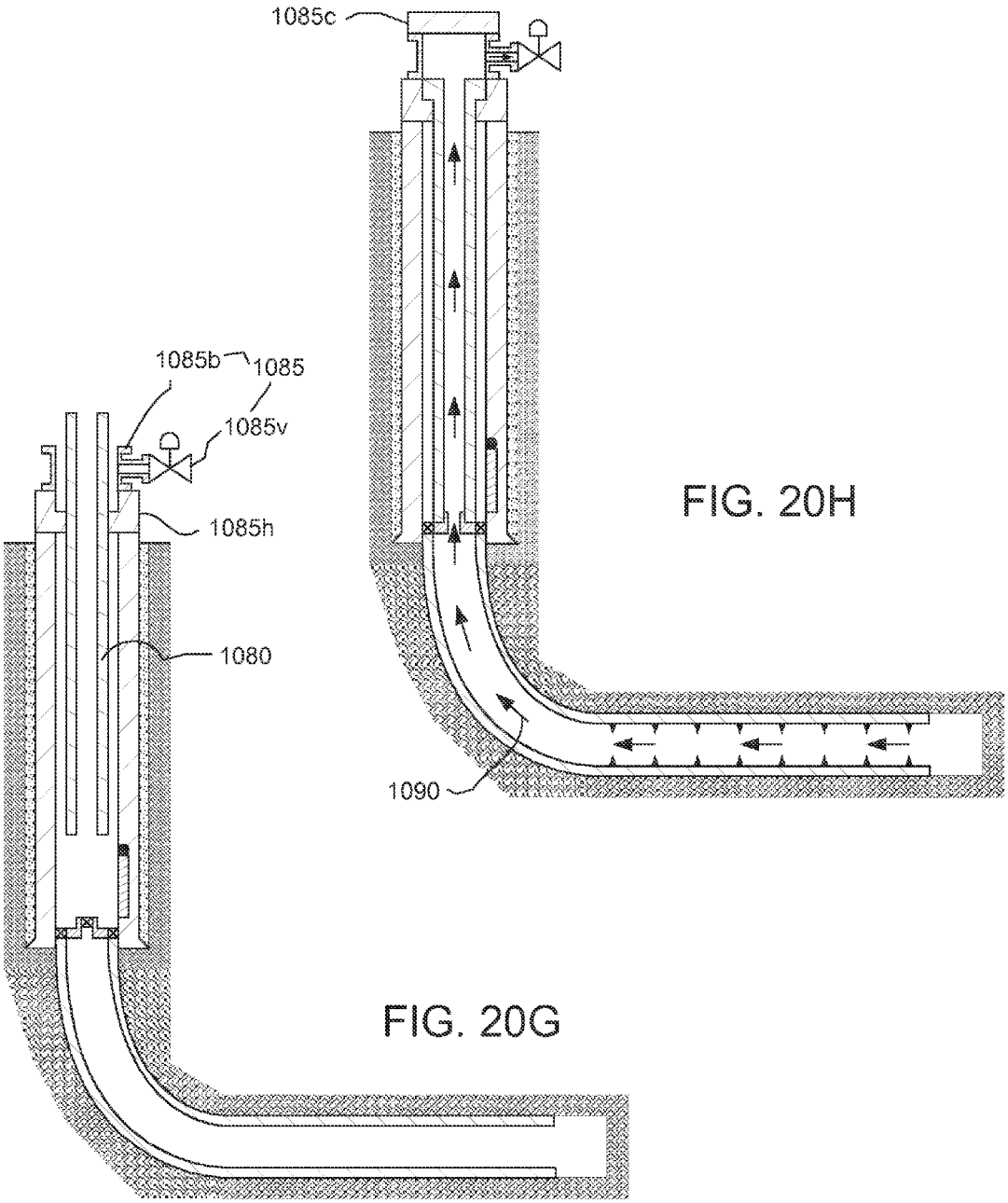

FIGS. 13A-13C are cross-sections of an isolation assembly in the closed position, according to another embodiment of the present invention. FIGS. 13D and 13E are enlargements of portions of FIG. 13A. The isolation assembly may include one or more power subs 500, a spacer sub 550, and the isolation valve 100. The isolation assembly may be assembled as part of a casing or liner string and run-into a wellbore (see FIG. 20A). The casing or liner string may be cemented in the wellbore or be a tie-back casing string. Although only one power sub 500 is shown, two power subs may be used in a similar three-way configuration discussed and illustrated above regarding the power subs 1*o,c*.

The power sub 500 may include a tubular housing 505 and a tubular mandrel 510. The housing 505 may have couplings (not shown) formed at each longitudinal end thereof for connection with other components of the casing/liner string. The couplings may be threaded, such as a box and a pin. The housing 505 may have a central longitudinal bore formed therethrough. Although shown as one piece, the housing 505 may include two or more sections to facilitate manufacturing and assembly, each section connected together, such as fastened with threaded connections. The housing may further have a groove 505*g* formed in an inner surface thereof.

The mandrel 510 may be disposed within the housing 505 and longitudinally movable relative thereto. The mandrel 510 may have a profile 510*p* formed in an inner surface thereof for receiving a driver, such as cleat 630, of a shifting tool 600. The mandrel 510 may further have an alignment groove 510*g* formed in an inner surface thereof for receiving a release 625 of the shifting tool 600. The mandrel 510 may further have one or more holes formed through a wall thereof in alignment with the groove and spaced therearound. A fastener, such as a snap ring 515 (FIGS. 13D and 13E), may be disposed in the groove 510*g* and one or more fasteners, such as dogs 515, may be disposed through respective holes 510*h*. Each dog 515 may engage an inner surface of the housing 505 and extend into the groove 510*g*. The snap ring 515 may be biased into engagement with and be received by the groove 510*g* except that the dogs 520 may prevent engagement of the snap ring 515 with the groove 510*g*.

The mandrel 510 may further have a piston shoulder 510*s* formed in an outer surface thereof. The piston shoulder 510*s* may be disposed in a chamber 506. The housing 505 may further have upper 505*u* and lower 505*l* shoulders formed in an inner surface thereof. The chamber 506 may be defined radially between the mandrel 510 and the housing 505 and longitudinally between an upper seal disposed between the housing 505 and the mandrel 510 proximate the upper shoulder 505*u* and a lower seal disposed between the housing 505 and the mandrel 510 proximate the lower shoulder 505*l*. Hydraulic fluid may be disposed in the chamber 506. Each end of the chamber 506 may be in fluid communication with a respective hydraulic coupling 509*c* via a respective hydraulic passage 509*p* formed longitudinally through a wall of the housing 505.

The spacer sub 550 may include a tubular housing 555 having couplings (not shown) formed at each longitudinal end thereof for connection with the power sub 300 and the isolation valve 100. The couplings may be threaded, such as a pin and a box. The spacer sub 550 may further include hydraulic conduits, such as tubing 559*t*, fastened to an outer surface of the housing 555 and hydraulic couplings 559*c* connected to each end of the tubing 559*t*. The hydraulic couplings 559*c* may mate with respective hydraulic couplings of the power sub 500 and the isolation valve 100. The spacer sub 550 may provide fluid communication between a respective power sub passage 509*p* and a respective isolation valve passage 109*p*. The spacer sub 550 may also have a length sufficient to accommodate the BHA of the drill string while the shifting tool 600 is engaged with the power sub 500, thereby providing longitudinal clearance between the drill bit and the flapper 120. The spacer sub length may depend on the length of the BHA. Further, a spacer sub may also be disposed between the opener power sub and the closer power sub to ensure that the wrong power sub is not inadvertently operated.

Figure 14A:
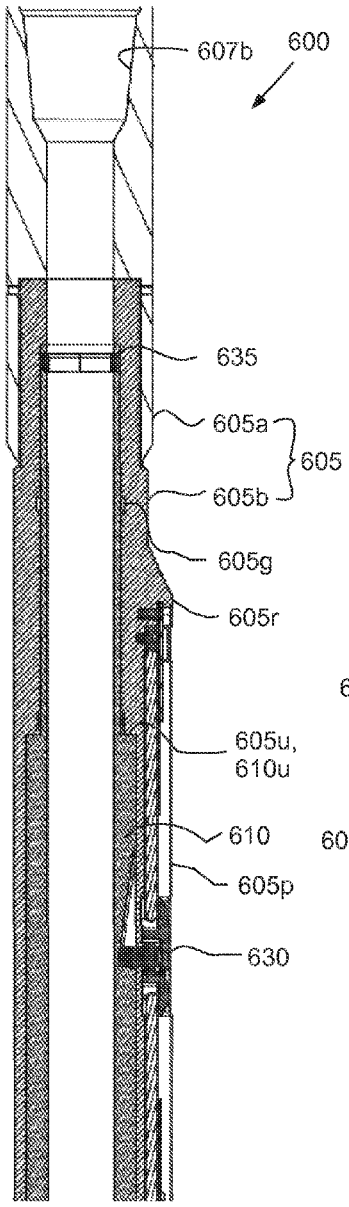
FIGS. 14A and 14B are cross-sections of a shifting tool for actuating the isolation assembly between the positions, according to another embodiment of the present invention.
Figure 14B:
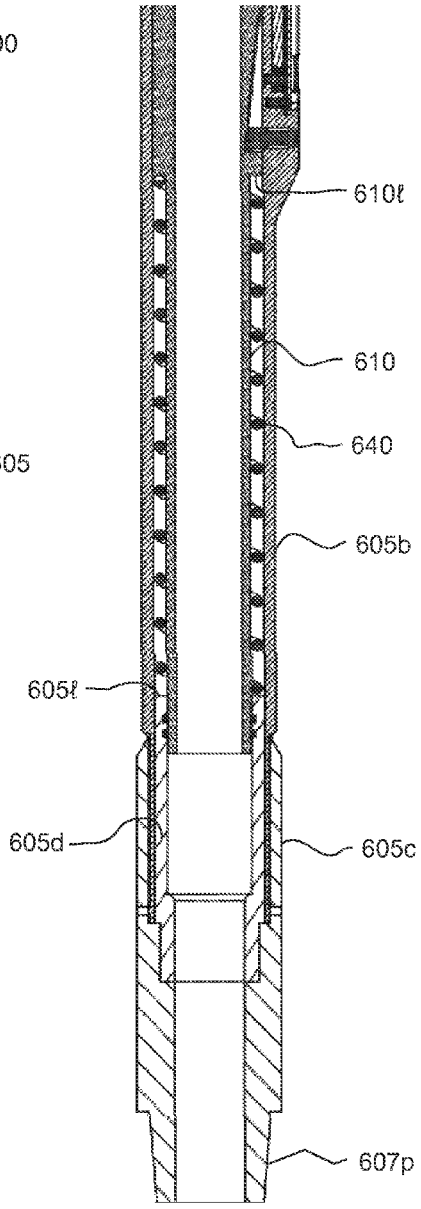
Figure 14C:
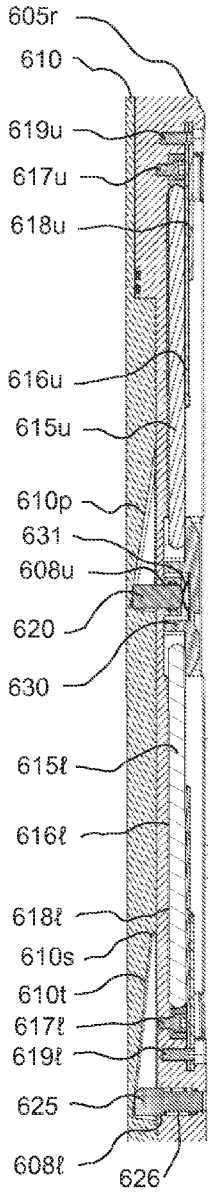
FIG. 14C is an enlargement of a portion of FIGS. 14A and 14B.

FIGS. 14A and 14B are cross-sections of a shifting tool 600 for actuating the isolation valve 100 between the positions, according to another embodiment of the present invention. FIG. 14C is an enlargement of a portion of FIGS. 14A and 14B. The shifting tool 600 may include a tubular housing 605, a tubular mandrel 610, and one or more drivers, such as cleats 630. The housing 605 may have couplings 607*b,p* formed at each longitudinal end thereof for connection with other components of a drill string. The couplings may be threaded, such as a box 607*b* and a pin 607*p*. The housing 605 may have a central longitudinal bore formed therethrough for conducting drilling fluid. The housing 605 may include two or more sections 605*a-d* to facilitate manufacturing and assembly, each section 605*a-c* connected together, such as fastened with threaded connections. The housing section 605*d* may be connected to the other sections 605*a-c* by being disposed between the sections 605*b,c*. An inner surface of the housing 605 may have a groove 605*g* and an upper shoulder 605*u* formed therein, a top of the housing section 605*d* may serve as a lower shoulder 605*l*, and a wall of the housing 605 may have one or more holes 608*u,l* formed therethrough.

Figures 15A, 15B, 15C, 15D:
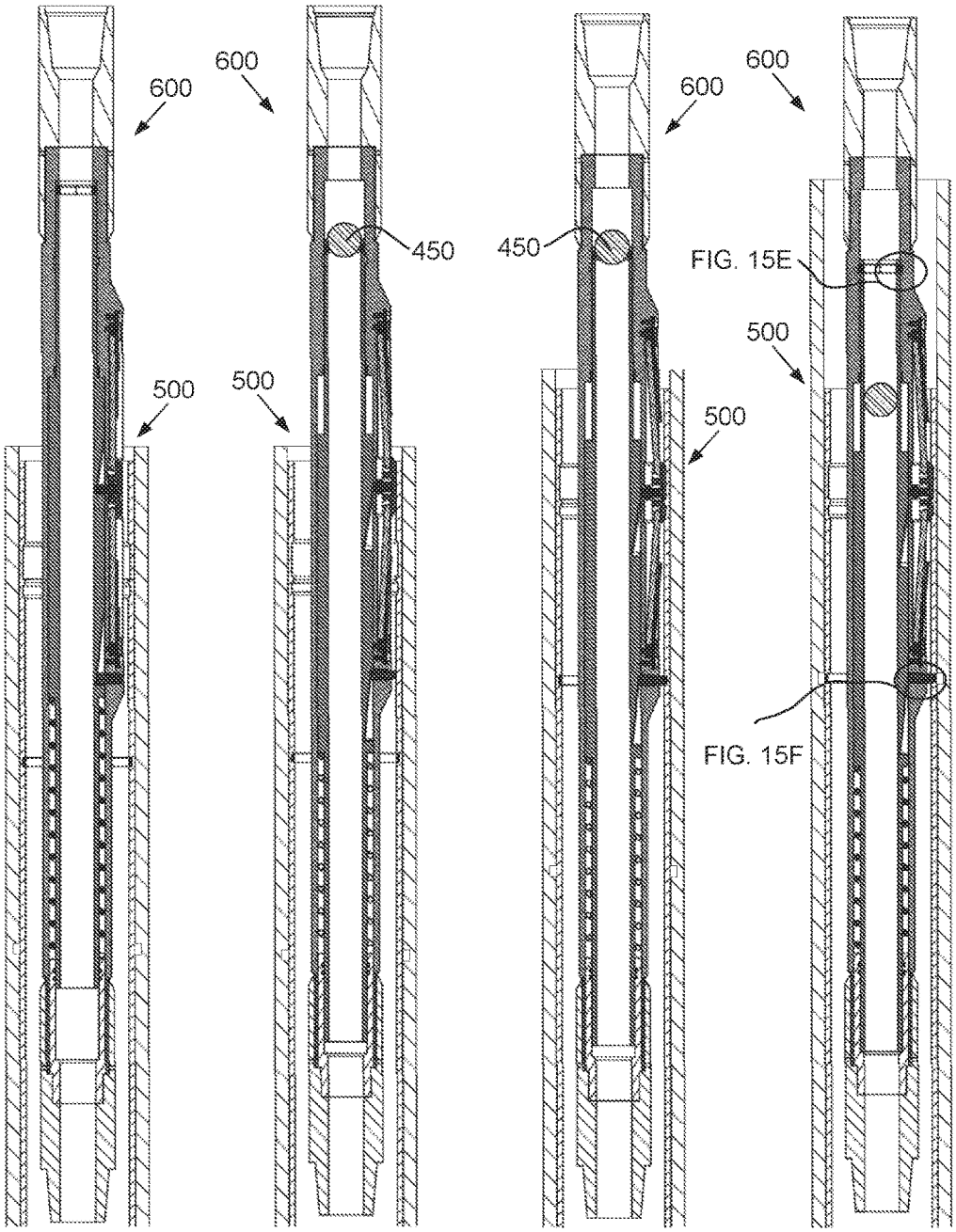

The mandrel 610 may be disposed within the housing 605 and longitudinally movable relative thereto between a retracted position (shown), an engaged position (see FIG. 15C), and a released position (see FIG. 15D). The mandrel 610 may have upper 610*u* and lower 610*l* shoulders formed in an outer surface thereof and upper and lower profiles, such as tapers 610*p,t*, formed in an outer surface thereof. A seat 635 may be fastened to the mandrel 610 for receiving a blocking member, such as a ball 450 (see FIG. 15B), pumped from the surface. The seat 635 may include an inner fastener, such as a snap ring 635*i* (FIG. 15E), and one or more outer fasteners, such as dogs 635*o*. Each dog 635*o* may be disposed through a respective hole 610*h* formed through a wall of the mandrel. Each dog 635*o* may engage an inner surface of the housing 605 and extend into a groove 610*g* formed in an inner surface of the mandrel 610*g*. The snap ring 635*i* may be biased into engagement with and be received by the groove 610*g* except that the dogs 635*o* may prevent engagement of the snap ring 635*i* with the groove 610*g*, thereby causing a portion of the snap ring 635*i* to extend into the mandrel bore to receive the ball 450.

One or more ribs 605*r* may be formed in an outer surface of the housing. A pocket 605*p* may be formed in each rib 605*r*. The cleat 630 may be disposed in the pocket 605*p* in the retracted position. The cleat 630 may be connected to upper 615*u* and lower arms 615*l*, such as by pivoting. A part of the connection between the cleat 630 and the arms 615*u,l* is not cut in this section and shown by backline only. The arms 615*u,l* may each be disposed in the pocket 605*p* (in the retracted position) and received by respective sockets connected to the housing 605, such as by one or more fasteners 617*u,l*, thereby pivoting the arms 615*u,l* to the housing. The arms 615*u,l* may each be biased toward the retracted position by one or more biasing members, such as upper 616*u* and lower 616*l* inner leaf springs and upper 618*u* and lower 618*l* outer leaf springs. Each of the upper leaf springs 616*u*, 618*u* may be disposed in the pocket 605*p* and connected to the housing 605, such as being received by a groove formed in the housing and fastened to the housing with upper fasteners 619*u* and each of the lower leaf springs 616*l*, 618*l* may be disposed in the pocket 605*p* and connected to the housing 605, such as being received by a groove formed in the housing 605 and fastened to the housing with lower fasteners 619*l*.

The cleat 630 may abut the housing 605 in the retracted position and have a cavity formed therein. A lug may be formed in the housing outer surface and extend into the cavity. The hole 608*u* may extend through the lug. A pusher, such as a pin 620, may be disposed between the cleat 630 and the mandrel 610 and in the profile 610*p*, and may extend through the hole 608*u*. One or more seals may be disposed between the housing lug and the pin 620. A biasing member, such as a leaf spring 631, may be connected to the cleat 630 and may bias the cleat 630 away from the pin 620. A release, such as a pin 625, may be disposed between the housing 605 and the mandrel 610 and in the profile 610*t* and extend through the hole 608*l*. A biasing member, such as a spring 626 may be disposed in the hole and may bias the release pin 625 toward the retracted position. One or more seals may be disposed between the housing 605 and the release pin 625.

A chamber may be defined radially between the mandrel 610 and the housing 605 and longitudinally between one or more upper seals disposed between the housing 605 and the mandrel 610 proximate the upper shoulder 605*u* and one or more lower seals disposed between the housing 605 and the mandrel 610 proximate the lower shoulder 605*l*. Lubricant may be disposed in the chamber. A compensator piston (not shown) may be disposed in the mandrel 610 or the housing 605 to compensate for displacement of lubricant due to movement of the mandrel 610. The compensator piston may also serve to equalize pressure of the lubricant (or slightly increase) with pressure in the housing bore. A biasing member, such as a spring 640, may be disposed against the lower shoulders 610*l*, 605*l*, thereby biasing the mandrel 610 toward the retracted position. In addition to the spring 640, bottom of the mandrel 610 may have an area greater than a top of the mandrel 610, thereby serving to bias the mandrel 610 toward the retracted position in response to fluid pressure (equalized) in the housing bore.

FIGS. 15A-15F illustrate operation of the shifting tool 600. The shifting tool 600 may be assembled as part of a drill string. The drill string may be run into the wellbore until the cleat 630 is aligned or nearly aligned with the power sub profile 510*p*. The ball 450 may be launched from the surface and pumped down through the drill string until the ball 450 lands on the seat 635. Continued pumping may exert fluid pressure on the ball 450, thereby driving the mandrel 610 longitudinally downward and moving the profiles 610*p,t* relative to the pins 620, 625 until the release pin 625 engages a shoulder 610*s* of the profile 610*t*.

The pins 620, 625 may be wedged outward by (relative) movement along the profiles 610*p,t*. The driver pin 620 may push the cleat 630 into engagement with an inner surface of the power sub mandrel 510 and the release pin 625 may directly engage an inner surface of the power sub mandrel 510. If the cleat 630 is misaligned with the power sub profile 510*p*, then the shifting tool 600 may be raised and/or lowered until the cleat 630 is aligned. The ball 450 may be deployed with the shifting tool intentionally misaligned slightly above the profile to prevent overshoot. The leaf spring 631 may allow the cleat 630 to be pushed inward by the profile 510*p* during engagement of the profile 510*p* with the cleat 630. Retention of the ball seat 635 by the release pin 625 may safeguard against false actuation of the isolation valve 100.

Once the cleat 630 engages the power sub profile 610*p*, the release 625 may simultaneously engage the power sub snap ring 515. Engagement of the cleat 630 with the profile 510*p* may longitudinally connect the shifting tool 600 and the power sub mandrel 510. The longitudinal connection may be bi-directional or uni-directional. The shifting tool 600 may be lowered (or lowering may continue), thereby also moving the power sub mandrel 510 longitudinally downward and actuating the isolation valve 100. If only one power sub is used (bi-directional connection), then the shifting tool 600 may be raised or lowered depending on the last position of the isolation valve 100. Use of two-power subs 500 in the three-way configuration in conjunction with the uni-directional (downward) connection advantageously allows retrieval of the drill string in the event of emergency and/or malfunction of the power subs and/or shifting tool by simply pulling up on the drill string.

Once the power sub piston 510*s* has reached a bottom of the chamber 506, the power sub mandrel groove 510*g* may become aligned with the power sub housing groove 505*g*. The power sub snap ring 515 may extend into the power sub mandrel groove 510*g* and push the dogs 520 partially into the power sub housing groove 505*g*. The release pin 610*s* may pass the shoulder 610*s*, thereby allowing the release pin 625 to follow the snap ring 515 and release the mandrel 610 from the housing 605. The mandrel 610 may then move longitudinally downward until the ball seat dogs 635*o* align with the housing groove 605*g*, thereby allowing extension of the ball seat snap ring 635*i* and releasing the ball 450 from the ball seat 635. The ball 450 may then pass through the mandrel 610 and the driller may receive indication at surface that the isolation valve 100 has been actuated. The springs 640, 626 and arms 615*u,l* may then reset the shifting tool 600. The drill string may further include a catcher 950 (see FIG. 17B) to receive the ball.

Alternatively, the snap ring 515 may be omitted and the dogs 520 may extend inward to be flush with an inner surface of the mandrel 510. Alternatively, a collet may be used instead of the ball seat snap ring 635*i* and dogs 635*o*. Alternatively, the power sub 500 may include a release piston instead of the snap ring 515 and dogs 520 and a driver. The release piston may be similar to the release piston 315 in function to receive return hydraulic fluid from the isolation valve. The driver may be different from the sleeve 320 in that it may not be connected to the release piston. The release piston may be movable into engagement with the driver to push a leaf spring connected to the driver radially inward to engage the shifting tool and release the seat. Alternatively, the driver may be a collet and the release piston may actuate the collet between an engaged position and a disengaged position. The release pin of the shifting tool may engage the collet and the seat may be released when the collet is in the disengaged position. Alternatively, the acts of exerting the first threshold may be omitted and the second threshold may be initially exerted on the ball.

Figure 16A:
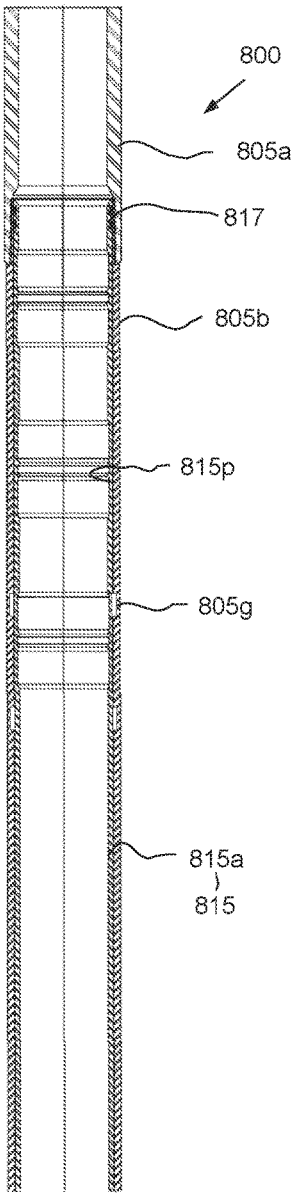
FIGS. 16A-16C are cross-sections of an isolation assembly in the closed position, according to another embodiment of the present invention.
Figure 16B:
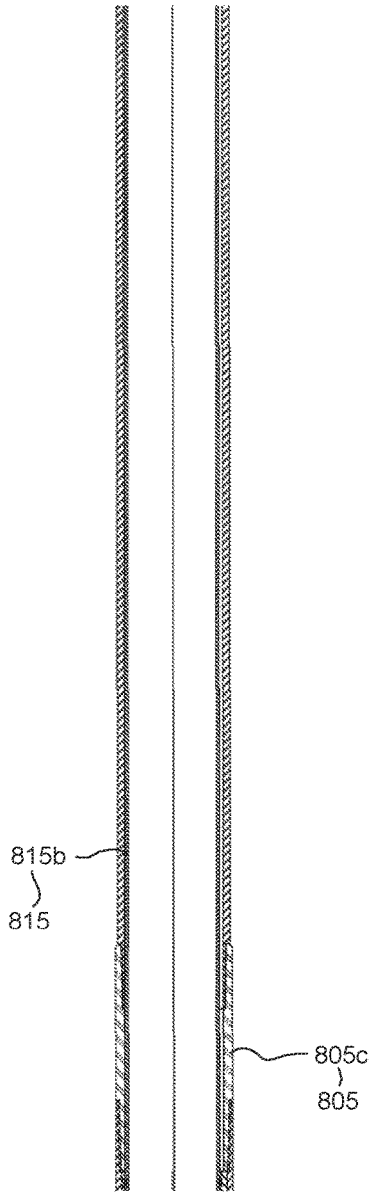
Figure 16C:
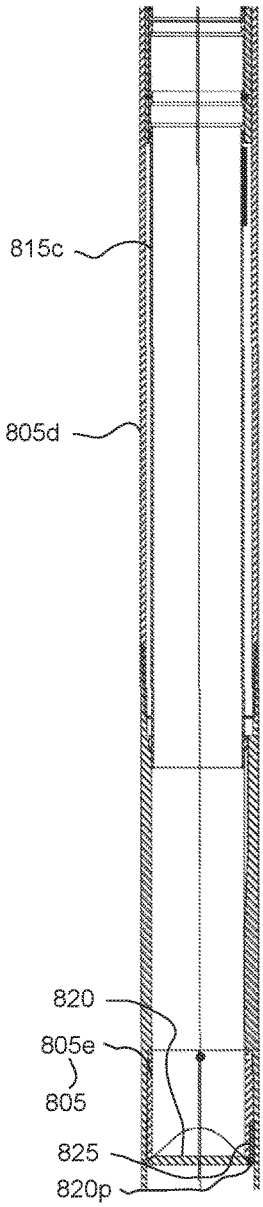

FIGS. 16A-16C are cross-sections of an isolation valve 800 in the closed position, according to another embodiment of the present invention. The isolation valve 800 may include a tubular housing 805, a flow tube 815, and a closure member, such as a flapper 820. As discussed above, the closure member may be a ball (not shown) instead of the flapper 820. To facilitate manufacturing and assembly, the housing 805 may include one or more sections 805*a-d* each connected together, such as fastened with threaded connections. The housing 805 may have a longitudinal bore formed therethrough for passage of a drill string. The housing 805 may further have one or more indicator grooves 805*g* formed in an inner surface thereof.

The flow tube 815 may have one or more profiles 815*p* formed in an inner surface thereof for receiving a driver, such as a cleat 930 of a shifting tool 900. To facilitate manufacturing and assembly, the flow tube 815 may include one or more sections 815*a-c* each connected together, such as fastened with threaded connections and/or fasteners. The housing 805 and the flow tube 815 may each have a length sufficient to accommodate the BHA of the drill string while the shifting tool 900 is engaged with one of the profiles 815*p*, thereby providing longitudinal clearance between the drill bit and the flapper 820. The flow tube 815 may further have an indicator groove 815*g* (FIG. 18C) formed in an inner surface thereof. A fastener, such as a snap ring 817, may be disposed in the groove 815*g*. The snap ring 817 may be biased outward into engagement with an inner surface of the housing 805.

The flow tube 815 may be longitudinally movable relative to the housing 805 between the open position and the closed position. In the closed position, the flow tube 815 may be clear from the flapper 820, thereby allowing the flapper 820 to close. In the open position, the flow tube 815 may engage the flapper 820, push the flapper 820 to the open position, and engage a seat (not shown, see seat 108*s*) formed in the housing 805. Engagement of the flow tube 815 with the seat may protect the flapper 820 and the flapper seat 806*s*. The flapper 820 may be pivoted to the housing 805, such as by a fastener 820*p*. A biasing member, such as a torsion spring 825 may engage the flapper 820 and the housing 805 and be disposed about the fastener 820*p* to bias the flapper 820 toward the closed position. In the closed position, the flapper 820 may fluidly isolate an upper portion of the valve from a lower portion of the valve.

The isolation valve 800 may be purely mechanical in that the isolation valve may have no elastomer (or other polymer) seals and no hydraulic fluid. The flapper and flapper seat as well as any other seals may be metal-to-metal.

Figure 17A:
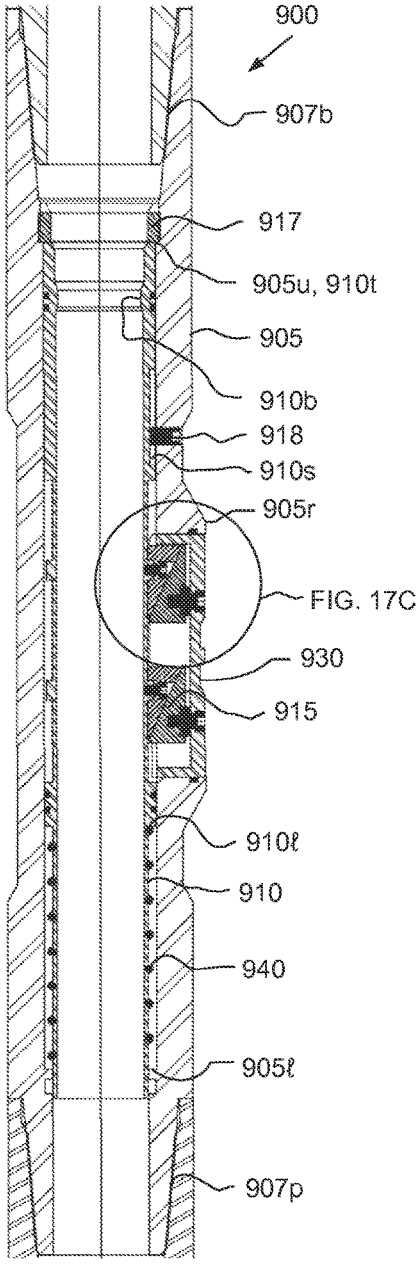
FIG. 17A is a cross-section of a shifting tool for actuating the isolation assembly between the positions, according to another embodiment of the present invention.

FIG. 17A is a cross-section of a shifting tool 900 for actuating the isolation valve 800 between the positions, according to another embodiment of the present invention. FIG. 17C is an enlargement of a portion of FIG. 17A. The shifting tool 900 may include a tubular housing 905, a tubular mandrel 910, and one or more drivers, such as cleats 930. The housing 905 may have couplings 907*b,p* formed at each longitudinal end thereof for connection with other components of a drill string. The couplings may be threaded, such as a box 907*b* and a pin 907*p*. The housing 905 may have a central longitudinal bore formed therethrough for conducting drilling fluid. The housing 905 may include two or more sections to facilitate manufacturing and assembly, each section connected together, such as fastened with threaded connections. An inner surface of the housing 905 may have an upper 905*u* and lower 905*l* shoulder formed therein.

Figure 18C:
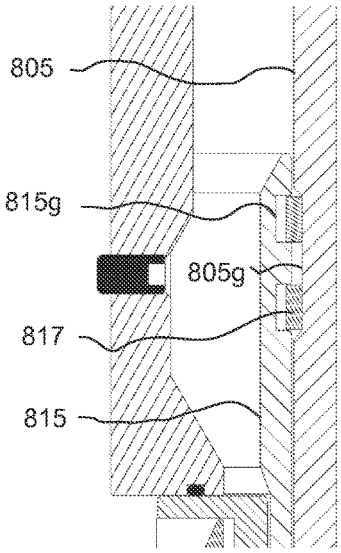
FIGS. 18A-18E illustrate operation of the shifting tool.
Figures 18A, 18B, 18D, 18E:
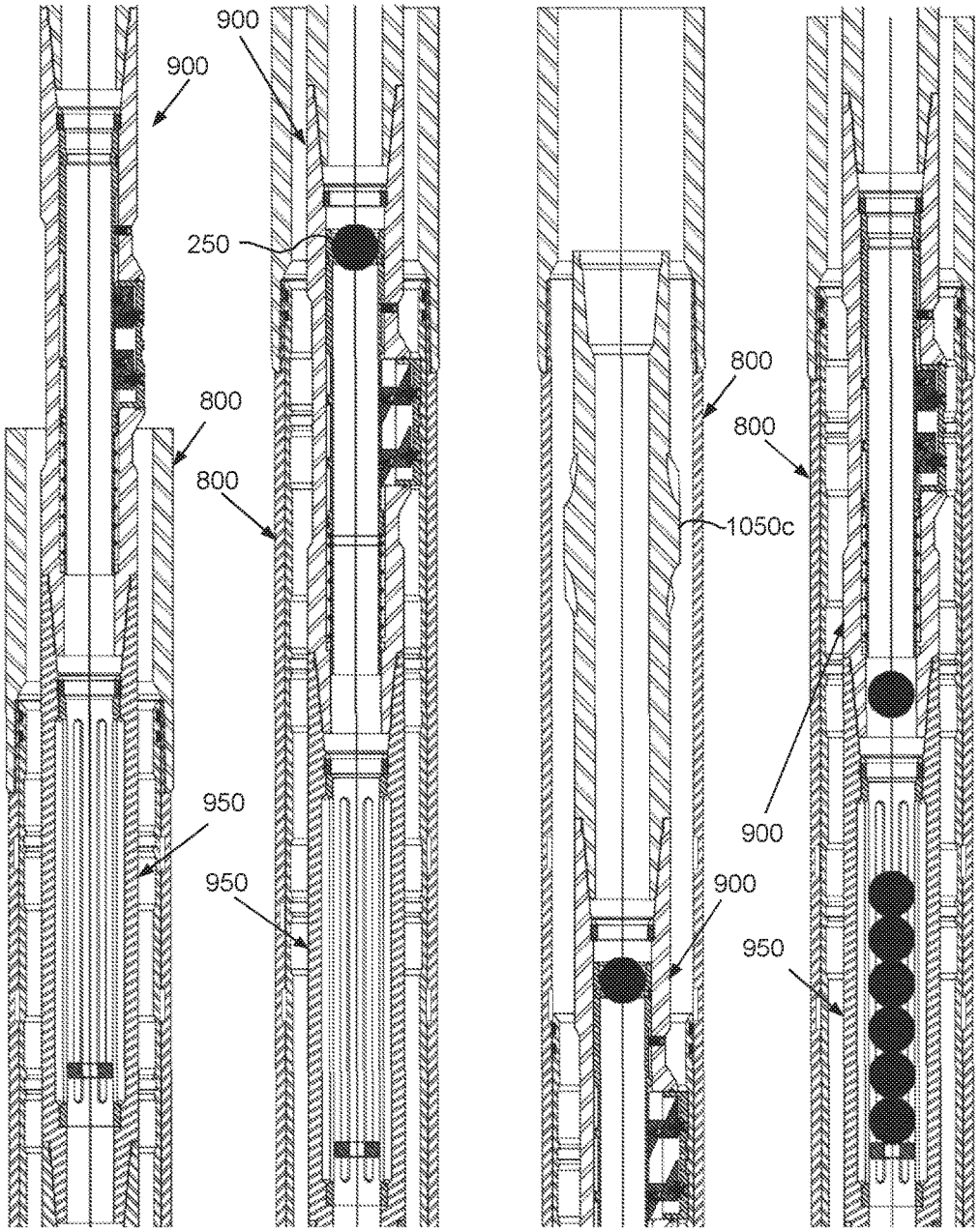

The mandrel 910 may be disposed within the housing 905 and longitudinally movable relative thereto between a retracted position (shown) and an engaged position (FIGS. 18C and 18D). The mandrel 910 may have a top 910*t*, a seat 910*b* formed in an inner surface thereof for receiving a blocking member, such as a ball 250 (FIG. 18B), pumped from the surface, one or more profiles, such as slots 910*s*, formed in an outer surface thereof, one or more lugs 910*g* formed in an outer surface thereof, and a shoulder 910*l* formed in an outer surface thereof. One or more fasteners, such as pins 918, may be disposed through respective holes formed through a wall of the housing and extend into the respective slots, thereby rotationally connecting the mandrel 910 to the housing 905. In the retracted position, the mandrel top 910*t* may be stopped by engagement with a fastener, such as a ring 917, connected to the housing 905, such as by a threaded connection. The stop ring 917 may engage the upper housing shoulder 905*u*.

One or more ribs 905*r* may be formed in an outer surface of the housing 905. A pocket 905*p* may be formed through each rib 905*r*. The cleat 930 may be disposed in the pocket 905*p* in the retracted position. The cleat 930 may be moved outward toward to the engaged position by one or more wedges 915 disposed in the pocket 905*p*. Each wedge 915 may include an inner member 915*i* and an outer member 915*o*. The inner member 915*i* may be connected to the mandrel lug 910*g*, such as by a fastener 916*i*. The outer member 915*o* may be connected to the cleat 930, such as by a fastener 916*o*. A clearance may be provided between the cleat and the fastener and a biasing member, such as a Bellville spring 931, may be disposed between the outer member 915*o* and the cleat 930 to bias the cleat 930 into engagement with the fastener 916*o*. A seal may be disposed between the cleat 930 and the housing 905.

A chamber may be defined radially between the mandrel 910 and the housing 905 and may include the pocket 905*p*. The chamber may be longitudinally defined between one or more upper seals disposed between the housing 905 and the mandrel 910 proximate the ball seat 910*b* and one or more lower seals disposed between the housing 905 and the mandrel 910 proximate the lower shoulder 910*l*. Lubricant may be disposed in the chamber. A compensator piston (not shown) may be disposed in the mandrel 910 or the housing 905 to compensate for displacement of lubricant due to movement of the mandrel 910. The compensator piston may also serve to equalize pressure of the lubricant (or slightly increase) with pressure in the housing bore. A biasing member, such as a spring 940, may be disposed against the lower shoulders 910*l*, 905*l*, thereby biasing the mandrel 910 toward the retracted position. Alternatively, instead of the spring 940, a bottom of the mandrel 910 may have an area greater than the top 910*t* the mandrel 910, thereby serving to bias the mandrel 910 toward the retracted position in response to fluid pressure (equalized) in the housing bore.

Figure 17B:
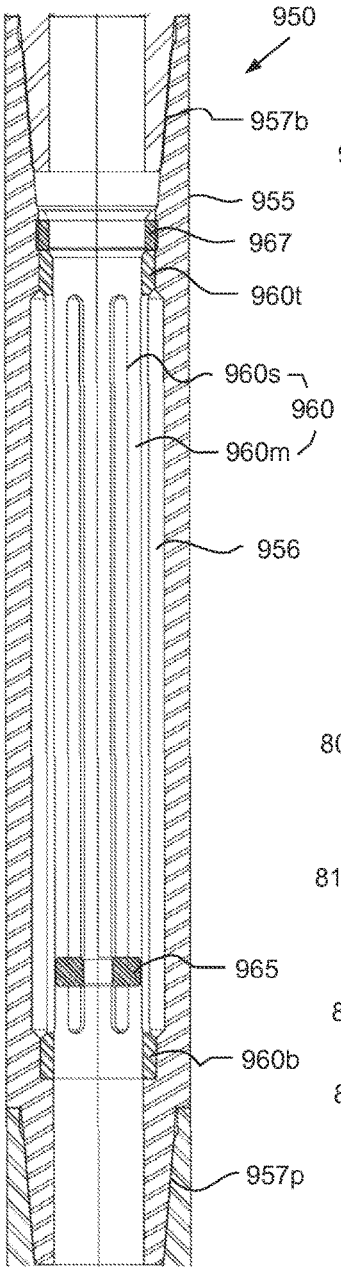
FIG. 17B is a cross section of a catcher for use with the shifting tool.
Figure 17C:
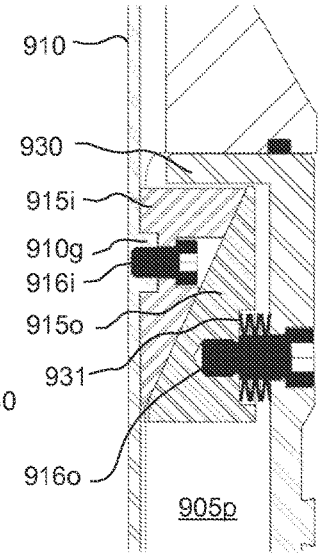
FIG. 17C is an enlargement of a portion of FIG. 17A.

FIG. 17B is a cross section of a catcher 950 for use with the shifting tool 900. The catcher 950 may receive one or more balls 250, such as seven, so that the isolation valve 800 may be actuated a plurality of times during one trip of the drill string. The catcher 950 may include a tubular housing 955, a tubular cage 960, and a baffle 965. The housing 955 may have couplings 957*b,p* formed at each longitudinal end thereof for connection with other components of a drill string. The couplings may be threaded, such as a box 957*b* and a pin 957*p*. The housing 955 may have a central longitudinal bore formed therethrough for conducting drilling fluid. An inner surface of the housing 955 may have an upper and lower shoulder formed therein.

The cage 960 may be disposed within the housing 955 and connected thereto, such as by being disposed between the lower housing shoulder and a fastener, such as a ring 967, connected to the housing 955, such as by a threaded connection. The cage 960 may be made from an erosion resistant material, such as a tool steel or cermet, or be made from a metal or alloy and treated, such as a case hardened, to resist erosion. The retainer ring 967 may engage the upper housing shoulder. The cage 960 may have solid top 960*t* and bottom 960*b* and a perforated body 960*m*, such as slotted 960*s*. The slots 960*s* may be formed through a wall of the body 960*m* and spaced therearound. A length of the slots 960*s* may correspond to a ball capacity of the catcher. The baffle 965 may be fastened to the body 960*m*, such as by one or more fasteners (not shown). An annulus 956 may be formed between the body 960*m* and the housing. The annulus 956 may serve as a fluid bypass for the flow of drilling fluid through the catcher 950. The first caught ball may land on the baffle 965. Drilling fluid may enter the annulus 956 from the housing bore through the slots 960*s*, flow around the caught balls along the annulus 956, and re-enter the housing bore thorough the slots 960*s* below the baffle 965.

FIGS. 18A-18E illustrate operation of the shifting tool 900. The shifting tool 900 may be assembled as part of a drill string. The drill string may be run into the wellbore until the cleat 930 is aligned or nearly aligned with one of the flow tube profiles 815*p*. The ball 250 may be launched from the surface and pumped down through the drill string until the ball 250 lands on the seat 910*b*. Continued pumping may exert fluid pressure on the ball 250, thereby driving the mandrel 910 longitudinally downward and moving the inner members 915*i* relative to the outer members 915*o*.

Once the ball 250 has landed and the wedges 915 have operated, pumping may be halted and pressure maintained. The fasteners 916*o* may be pushed outward by the relative longitudinal movement of the wedges 915. The fasteners 916*o* may push the cleat 930 into engagement with an inner surface of the flow tube 815. If the cleat 930 is misaligned with one of the flow tube profiles 815*p*, then the shifting tool 900 may be raised and/or lowered until the cleat 930 is aligned with one of the flow tube profiles 815*p*. The Belleville spring 931 may allow the cleat 930 to be pushed inward by the profile 815*p* during engagement of the profile 815*p* with the cleat 930. Engagement of the cleat 930 with the profile 815*p* may bi-directionally longitudinally connect the shifting tool 900 and the flow tube 815. The shifting tool 900 may be raised or lowered to open or close the isolation valve 800.

As the shifting tool 900 and flow tube 815 are being raised or lowered, the snap rings 817 may engage the grooves 805*g* causing increased resistance to raising or lowering of the shifting tool and flow tube. This increased resistance may be detectable at the surface by the driller. Further, the resistance may prevent unintentional actuation of the power sub due to incidental contact with the drill string during drilling. Each groove 805*g* may correspond to a predetermined position of the flow tube 815. A first groove 805*g* may correspond to engagement of the flow tube 815 with the flapper 820 and a second groove 805*g* may correspond to seating of the flow tube 815 on the flow tube seat. In this manner, if the isolation valve 800 is unable to be fully actuated due to malfunction, a partial actuation may be detected and may be sufficient to continue drilling operations. Additionally, a groove 805*g* may be formed in the housing 805 corresponding to the closed position of the flapper 820 to indicate that the cleat has engaged the profile (when opening the isolation valve 800).

For example, if engagement with the first groove 805*g* is detected but engagement with the second groove 805*g* is obstructed, the driller may know that the flapper 820 has been moved to the open position but is unable to verify that the flow tube 815 has seated. Opening of the flapper 820 may be sufficient for drilling operations to continue as the open flapper 820 may not obstruct passage of the drill string through the isolation valve 800. The grooves may also provide position indication when closing the isolation valve 800. Once the isolation valve 800 has been actuated, pumping of fluid into the drill string may resume, thereby increasing pressure exerted on the ball 250 until the ball 250 deforms and passes through the mandrel 910 to the catcher 950.

Additionally, any of the other power subs 1*o,c*, 300, 500 may include an indicator similar to the indicator 805*g*, 815*g*, 817 to provide resistance to initial operation thereof detectable at the surface and to prevent unintentional operation of the power subs due to incidental contact with the drill string during drilling.

Alternatively, any of the rotational power subs 1*o,c* 300 may include a gearbox instead of the helical profile.

Alternatively, any of the ball seats 210*b*, 435, 635, 910*b*, 1135 of the shifting tools 200, 400, 600, 900, 1100 may be chokes and extended inward to provide fluid restriction therethrough. The shifting tools may then be operated by injecting fluid therethrough at a rate greater than or equal to a threshold rate to create a pressure differential across the choke instead of pumping the ball 250/450 to operate the respective shifting tool. If a choke is used instead of the seats 435, 635, the chokes may retract in response to opening or closing of the valve.

Figure 19:
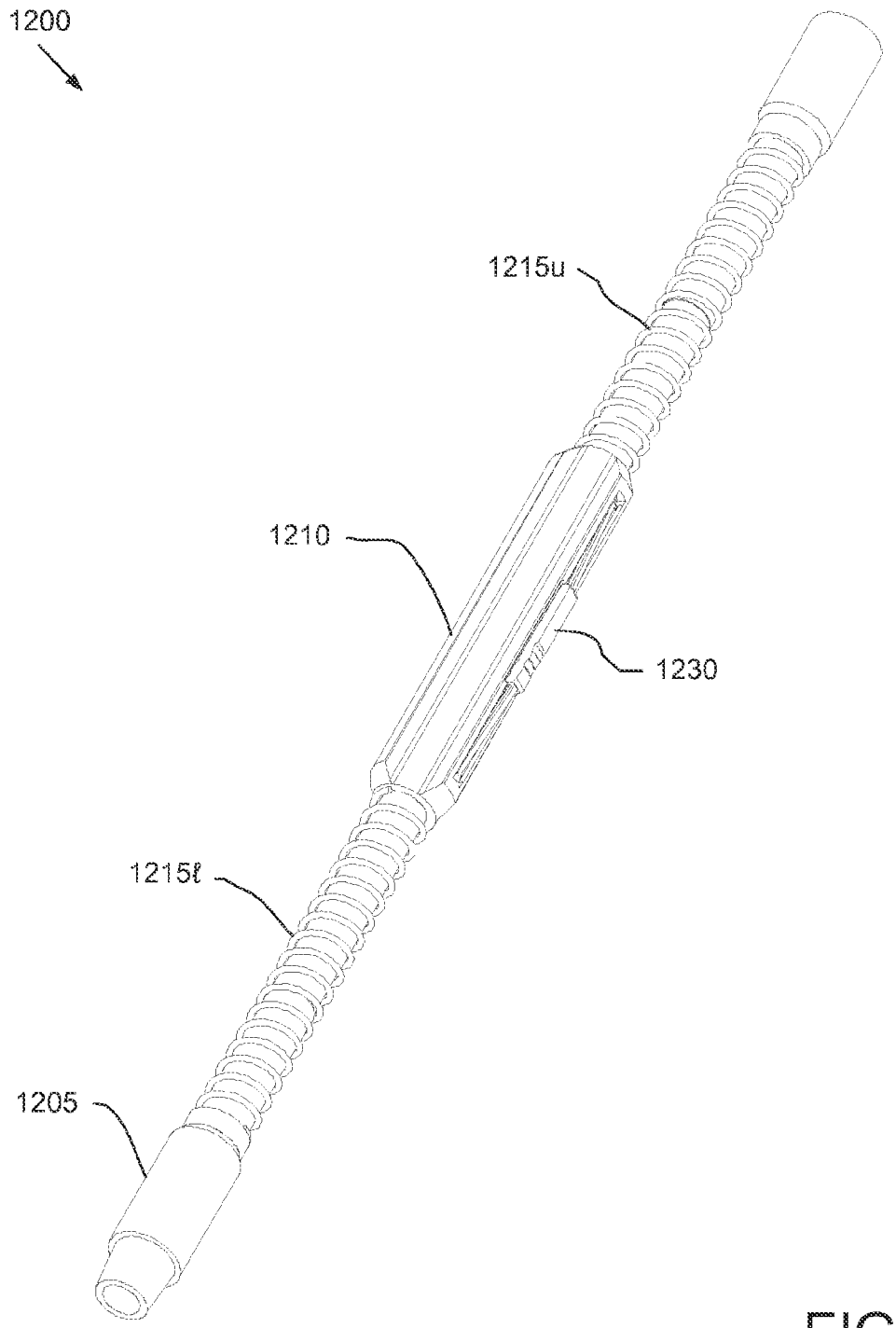
FIG. 19 illustrates a heave compensated shifting tool, according to another embodiment of the present invention.

FIG. 19 illustrates a heave compensated shifting tool 1200, according to another embodiment of the present invention. The shifting tool 1200 may include a tubular housing 1205, a tubular mandrel 1210, one or more biasing members, such as upper spring 1215*u* and lower spring 1215*l* and one or more latches, such as cleats 1230. The housing 1205 may have couplings formed at each longitudinal end thereof for connection with other components of a drill string. The couplings may be threaded, such as a box and a pin. The housing 1205 may have a central longitudinal bore formed therethrough for conducting drilling fluid. The housing 1205 may include two or more sections facilitate manufacturing and assembly, each section connected together, such as fastened with threaded connections. The shifting tool 1200 may be operable with either of the power subs 500, 800. The housing 1205 may be longitudinally movable relative to the mandrel 1210 to account for drill string heave during operation. Alternatively, the mandrel may be rotationally connected to the housing while retaining longitudinal movement capability, such as by a splined connection, and the shifting tool may be used with any of the power subs 1, 300, 700 instead of or in addition to elongated mandrel slots to account for heave.

FIGS. 20A-20H illustrate a method of drilling and completing a wellbore 1005, according to another embodiment of the present invention. An upper section of a wellbore 1005 through a non-productive formation 1030*n* has been drilled using a drilling rig 1000. A casing string 1015 has been installed in the wellbore 1005 and cemented 1010 in place. One of the isolation valve/assemblies discussed and illustrated above has been assembled as part of the casing string 1015 and is represented by the depiction of a flapper 1020. Alternatively, as discussed above, the isolation valve/assembly may instead be assembled as part of a tie-back casing string received by a polished bore receptacle of a liner string cemented to the wellbore. The isolation valve 1020 may be in the open position for deployment and cementing of the casing string. Once the casing string 1015 has been deployed and cemented, a drill string 1050 may be deployed into the wellbore for drilling of a productive hydrocarbon bearing (i.e., crude oil and/or natural gas) formation 1030*p*.

The drilling rig 1000 may be deployed on land or offshore. If the wellbore 1005 is subsea, then the drilling rig 1000 may be a mobile offshore drilling unit, such as a drillship or semisubmersible. The drilling rig 1000 may include a derrick (not shown). The drilling rig 1000 may further include drawworks (not shown) for supporting a top drive (not shown). The top drive may in turn support and rotate the drill string 1050. Alternatively, a Kelly and rotary table (not shown) may be used to rotate the drill string instead of the top drive. The drilling rig 1000 may further include a rig pump (not shown) operable to pump drilling fluid 1045*f* from of a pit or tank (not shown), through a standpipe and Kelly hose to the top drive. The drilling fluid may include a base liquid. The base liquid may be refined oil, water, brine, or a water/oil emulsion. The drilling fluid may further include solids dissolved or suspended in the base liquid, such as organophilic clay, lignite, and/or asphalt, thereby forming a mud. The drilling fluid may further include a gas, such as diatomic nitrogen mixed with the base liquid, thereby forming a two-phase mixture. If the drilling fluid is two-phase, the drilling rig 1000 may further include a nitrogen production unit (not shown) operable to produce commercially pure nitrogen from air.

The drilling fluid 1045*f* may flow from the standpipe and into the drill string 1050 via a swivel (Kelly or top drive, not shown). The drilling fluid 1045*f* may be pumped down through the drill string 1050 and exit a drill bit 1050*b*, where the fluid may circulate the cuttings away from the bit 1050*b* and return the cuttings up an annulus 1025 formed between an inner surface of the casing 1015 or wellbore 1005 and an outer surface of the drill string 1050. The return mixture (returns) 1045*r* may return to a surface 1035 of the earth and be diverted through an outlet 1060*o* of a rotating control device (RCD) 1060 and into a primary returns line (not shown). The returns 1045*r* may then be processed by one or more separators (not shown). The separators may include a shale shaker to separate cuttings from the returns and one or more fluid separators to separate the returns into gas and liquid and the liquid into water and oil.

The RCD 1060 may provide an annular seal 1060*s* around the drill string 1050 during drilling and while adding or removing (i.e., during a tripping operation to change a worn bit) segments or stands to/from the drill string 1050. The RCD 1060 achieves fluid isolation by packing off around the drill string 1050. The RCD 1060 may include a pressure-containing housing mounted on the wellhead where one or more packer elements 1060*s* are supported between bearings and isolated by mechanical seals. The RCD 1060 may be the active type or the passive type. The active type RCD uses external hydraulic pressure to activate the packer elements 1060*s*. The sealing pressure is normally increased as the annulus pressure increases. The passive type RCD uses a mechanical seal with the sealing action supplemented by wellbore pressure. One or more blowout preventers (BOPs) 1055 may be attached to the wellhead 1040.

A variable choke valve 1065 may be disposed in the returns line. The choke 1065 may be in communication with a programmable logic controller (PLC) 1070 and fortified to operate in an environment where the returns 1045*r* contain substantial drill cuttings and other solids. The choke 1065 may be employed during normal drilling to exert back pressure on the annulus 1025 to control bottom hole pressure exerted by the returns on the productive formation. The drilling rig may further include a flow meter (not shown) in communication with the returns line to measure a flow rate of the returns and output the measurement to the PLC 1070. The flow meter may be single or multi-phase. Alternatively, a flow meter in communication with the PLC 1070 may be in each outlet of the separators to measure the separated phases independently.

Alternatively, the choke 1065 and the RCD 1060 may be omitted.

The PLC 1070 may further be in communication with the rig pump to receive a measurement of a flow rate of the drilling fluid injected into the drill string. In this manner, the PLC may perform a mass balance between the drilling fluid 1045*f* and the returns 1045*r* to monitor for formation fluid 1090 entering the annulus 1025 or drilling fluid 1045*f* entering the formation 1030*p*. The PLC 1070 may then compare the measurements to calculated values by the PLC 1070. If nitrogen is being used as part of the drilling fluid, then the flow rate of the nitrogen may be communicated to the PLC via a flow meter in communication with the nitrogen production unit or a flow rate measured by a booster compressor in communication with the nitrogen production unit. If the values exceed threshold values, the PLC 1070 may take remedial action by adjusting the choke 1065. A first pressure sensor (not shown) may be disposed in the standpipe, a second pressure sensor (not shown) may be disposed between the RCD outlet 1060*o* and the choke 1065, and a third pressure sensor (not shown) may be disposed in the returns line downstream of the choke 1065. The pressure sensors may be in data communication with the PLC.

The drill string 1050 may include a deployment string, such as drill pipe 1050*p*, the drill bit 1050*b* disposed on a longitudinal end thereof, one of the shifting tools discussed above (depicted by 1050*s*). Alternatively, the deployment string may be casing, liner, or coiled tubing instead of the drill pipe 1050*p*. The drill string 1050 may also include a bottom hole assembly (BHA) (not shown) that may include the bit 1050*b*, drill collars, a mud motor, a bent sub, measurement while drilling (MWD) sensors, logging while drilling (LWD) sensors and/or a float valve (to prevent backflow of fluid from the annulus). The mud motor may be a positive displacement type (i.e., a Moineau motor) or a turbomachine type (i.e., a mud turbine). The drill string 1050 may further include float valves distributed therealong, such as one in every thirty joints or ten stands, to maintain backpressure on the returns while adding joints thereto. The drill string 1050 may also include one or more centralizers 1050*c* (FIG. 18D) spaced therealong at regular intervals. The drill bit 1050*b* may be rotated from the surface by the rotary table or top drive and/or downhole by the mud motor. If a bent sub and mud motor is included in the BHA, slide drilling may be effected by only the mud motor rotating the drill bit and rotary or straight drilling may be effected by rotating the drill string from the surface slowly while the mud motor rotates the drill bit. Alternatively, if coiled tubing is used instead of drill pipe, the BHA may include an orienter to switch between rotary and slide drilling. If the deployment string is casing or liner, the liner or casing may be suspended in the wellbore 1005 and cemented after drilling. If the deployment string 1050 is coiled tubing or other non-jointed tubular, a stripper or pack-off elements (not shown) may be used instead of the RCD 1060.

The drill string 1050 may be operated to drill through the casing shoe 1015*s* and then to extend the wellbore 1005 by drilling into the productive formation 1030*p*. A density of the drilling fluid 1045*f* may be less than or substantially less than a pore pressure gradient of the productive formation 1030*p*. A free flowing (non-choked) equivalent circulation density (ECD) of the returns 1045*r* may also be less than or substantially less than the pore pressure gradient. During drilling, the variable choke 1065 may be controlled by the PLC 1070 to maintain the ECD to be equal to (managed pressure) or less than (underbalanced) the pore pressure gradient of the productive formation 1030*p*. If, during drilling of the productive formation, the drill bit 1050*b* needs to be replaced or after total depth is reached, the drill string 1050 may be removed from the wellbore 1005. The drill string 1050 may be raised until the drill bit 1050*b* is above the flapper 1020 and the shifting tool 1050*s* is aligned with the power sub. The shifting tool 1050*s* may then be operated to engage the power sub (or one of the power subs) to close the flapper 1020.

The drill string 1050 may then be further raised until the BHA/drill bit 1050*b* is proximate the wellhead 1040. An upper portion of the wellbore 1005 (above the flapper 1020) may then be vented to atmospheric pressure. The returns 1045*r* may also be displaced from the upper portion of the wellbore using air or nitrogen. The RCD 1060 may then be opened or removed so that the drill bit/BHA 1050*b* may be removed from the wellbore 1005. If total depth has not been reached, the drill bit 1050*b* may be replaced and the drill string 1050 may be reinstalled in the wellbore. The annulus 1025 may be filled with drilling fluid 1045*f*, pressure in the upper portion of the wellbore 1005 may be equalized with pressure in the lower portion of the wellbore 1005. The shifting tool 1050*s* may be operated to engage the power sub and open the flapper 1020. Drilling may then resume. In this manner, the productive formation 1030*p* may remain live during tripping due to isolation from the upper portion of the wellbore by the closed flapper 1020, thereby obviating the need to kill the productive formation 1030*p*.

Once drilling has reached total depth, the drill string 1050 may be retrieved to the drilling rig as discussed above. A liner string, such as an expandable liner string 1075*l*, may then be deployed into the wellbore 1005 using a workstring 1075. The workstring 1075 may include an expander 1075*e*, the shifting tool 1050*s*, a packer 1075*p* and the string of drill pipe 1050*p*. The expandable liner 1075*l* may be constructed from one or more layers, such as three. The three layers may include a slotted structural base pipe, a layer of filter media, and an outer shroud. Both the base pipe and the outer shroud may be configured to permit hydrocarbons to flow through perforations formed therein. The filter material may be held between the base pipe and the outer shroud and may serve to filter sand and other particulates from entering the liner 1075*l*. The liner string 1075*l* and workstring 1050*s* may be deployed into the live wellbore using the isolation valve 1020, as discussed above for the drill string 1050. Once deployed, the expander 1075*e* may be operated to expand the liner 1075*l* into engagement with a lower portion of the wellbore traversing the productive formation 1030*p*. Once the liner 1075*l* has been expanded, the packer 1070*s* may be set against the casing 1015. The packer 1075*p* may include a removable plug set in a housing thereof, thereby isolating the productive formation 1030*p* from the upper portion of the wellbore 1005. The packer housing may have a shoulder for receiving a production tubing string 1080. Once the packer is set, the expander 1075*e*, the shifting tool 1050*s*, and the drill pipe 1050*p* may be retrieved from the wellbore using the isolation valve 1020 as discussed above for the drill string 1050.

Alternatively, a conventional solid liner may be deployed and cemented to the productive formation 1030*p* and then perforated to provide fluid communication. Alternatively, a perforated liner (and/or sandscreen) and gravel pack may be installed or the productive formation 1030*p* may be left exposed (a.k.a. barefoot).

The RCD 1060 and BOP 1055 may be removed from the wellhead 1040. A production (also known as Christmas) tree 1085 may then be installed on the wellhead 1040. The production tree 1085 may include a body 1085*b*, a tubing hanger 1085*h*, a production choke 1085*v*, and a cap 1085*c* and/or plug. Alternatively, the production tree 1085 may be installed after the production tubing 1080 is hung from the wellhead 1040. The production tubing 1080 may then be deployed and may seat in the packer body. The packer plug may then be removed, such as by using a wireline or slickline and a lubricator. The tree cap 1085*c* and/or plug may then be installed. Hydrocarbons 1090 produced from the formation 1030*p* may enter a bore of the liner 1075*l*, travel through the liner bore, and enter a bore of the production tubing 1080 for transport to the surface 1035.

Figure 21:
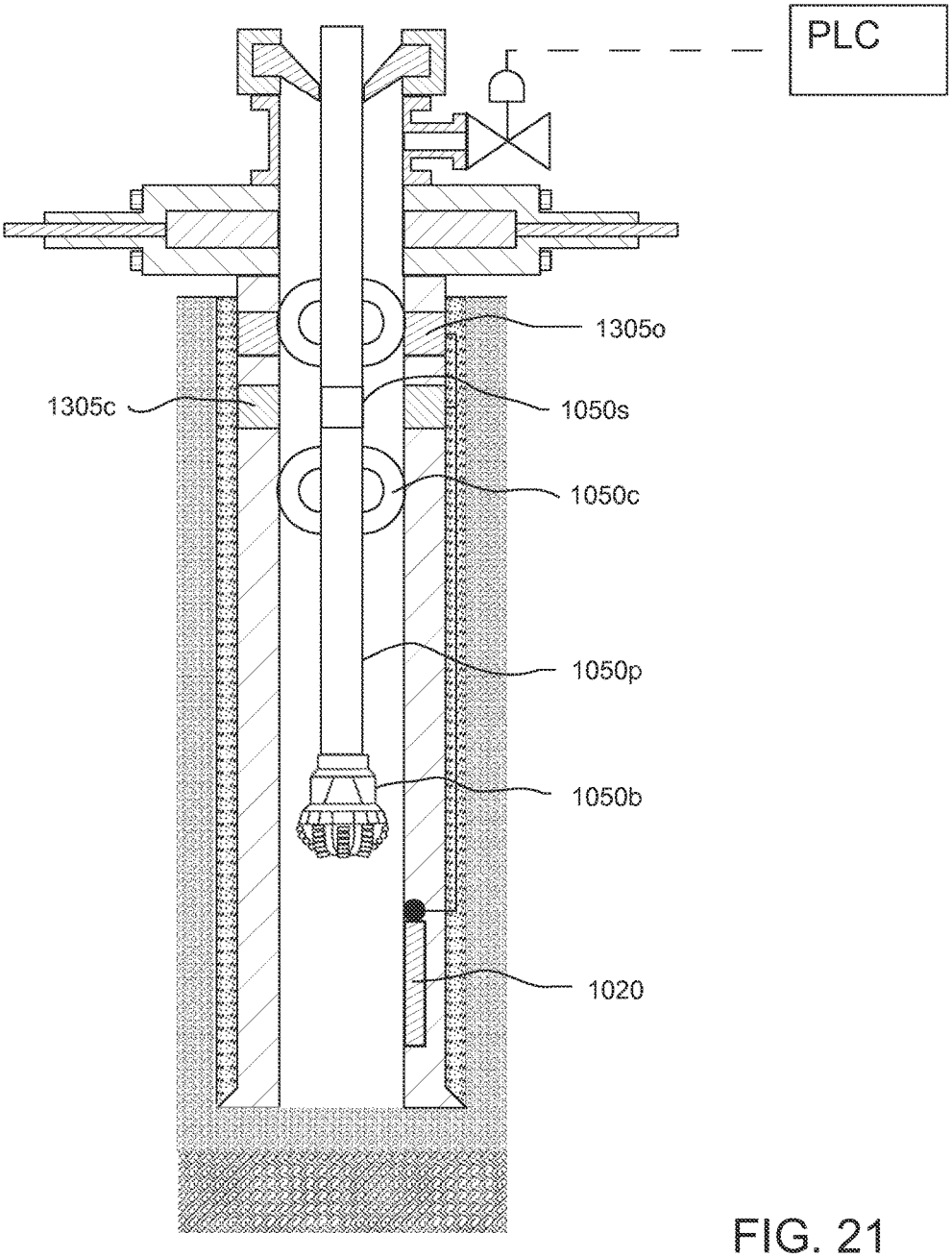
FIG. 21 illustrates a method of drilling a wellbore, according to another embodiment of the present invention.

FIG. 21 illustrates a method of drilling a wellbore, according to another embodiment of the present invention. Instead of being located proximate the isolation valve 1020, one or more of the power subs 1305*o,c* (may be any of the power subs discussed above) may be located along the casing at a depth substantially above the isolation valve 1020, such as proximate to the wellhead 1040. This distal placement of the power subs 1305*o,c* allows the shifting tool 1050*s* to be located along the drill string 1050 at a location distal from the bit 1050*b*. The distal placement of the shifting tool 1050*s* may allow the shifting tool to remain in the upper portion of the wellbore 1005 while the productive formation 1030*p* is being drilled, thereby reducing wear of the shifting tool 1050*s* and reducing risk of malfunction. The upper portion of the wellbore may be cased (shown) or may be a bare vertical portion of the wellbore. Additionally or alternatively, distal placement of the power subs 1305*o,c* may also be used to accommodate long BHAs (without having to place the shifting tool 1050*s* proximate the bit 1050*b*). Additionally or alternatively, distal placement of the power subs 1305*o,c* may also be used to deploy the liner 1075*l* using an alternative of the workstring 1075 such that the workstring does not have to extend through the liner.

In another embodiment (not shown), a valve and power subs may be assembled as part of the production tubing string 1080. The power subs may be in communication with the valve and operable to open and close the valve, respectively. The valve may be a subsurface safety valve (SSV), a flow control valve, or a shutoff valve. The SSV may close a bore of the production tubing to isolate the productive formation 1130*p* from the upper portion of the wellbore. The flow control and shutoff valves may be employed for selectively producing from a lateral wellbore (not shown) extending to a second productive formation (not shown). The flow control and shutoff valve may selectively open, close, and meter (flow control valve only) one or more ports formed through a wall of the production tubing for receiving fluid flow from the lateral wellbore. The shifting tool may then be deployed as part of a work string. The work string may further include a BHA and a deployment string, such as drill pipe, coiled tubing, or wireline. The BHA may be used in a completion operation or an intervention operation.

While the foregoing is directed to embodiments of the present invention, other and further embodiments of the invention may be devised without departing from the basic scope thereof, and the scope thereof is determined by the claims that follow.

In one embodiment, a shifting tool for use in a wellbore includes a tubular housing having a bore formed therethrough; a tubular mandrel disposed in the housing and longitudinally movable relative thereto; and an engagement member moveable relative to the housing between an extended position, a released position, and a retracted position, wherein: the engagement member is movable from the retracted position to the extended position in response to movement of the mandrel relative to the housing, and the engagement member is further movable from the extended position to the released position in response to further movement of the mandrel relative to the housing.

In one or more of the embodiments described herein, the shifting tool includes a cam operably connecting the engagement member and the mandrel.

In one or more of the embodiments described herein, the engagement member is pivoted to the housing.

In one or more of the embodiments described herein, the shifting tool includes a seat longitudinally connected to the mandrel and radially movable relative thereto between an engaged position for receiving a blocking member and a disengaged position for releasing the blocking member.

In one or more of the embodiments described herein, the seat is operable to move to the disengaged position when the engagement member is in the released position.

In one or more of the embodiments described herein, the shifting tool includes one or more variable volume hydraulic reservoirs for thermal compensation.

In one or more of the embodiments described herein, the engagement member is further movable to a collapsed position in response to engagement of the engagement member with a top of a profile in the wellbore.

In one or more of the embodiments described herein, the engagement member includes an arm.

In another embodiment, a method of operating a shifting tool in a wellbore includes aligning a release member of the shifting tool with a profile in the wellbore; landing a blocking member in the shifting tool; moving a mandrel in the shifting tool downward relative to a housing of the shifting tool; radially extending the release member to a first position, wherein the release member at least partially extends into the profile; rotating the shifting tool, thereby actuating a tool in the wellbore; radially extending the release member to a second position in response to the actuation of the tool, wherein the tool causes the release member to radially extend to the second position; and releasing the blocking member from the shifting tool in response to the release member extending to the second position.

In one or more of the embodiments described herein, the tool includes an isolation valve.

In one or more of the embodiments described herein, the isolation valve isolates a formation and an upper portion of the wellbore in a closed position.

In one or more of the embodiments described herein, the release member is prevented from extending from the first position to the second position until the tool is actuated.

In one or more of the embodiments described herein, the profile is formed in an actuator.

In one or more of the embodiments described herein, increasing fluid pressure behind the blocking member causes the mandrel to move downward.

In one or more of the embodiments described herein, the method includes setting a liner string in the wellbore.

In one or more of the embodiments described herein, setting the liner includes expanding the liner into engagement with the wellbore.

In one or more of the embodiments described herein, the release member extends using a cam and follower arrangement.

In one or more of the embodiments described herein, the method includes setting a packer, wherein the packer includes a removable plug configured to isolate a productive portion of a formation and an upper portion of the wellbore.

In one or more of the embodiments described herein, removing the plug from the packer unblocks fluid communication between the productive portion of the formation and the production tubing.

In one or more of the embodiments described herein, the method includes producing from the productive portion of the formation.

In another embodiment, a power sub for use in a wellbore includes a tubular housing having a bore formed therethrough; a tubular mandrel disposed in the housing, movable relative thereto, and having a profile for receiving a driver of a shifting tool; a first piston operably coupled to the mandrel and operable to pump hydraulic fluid to an outlet of the housing; and a release operable to receive a release of the shifting tool after operation of the power sub, thereby depressurizing the shifting tool.

In one or more of the embodiments described herein, the mandrel is rotatable relative to the housing, and rotation of the mandrel longitudinally moves the first piston relative thereto.

In one or more of the embodiments described herein, the release comprises a sleeve disposed between the mandrel and the housing, connected to the mandrel by a cam, and having a profile; a second piston in fluid communication with an inlet of the housing and operable to move the sleeve longitudinally relative to the mandrel from a first position to a second position, wherein the profile radially increases when the sleeve moves from the first position to the second position.

In another embodiment, a power sub for use in a casing includes a tubular housing having a bore formed therethrough; a tubular mandrel disposed in the housing and rotatable relative thereto; and a piston operably coupled to the mandrel such that rotation of the mandrel longitudinally reciprocates the piston relative thereto, thereby pumping hydraulic fluid to an outlet of the housing.

In one or more of the embodiments described herein, the piston is disposed in a pump, the piston longitudinally reciprocates between a first position and a second position, and the piston is operably coupled to the mandrel via a bearing.

In one or more of the embodiments described herein, the pump includes a plurality of pistons operatively coupled to the mandrel via respective bearings.

In one or more of the embodiments described herein, the piston is configured to draw hydraulic fluid from a reservoir when the piston moves toward the first position.

In one or more of the embodiments described herein, the piston is configured to drive hydraulic fluid into a pressure chamber when the piston moves toward the second position.

In one or more of the embodiments described herein, the pressure chamber is in fluid communication with an isolation valve.

In another embodiment, an isolation assembly for use in a wellbore includes a power sub; an isolation valve; a toggle sub operable between a first position and a second position, wherein when the toggle sub is in the first position the isolation valve closes upon operation of the power sub and when the toggle sub is in the second position the isolation valve opens upon operation of the power sub.

In one or more of the embodiments described herein, the toggle sub is longitudinally movable between the first and second position.

In one or more of the embodiments described herein, the toggle sub is rotationally movable between the first and second position.

In one or more of the embodiments described herein, the toggle sub includes a profile for receiving a shifting tool.

In one or more of the embodiments described herein, the power sub includes a profile for receiving the shifting tool.

In one or more of the embodiments described herein, the power sub includes a tubular housing having a bore formed therethrough; a tubular mandrel disposed in the housing, movable relative thereto, and having the profile for receiving the shifting tool; a first piston operably coupled to the mandrel and operable to pump hydraulic fluid to an outlet of the housing; and a release operable to receive a release of the shifting tool after operation of the power sub, thereby depressurizing the shifting tool.

In another embodiment, a fluid circuit for actuating a tool in a wellbore includes a reservoir; a tubular having a bore therethrough; a first flow path between the reservoir and the tool, the first flow path isolated from the bore, wherein fluid flow in the first flow path from the reservoir to the tool actuates the tool from a first state to a second state; and a second flow path between the tool and a piston, wherein fluid flow in the second flow path from the tool to the piston is caused by the actuation of the tool from the first state to the second state and fluid flow in the second flow path from the tool to the piston causes the piston to move from a first position and a second position.

In one or more of the embodiments described herein, the fluid circuit includes a third flow path between the piston and a second piston, wherein fluid flow in the third flow path from the piston to the second piston causes the second piston to move from a first position to a second position.

In one or more of the embodiments described herein, the fluid circuit includes a fourth fluid path between the second piston and the reservoir, wherein fluid flow in the fourth flow path from the second piston to the reservoir is caused by the movement of the second piston from the first position to the second position.

The invention claimed is:

1. A shifting tool for use in a wellbore, comprising:

a tubular housing having a bore formed therethrough;

a tubular mandrel disposed in the tubular housing and longitudinally movable relative thereto;

a driver radially movable relative to the housing between an extended position and a retracted position; and an engagement member moveable relative to the tubular housing between an extended position, a released position, and a retracted position, wherein:

the engagement member is movable from the retracted position to the extended position in response to movement of the mandrel relative to the tubular housing, and the engagement member is further movable from the extended position to the released position in response to further movement of the mandrel relative to the tubular housing.

2. The shifting tool of claim 1, further comprising a cam operably connecting the engagement member and the mandrel.

3. The shifting tool of claim 1, wherein the engagement member is pivoted to the tubular housing.

4. The shifting tool of claim 1, further comprising a seat connected to the mandrel and radially movable relative thereto between an engaged position for receiving a blocking member and a disengaged position for releasing the blocking member, and wherein the seat is radially movable between the disengaged position and the engaged position.

5. The shifting tool of claim 4, wherein the seat is operable to move to the disengaged position when the engagement member is in the released position.

6. The shifting tool of claim 1, further comprising one or more variable volume hydraulic reservoirs for thermal compensation.

7. The shifting tool of claim 1, wherein the engagement member includes an arm.

8. The shifting tool of claim 1, further comprising:

a piston disposed in the tubular housing and longitudinally movable relative thereto, and wherein the driver is movable from the retracted position to the extended position in response to the movement of the piston relative to the tubular housing.

9. The shifting tool of claim 8, further comprising at least one radial piston between the driver and the piston.

10. A method of operating a shifting tool in a wellbore, comprising:

aligning a release member of the shifting tool with a profile in the wellbore;

landing a blocking member in the shifting tool;

moving a mandrel in the shifting tool downward relative to a housing of the shifting tool;

radially extending the release member to a first position, wherein the release member at least partially extends into the profile;

rotating the shifting tool, thereby actuating a tool in the wellbore;

radially extending the release member to a second position in response to the actuation of the tool, wherein the tool causes the release member to radially extend to the second position; and releasing the blocking member from the shifting tool in response to the release member extending to the second position.

11. The method of claim 10, wherein the tool includes an isolation valve.

12. The method of claim 11, wherein the isolation valve isolates a formation and an upper portion of the wellbore in a closed position.

13. The method of claim 10, wherein the release member is prevented from extending from the first position to the second position until the tool is actuated.

14. The method of claim 10, wherein the profile is formed in an actuator.

15. The method of claim 10, wherein increasing fluid pressure behind the blocking member causes the mandrel to move downward.

16. The method of claim 10, further comprising setting a liner string in the wellbore.

17. The method of claim 16, wherein setting the liner string includes expanding the liner string into engagement with the wellbore.

18. The method of claim 10, wherein the release member extends using a cam and follower arrangement.

19. The method of claim 10, further comprising setting a packer, wherein the packer includes a removable plug configured to isolate a productive portion of a formation and an upper portion of the wellbore.

20. The method of claim 19, further comprising removing the removable plug from the packer, wherein removing the plug from the packer unblocks fluid communication between the productive portion of the formation and the upper portion of the wellbore.

21. The method of claim 20, further comprising producing from the productive portion of the formation.

* * * * *